US012157985B2

(12) United States Patent
Ito

(10) Patent No.: US 12,157,985 B2
(45) Date of Patent: Dec. 3, 2024

(54) SHOVEL AND CONTROL DEVICE FOR SHOVEL

(71) Applicant: SUMITOMO HEAVY INDUSTRIES, LTD., Tokyo (JP)

(72) Inventor: Tsutomu Ito, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 676 days.

(21) Appl. No.: 17/319,309

(22) Filed: May 13, 2021

(65) Prior Publication Data

US 2021/0262190 A1 Aug. 26, 2021

Related U.S. Application Data

(63) Continuation of application No. PCT/JP2019/044786, filed on Nov. 14, 2019.

(30) Foreign Application Priority Data

Nov. 14, 2018 (JP) ..... 2018-214164

(51) Int. Cl.
*E02F 9/00* (2006.01)
*E02F 3/32* (2006.01)
(Continued)

(52) U.S. Cl.
CPC ..... *E02F 3/435* (2013.01); *E02F 3/32* (2013.01); *E02F 9/123* (2013.01); *E02F 9/2037* (2013.01);
(Continued)

(58) Field of Classification Search
CPC ..... E02F 3/435; E02F 3/32; E02F 9/123; E02F 9/2037; E02F 9/2203; E02F 9/2271;
(Continued)

(56) References Cited

U.S. PATENT DOCUMENTS 5,572,809 A * 11/1996 Steenwyk ..... E02F 3/437 701/50
5,704,429 A * 1/1998 Lee ..... E02F 9/2004 701/50
(Continued)

FOREIGN PATENT DOCUMENTS

JP S51-048503 4/1976
JP H03-024933 4/1991
(Continued)

OTHER PUBLICATIONS

JP-H0720352-U machine translation (Year: 1995).*
(Continued)

*Primary Examiner* — Angelina M Shudy
(74) *Attorney, Agent, or Firm* — IPUSA, PLLC

(57) ABSTRACT

A shovel includes a lower travelling body; an upper pivot body pivotably mounted to the lower travelling body; an attachment attached to the upper pivot body; a plurality of actuators that include a first actuator and a second actuator, and drive the attachment and the upper pivot body; and a control device that controls an operation of another actuator of the plurality of actuators other than the first actuator in accordance with an operation of the first actuator so that the attachment is along a target trajectory. The control device operates the second actuator so that the attachment is along the target trajectory, when a predetermined condition is satisfied.

13 Claims, 30 Drawing Sheets

(51) Int. Cl.

| | |
|---|---|
| ***E02F 3/43*** | (2006.01) |
| ***E02F 9/12*** | (2006.01) |
| ***E02F 9/20*** | (2006.01) |
| ***E02F 9/22*** | (2006.01) |
| ***E02F 9/24*** | (2006.01) |
| ***E02F 9/26*** | (2006.01) |

(52) U.S. Cl.
CPC ..... *E02F 9/2203* (2013.01); *E02F 9/2271* (2013.01); *E02F 9/24* (2013.01); *E02F 9/262* (2013.01); *E02F 9/2285* (2013.01); *E02F 9/2292* (2013.01); *E02F 9/2296* (2013.01)

(58) Field of Classification Search
CPC ..... E02F 9/24; E02F 9/262; E02F 9/2285; E02F 9/2292; E02F 9/2296; E02F 3/437; E02F 9/205; E02F 9/265; E02F 9/2282; E02F 3/43; E02F 9/26; G05D 1/00
See application file for complete search history.

(56) References Cited

U.S. PATENT DOCUMENTS 5,735,065 A * 4/1998 Yamagata ..... E02F 3/437 701/50
5,826,666 A * 10/1998 Tozawa ..... E02F 3/437 172/7
5,903,988 A * 5/1999 Tochizawa ..... E02F 3/437 701/50
5,933,346 A * 8/1999 Brabec ..... E02F 3/437 340/684
6,076,029 A * 6/2000 Watanabe ..... E02F 3/437 37/340
6,167,336 A * 12/2000 Singh ..... E02F 9/2045 701/50
6,363,632 B1 * 4/2002 Stentz ..... E02F 9/24 701/50
7,210,890 B2 * 5/2007 Curotto ..... B65F 3/041 414/501
7,610,136 B2 * 10/2009 Okamura ..... E02F 9/2207 37/444
9,080,314 B1 * 7/2015 Rossi, Jr. ..... E02F 3/407
9,322,149 B2 * 4/2016 Takaura ..... E02F 3/43
9,458,598 B2 * 10/2016 Takaura ..... E02F 9/262
9,540,786 B2 * 1/2017 Ogawa ..... E02F 9/264
9,605,412 B2 * 3/2017 Ikegami ..... E02F 9/2033
9,616,748 B2 * 4/2017 Tsubone ..... B60K 35/00
9,677,251 B2 * 6/2017 Kitajima ..... E02F 3/3677
9,856,628 B2 * 1/2018 Kitajima ..... E02F 3/435
9,915,054 B2 * 3/2018 Wu ..... E02F 9/2285
10,132,056 B2 * 11/2018 Tsukamoto ..... E02F 3/32
10,190,288 B2 * 1/2019 Matson ..... E02F 9/2054
10,323,386 B2 * 6/2019 Kiyota ..... E02F 9/24
10,435,870 B2 * 10/2019 Narikawa ..... F02D 29/00
10,687,026 B2 * 6/2020 Izumikawa ..... E02F 9/261
10,927,527 B2 * 2/2021 Machida ..... G06V 20/58
11,001,985 B2 * 5/2021 Ito ..... E02F 9/2207
11,149,411 B2 * 10/2021 Edamura ..... E02F 9/265
11,377,813 B2 * 7/2022 Nakano ..... E02F 9/2267
11,414,841 B2 * 8/2022 Moriki ..... E02F 3/43
11,939,747 B2 * 3/2024 Itoh ..... E02F 9/261
2006/0099081 A1 * 5/2006 Toda ..... F15B 11/165 417/1
2007/0010925 A1 * 1/2007 Yokoyama ..... E02F 9/261 37/413
2008/0300757 A1 * 12/2008 Kanayama ..... E02F 9/2296 701/50
2009/0282710 A1 * 11/2009 Johnson ..... E02F 3/404 37/444
2010/0268407 A1 * 10/2010 Yanagisawa ..... B60K 6/46 180/65.265
2011/0154815 A1 * 6/2011 Lee ..... F15B 9/09 60/459
2011/0231070 A1 * 9/2011 Toda ..... F02D 41/021 701/50
2012/0239199 A1 * 9/2012 Danko ..... E02F 3/439 700/264
2013/0158784 A1 * 6/2013 Fukano ..... E02F 9/2033 701/34.4
2013/0158787 A1 * 6/2013 Nomura ..... E02F 9/26 701/34.4
2013/0158797 A1 * 6/2013 Fukano ..... E02F 9/2025 701/36
2013/0315699 A1 * 11/2013 Matsuyama ..... E02F 9/262 701/50
2014/0007942 A1 * 1/2014 Wang ..... E02F 9/2242 137/1
2014/0100712 A1 * 4/2014 Nomura ..... E02F 9/264 701/1
2014/0102289 A1 * 4/2014 Wu ..... E02F 9/2075 91/466
2014/0142817 A1 * 5/2014 Matsuyama ..... E02F 3/437 701/50
2014/0180444 A1 * 6/2014 Edara ..... G05D 1/0088 700/56
2014/0188373 A1 * 7/2014 Kawaguchi ..... B60W 20/00 701/110
2014/0200776 A1 * 7/2014 Matsuyama ..... E02F 9/264 701/50
2015/0019086 A1 * 1/2015 Hayashi ..... E02F 3/844 172/4
2015/0075895 A1 * 3/2015 Inada ..... B60K 13/04 180/309
2015/0240445 A1 * 8/2015 Guo ..... E02F 3/435 701/50
2015/0308081 A1 * 10/2015 Takaura ..... E02F 3/437 701/50
2015/0308082 A1 * 10/2015 Takaura ..... E02F 3/32 701/50
2016/0024757 A1 * 1/2016 Nomura ..... E02F 9/2054 701/32.3
2016/0024758 A1 * 1/2016 Ishimoto ..... G06T 3/047 348/139
2016/0069040 A1 3/2016 Kami et al.
2016/0097184 A1 4/2016 Matsuyama et al.
2016/0193920 A1 * 7/2016 Tsubone ..... B60K 35/00 701/36
2016/0265187 A1 * 9/2016 Baba ..... E02F 3/963
2016/0289928 A1 * 10/2016 Kitajima ..... E02F 3/32
2017/0089033 A1 * 3/2017 Matsuyama ..... E02F 9/2285
2017/0114519 A1 * 4/2017 Hague ..... G05B 19/402
2017/0139418 A1 * 5/2017 Hiramatsu ..... A01B 69/008
2017/0175364 A1 * 6/2017 Hasegawa ..... G06T 11/40
2017/0247861 A1 * 8/2017 Matsuyama ..... E02F 9/262
2017/0268204 A1 * 9/2017 Shimano ..... E02F 3/435
2017/0284070 A1 * 10/2017 Matsuyama ..... E02F 9/20
2018/0002900 A1 * 1/2018 Morimoto ..... E02F 9/261
2018/0080198 A1 * 3/2018 Machida ..... B60K 35/00
2018/0148904 A1 * 5/2018 Howell ..... E02F 3/32
2018/0209122 A1 * 7/2018 Kiyota ..... E02F 9/26
2018/0230671 A1 * 8/2018 Wu ..... E02F 3/437
2018/0238023 A1 * 8/2018 Dean ..... E02F 3/433
2018/0266083 A1 * 9/2018 Narikawa ..... E02F 3/435
2018/0338087 A1 * 11/2018 Oblak ..... G06F 3/04883
2018/0340316 A1 * 11/2018 Izumikawa ..... E02F 3/435
2019/0017248 A1 * 1/2019 Okada ..... E02F 9/20
2019/0024347 A1 * 1/2019 Izumikawa ..... E02F 9/264
2019/0078291 A1 * 3/2019 Shimano ..... E02F 3/437
2019/0106861 A1 * 4/2019 Izumi ..... E02F 3/43
2019/0119886 A1 * 4/2019 Izumi ..... E02F 9/20
2019/0127946 A1 * 5/2019 Sakai ..... E02F 9/2203
2019/0177948 A1 6/2019 Matsuyama
2019/0211532 A1 * 7/2019 Sakamoto ..... E02F 9/26
2019/0226181 A1 * 7/2019 Imura ..... E02F 9/2221
2019/0249391 A1 * 8/2019 Kikuchi ..... E02F 3/845
2019/0345697 A1 * 11/2019 Ishihara ..... E02F 3/435
2019/0352885 A1 * 11/2019 Kurokami ..... B66C 23/88
2019/0360179 A1 * 11/2019 Moriki ..... E02F 3/43
2019/0390436 A1 * 12/2019 Tanaka ..... E02F 9/2033
2020/0011029 A1 * 1/2020 Sano ..... E02F 9/2029

(56) References Cited

U.S. PATENT DOCUMENTS

| | | | | |
|---|---|---|---|---|
| 2020/0018045 | A1* | 1/2020 | Sano | E02F 9/245 |
| 2020/0032482 | A1* | 1/2020 | Meguriya | E02F 9/2033 |
| 2020/0048861 | A1* | 2/2020 | Narikawa | E02F 9/20 |
| 2020/0115882 | A1* | 4/2020 | Sano | E02F 9/2267 |
| 2020/0157768 | A1* | 5/2020 | Ito | E02F 9/2207 |
| 2020/0165798 | A1* | 5/2020 | Nishi | E02F 9/264 |
| 2020/0181883 | A1* | 6/2020 | Igarashi | G05B 19/416 |
| 2020/0199851 | A1* | 6/2020 | Yamamoto | E02F 9/26 |
| 2020/0217049 | A1* | 7/2020 | Mizuochi | H04W 4/025 |
| 2020/0217050 | A1* | 7/2020 | Chiba | E02F 3/435 |
| 2020/0232179 | A1* | 7/2020 | Sasaki | E02F 9/2041 |
| 2020/0277752 | A1* | 9/2020 | Igarashi | E02F 9/262 |
| 2020/0277758 | A1* | 9/2020 | Edamura | E02F 9/262 |
| 2020/0399864 | A1* | 12/2020 | Shike | E02F 9/26 |
| 2021/0002862 | A1* | 1/2021 | Ono | E02F 9/262 |
| 2021/0010229 | A1* | 1/2021 | Sano | E02F 3/436 |
| 2021/0010239 | A1* | 1/2021 | Ono | E02F 9/2041 |
| 2021/0040705 | A1* | 2/2021 | Ishihara | E02F 9/265 |
| 2021/0079625 | A1* | 3/2021 | Narikawa | E02F 9/261 |
| 2021/0148081 | A1* | 5/2021 | Nakano | E02F 3/437 |
| 2021/0230841 | A1* | 7/2021 | Kurosawa | E02F 9/24 |
| 2021/0262190 | A1* | 8/2021 | Ito | E02F 9/24 |
| 2021/0262191 | A1* | 8/2021 | Ito | E02F 9/2228 |
| 2021/0324603 | A1* | 10/2021 | Marotz | E02F 9/262 |
| 2022/0002970 | A1* | 1/2022 | Kurosawa | E02F 9/2033 |
| 2022/0002979 | A1* | 1/2022 | Sano | E02F 9/264 |
| 2022/0010519 | A1* | 1/2022 | Izumikawa | E02F 9/22 |
| 2022/0010526 | A1* | 1/2022 | Nishi | E02F 9/262 |
| 2022/0018097 | A1* | 1/2022 | Kurosawa | G05D 1/0005 |
| 2022/0064910 | A1* | 3/2022 | Nishimura | E02F 3/435 |
| 2022/0074165 | A1* | 3/2022 | Iwasaki | E02F 9/2203 |
| 2022/0127825 | A1* | 4/2022 | Iwasaki | E02F 9/262 |
| 2022/0127826 | A1* | 4/2022 | Taylor | E02F 7/06 |
| 2022/0170238 | A1* | 6/2022 | Kim | E02F 9/2033 |
| 2022/0186459 | A1* | 6/2022 | Igarashi | E02F 3/435 |
| 2022/0220695 | A1* | 7/2022 | Izumi | E02F 3/435 |
| 2022/0220696 | A1* | 7/2022 | Sugiyama | E02F 3/439 |
| 2022/0290402 | A1* | 9/2022 | Okada | E02F 9/267 |
| 2022/0316173 | A1* | 10/2022 | Narikawa | E02F 9/2285 |
| 2022/0333338 | A1* | 10/2022 | Hayakawa | E02F 9/264 |
| 2023/0313503 | A1* | 10/2023 | Hayakawa | E02F 9/2228 701/31.4 |
| 2023/0332375 | A1* | 10/2023 | Suzuki | E02F 9/2203 |
| 2023/0332379 | A1* | 10/2023 | Ishii | E02F 9/2278 |
| 2023/0392347 | A1* | 12/2023 | Nakamura | E02F 3/32 |
| 2024/0011252 | A1* | 1/2024 | Onodera | E02F 9/20 |
| 2024/0209591 | A1* | 6/2024 | Honda | E02F 3/437 |

FOREIGN PATENT DOCUMENTS

| | | | | |
|---|---|---|---|---|
| JP | H0720352 U | * | 4/1995 | |
| JP | H08-333768 | | 12/1996 | |
| JP | 2005-346740 | | 12/2005 | |
| JP | 2013-217137 | | 10/2013 | |
| JP | 2015-168973 | | 9/2015 | |
| JP | 2018-090989 | | 6/2018 | |
| WO | 2014/167718 | | 10/2014 | |
| WO | 2017/061485 | | 4/2017 | |
| WO | WO-2017094626 A1 | * | 6/2017 | E02F 9/26 |
| WO | WO-2017094627 A1 | * | 6/2017 | E02F 3/36 |

OTHER PUBLICATIONS

WO-2017094626-A1 machine translation (Year: 2017).*
WO-2017094627-A1 machine translation (Year: 2017).*
WO2017094627A1 machine translation description with page numbers (Year: 2017).*
International Search Report for PCT/JP2019/044786 mailed on Feb. 10, 2020.

* cited by examiner

SHOVEL AND CONTROL DEVICE FOR SHOVEL

CROSS-REFERENCE TO RELATED APPLICATION

The present application is continuation application of International Application No. PCT/JP2019/044786, filed Nov. 14, 2019, which claims priority to Japanese Patent Application No. 2018-214164 filed Nov. 14, 2018. The contents of these applications are incorporated herein by reference in their entirety.

BACKGROUND OF THE INVENTION

1. Field of the Invention

The present disclosure relates to shovels or the like.

2. Description of the Related Art

Conventionally, a shovel performing leveling excavation control where a claw edge of a bucket is moved along a design plane is known.

SUMMARY OF INVENTION

Problem to be Solved by the Invention

However, the leveling excavation control mode is control to adjust the relative speed of the bucket blade edge with respect to the design plane depending on the distance between the claw edge of the bucket and the design plane, and there is a possibility that the movement speed of the bucket blade edge moving along the design plane while retaining the distance between the bucket blade edge and the design plane cannot be appropriately controlled.

Therefore, in view of the above-described problem, the present disclosure aims at providing a technology that enables a portion of an attachment of a shovel to be a reference to move along a predetermined trajectory more appropriately.

Means to Solve the Problem

In order to achieve the above purpose, according to an embodiment of the disclosure, a shovel includes a lower travelling body; an upper pivot body pivotably mounted to the lower travelling body; an attachment attached to the upper pivot body; a plurality of actuators that include a first actuator and a second actuator, and drive the attachment and the upper pivot body; and a control device that controls an operation of another actuator of the plurality of actuators other than the first actuator in accordance with an operation of the first actuator so that the attachment is along a target trajectory. The control device operates the second actuator so that the attachment is along the target trajectory, when a predetermined condition is satisfied.

Moreover, according to another embodiment of the disclosure, a control device for a shovel includes a lower travelling body; an upper pivot body pivotably mounted to the lower travelling body; an attachment attached to the upper pivot body; and a plurality of actuators that include a first actuator and a second actuator and drive the attachment and the pivot body, controls an operation of another actuator of the plurality of actuators other than the first actuator in accordance with an operation of the first actuator so that the attachment is along a target trajectory, and operates the second actuator so that the attachment is along the target trajectory, when a predetermined condition is satisfied.

Effects of Invention

According to the above-described embodiments, it is possible to provide a technology that enables a portion of an attachment of a shovel serving as a reference to move along a predetermined trajectory more appropriately.

DESCRIPTION OF THE PREFERRED EMBODIMENTS

Embodiments will be described with reference to drawings as follows:

[Overview of Shovel]

First, a shovel 100 according to the embodiment of the present disclosure will be schematically described with reference to FIGS. 1 and 2.

Figure 1:
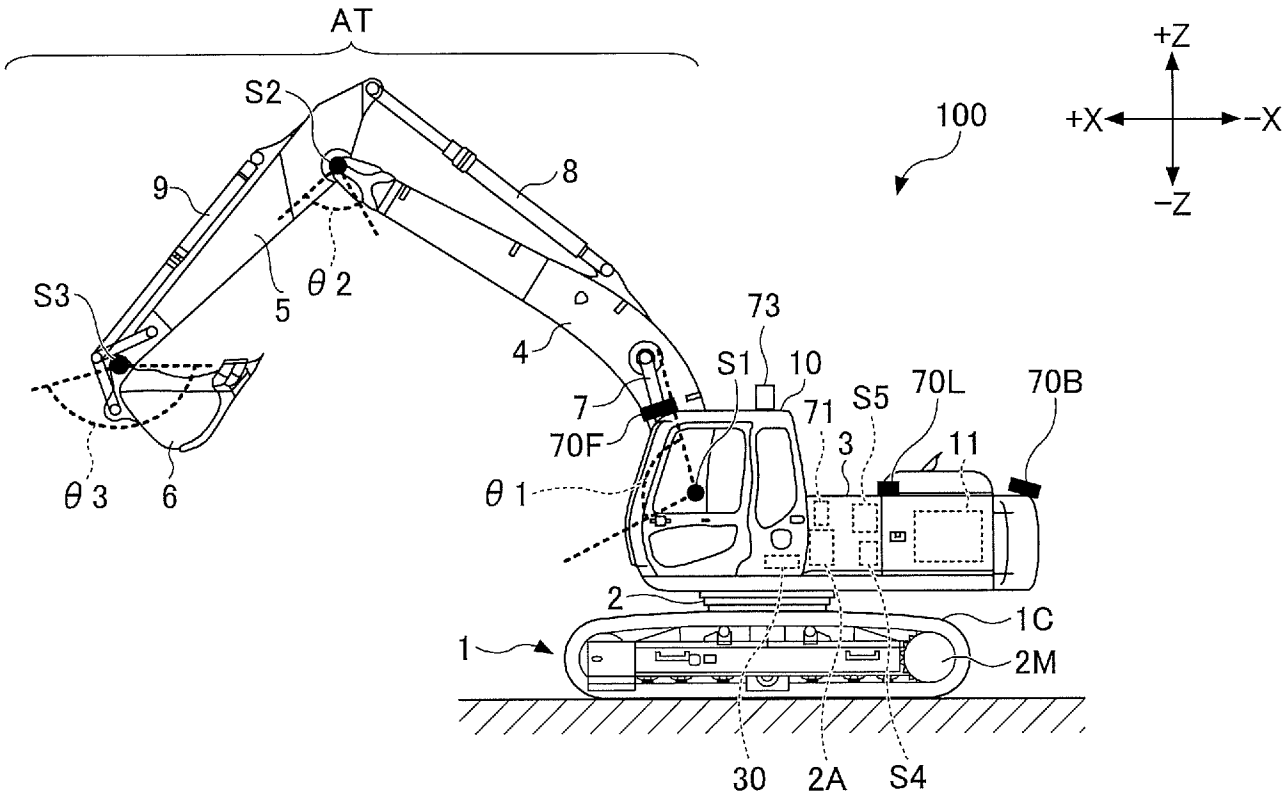
FIG. 1 is a side view of a shovel.
Figure 2:
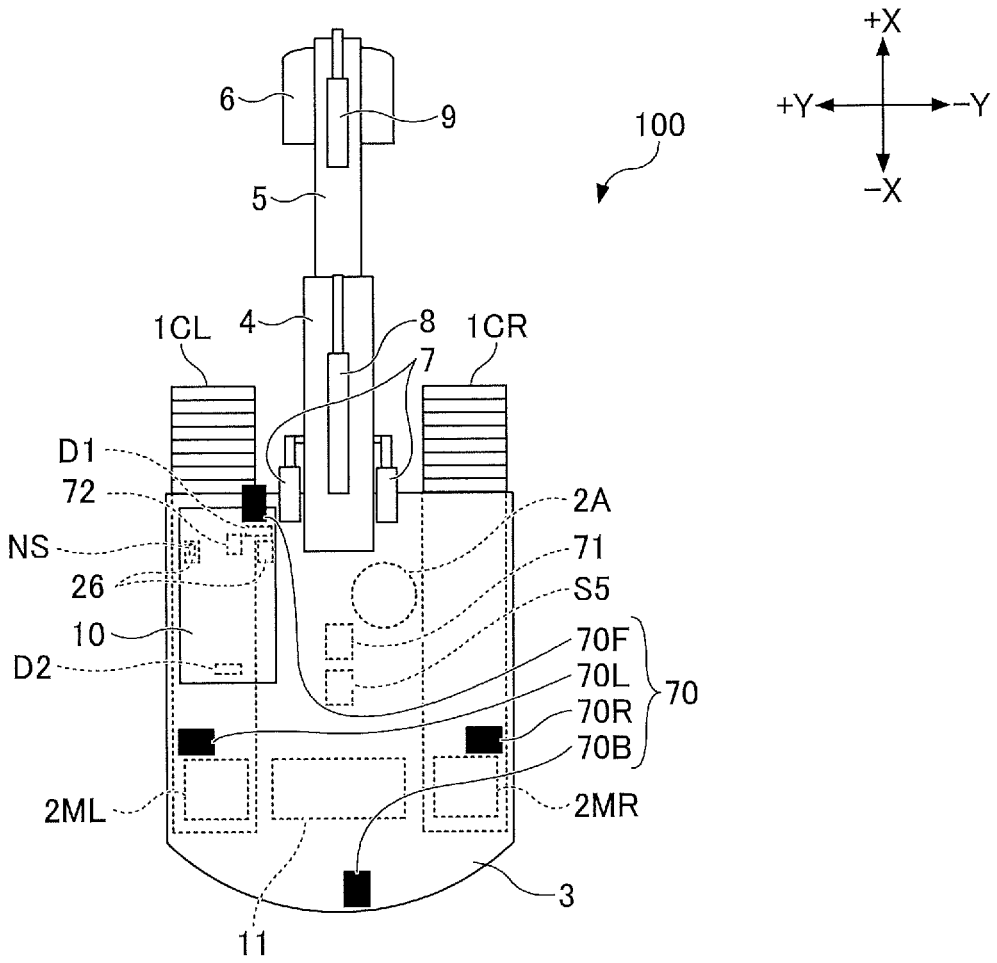
FIG. 2 is a top view of the shovel.

FIGS. 1 and 2 are a side view and a top view of the shovel 100, respectively.

The shovel 100 according to the present disclosure is provided with a lower travelling body 1; an upper pivot body 3 pivotably mounted to the lower travelling body 1 through a pivot mechanism 2; a boom 4, an arm 5, and a bucket 6 that together constitute an attachment AT; and a cabin 10.

The lower travelling body 1 (an example of a travelling body) includes a pair of left and right crawlers 1C, specifically a left crawler 1CL and a right crawler 1CR. The left crawler 1CL and the right crawler 1CR are hydraulically driven by travelling hydraulic motors 2M (2ML, 2MR), respectively, and thereby the lower travelling body 1 causes the shovel to move 100.

The upper pivot body 3 (an example of a pivot body) is driven by a pivot hydraulic motor 2A, and thereby pivots with respect to the lower travelling body 1.

The boom 4 is mounted rotatably to a front center portion of the upper pivot body 3 to be movable upward and downward. An arm 5 is attached to the tip of the boom 4 rotatably upward and downward, and a bucket 6 as an end attachment is attached to the tip of the arm 5 rotatably upward and downward. The boom 4, the arm 5, and the bucket 6 are hydraulically driven by a boom cylinder 7, an arm cylinder 8, and a bucket cylinder 9, respectively.

The bucket 6 is an example of an end attachment. To the tip of the arm 5, depending on operation content, another end attachment, such as a slope bucket, a dredging bucket, or a breaker may be attached instead of the bucket 6.

The cabin 10 is an operator's cab, which an operator boards, and is mounted to a front left portion of the upper pivot body 3.

The shovel 100, according to an operation by the operator boarding the cabin 10, operates the actuator, and drives operation elements (driven elements) including the lower travelling body 1, the upper pivot body 3, the boom 4, the arm 5, and the bucket 6.

Moreover, the shovel 100, instead of or in addition to being configured so as to be operated by the operator in the cabin 10, may be configured so as to be operated remotely by an operator of a predetermined external device (e.g. assisting device 200 or a management device 300, which will be described later). In this case, the shovel 100 sends image information (captured image) output from a space recognition device 70, which will be described later, to the external device. Moreover, various information images (e.g. various setting screen) displayed on a display device D1, which will be described later, of the shovel 100 may be also displayed on a display device provided in the external device. Thus, the operator can remotely operate the shovel 100 while looking at contents displayed on the display device of the external device. The shovel 100, according to remote operation signal indicating contents of the remote operation received from the external device, may operate the actuator, and drive the operation elements including the lower traveling body 1, upper pivot body 3, the boom 4, the arm 5, and the bucket 6. When the shovel 100 is remotely operated, the operator need not board the cabin 10. In the following description, the operation by the operator is assumed to include an operation device 26 by the operator in the cabin 10, and the remote operation by the operator of the external device, or both.

Moreover, the shovel 100 may operate the hydraulic actuator automatically irrespectively of the operation content by the operator. Thus, the shovel 100 performs a function of operating automatically at least a part of the operation elements, including the lower traveling body 1, upper pivot body 3, the boom 4, the arm 5, and the bucket 6 (in the following, referred to as an "automatic operation function", or "machine control function").

The automatic operation function may include a function of automatically operating an operation element (hydraulic actuator) other than the operation element (hydraulic actuator) to be operated, depending on the operation with respect to the operation device 26 by the operator or the remote operation ("semi-automatic operation function"). Moreover, the automatic operation function may include a function of automatically operating at least a part of the plurality of driven elements (hydraulic actuators) assuming that the operation with respect to the operation device 26 by the operator and the remote operation are absent ("full-automatic operation function"). When the full-automatic operation function is effective for the shovel 100, an operator need not board the cabin 10. Moreover, the automatic operation function may include a function in which the shovel 100 recognizes gestures of people, such as a worker around the shovel 100, and automatically operates at least a part of the plurality of driven elements (hydraulic actuators), depending on contents of the recognized gestures ("gesture operation function"). Moreover, the semi-automatic operation function, the full-automatic operation function, and the gesture operation function may include a mode of automatically determining the operation content of the operation elements of the target of the automatic operation (hydraulic actuator) according to a predetermined rule. Moreover, the semi-automatic operation function, the full-automatic operation function, and the gesture operation function may include a mode in which the shovel 100 autonomously performs various determinations, and autonomously determines the operation contents of the operation elements of the target of the automatic operation (hydraulic actuators) along results of the determination ("autonomous operation function").

[Configuration of Shovel]

Next, with reference to FIGS. 3 and 4A to 4D, in addition to FIGS. 1 and 2, the configuration of the shovel 100 will be described.

Figure 3:
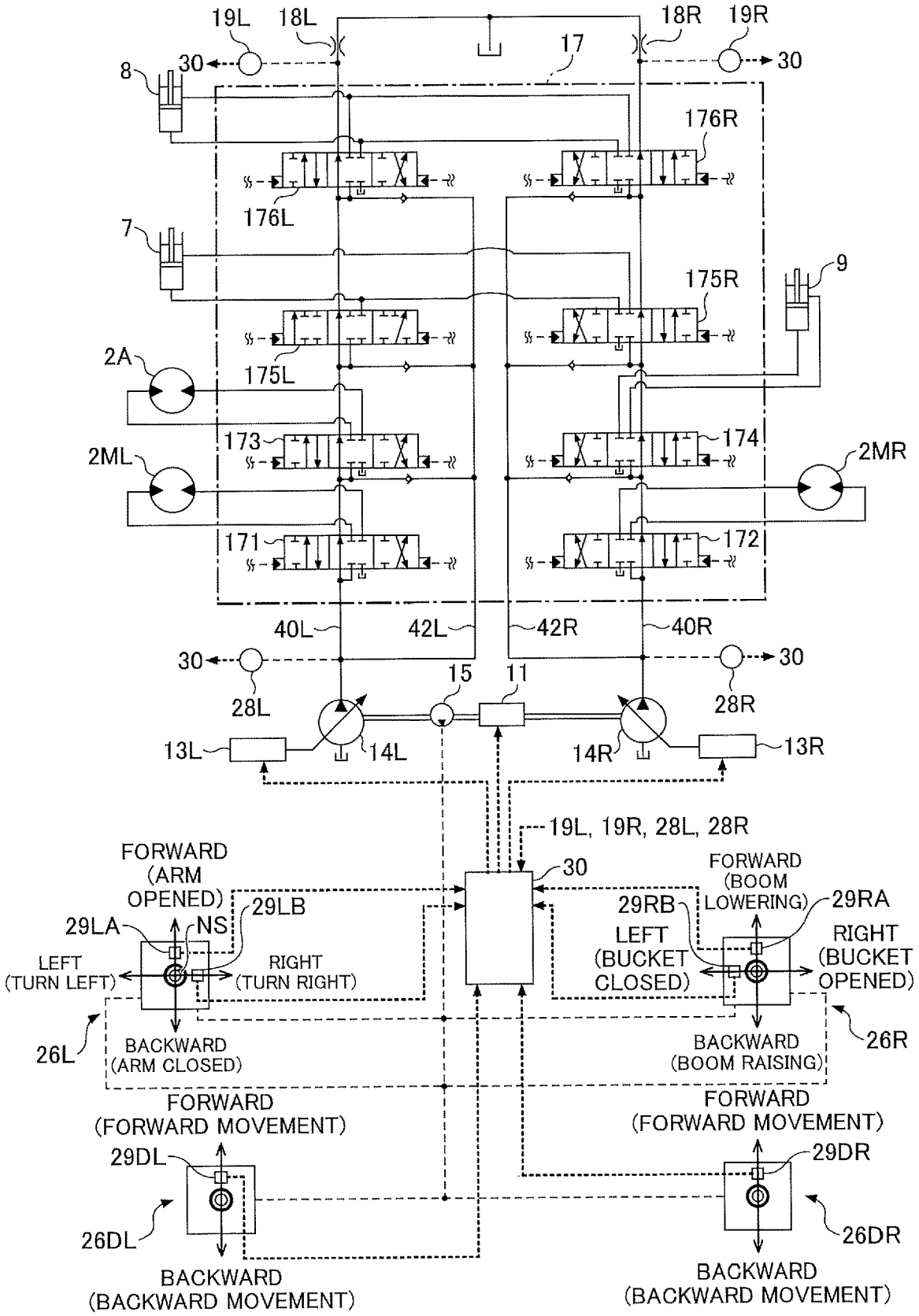
FIG. 3 is a diagram illustrating an example arrangement of a hydraulic system of the shovel.

FIG. 3 is a diagram illustrating an example arrangement of the hydraulic system of the shovel 100 according to the embodiment of the present disclosure. FIGS. 4A to 4D are diagrams for illustrating an exemplary configuration part of the operation system related to the attachment AT and the upper pivot body 3 in the hydraulic system of the shovel 100 according to the embodiment of the present disclosure. Specifically, FIGS. 4A to 4D are diagrams for illustrating an example arrangement part of the operation system related to the arm 5, the boom 4, the bucket 6, and the upper pivot body 3, respectively.

The hydraulic system of the shovel 100 according to the embodiment of the present disclosure includes an engine 11, a regulator 13, a main pump 14, a pilot pump 15, a control valve 17, an operation device 26, a discharge pressure sensor 28, an operation pressure sensor 29, and controller 30. Moreover, the hydraulic system of the shovel 100 according to the embodiment of the present disclosure includes, as described above, hydraulic actuators, such as the travelling hydraulic motors 2ML, 2MR, the pivot hydraulic motor 2A, the boom cylinder 7, the arm cylinder 8, and the bucket cylinder 9 that hydraulically drives the lower traveling body 1, the upper pivot body 3, the boom 4, the arm 5, and the bucket 6, respectively.

The engine 11 is a main power source of the hydraulic systems, and mounted, for example, to a rear part of the upper pivot body 3. Specifically, the engine 11 rotates constantly at a predetermined target rotation speed under direct or indirect control of the controller 30, to drive the main pump 14 and the pilot pump 15. The engine 11 may be, for example, a diesel engine fueled by light oil.

The regulator 13 controls the discharge amount of the main pump 14. For example, the regulator 13 adjusts the swashplate tilt angle (tilted angle) of the main pump 14 in response to a control command from the controller 30. The regulator 13 includes regulators 13L and 13R corresponding respectively to main pumps 14L and 14R, which will be described later.

The main pump 14 is mounted, for example, to the rear part of the upper pivot body 3, similarly to the engine 11, and, as described above, is driven by the engine 11, to supply operating oil to the control valve 17 via a high-pressure hydraulic line. The main pump 14 is, for example, a variable capacity type of hydraulic pump, and under the control of the controller 30, as described above, the tilt angle of the swashplate is adjusted, and a length of stroke is adjusted, and thereby discharge flow amount (discharge pressure) is controlled by the regulator 13. The main pump 14 includes the main pump 14L and the main pump 14R.

The pilot pump 15 is mounted, for example, to the rear part of the upper pivot body 3, and supplies a pilot pressure to the operation device 26 through a pilot line. The pilot pump 15 is, for example, a fixed capacity type of hydraulic pump, and driven by the engine 11, as described above.

The control valve 17 is mounted, for example, to the central part of the upper pivot body 3. The control valve 17 is a hydraulic controller for controlling the hydraulic system in the shovel 100, according to the operation with respect to the operation device 26 by the operator or the remote operation. The control valve 17 is connected to the main pump 14 through the high pressure hydraulic line, as described above, and selectively supplies operating oil supplied from the main pump 14 to the hydraulic actuators (the travelling hydraulic motors 2ML, 2MR, the pivot hydraulic motor 2A, the boom cylinder 7, the arm cylinder 8, and the bucket cylinder 9), according to the operation with respect to the operation device 26 by the operator or the remote operation. Specifically, the control valve 17 includes control valves 171 to 176 that control flow amounts and flow directions of operating oil supplied from the main pump 14 to the respective hydraulic actuators. The control valve 171 corresponds to the traveling hydraulic motor 2ML. Moreover, the control value 172 corresponds to the traveling hydraulic motor 2MR. Moreover, the control valve 173 corresponds to the pivot hydraulic motor 2A, and the control valve 174 corresponds to the bucket cylinder 9. The control valve 175 corresponds to the boom cylinder 7, and includes control valves 175L and 175R. The control valve 176 corresponds to the arm cylinder 8, and includes control valves 176L and 176R.

The operation device 26 is provided near a driver's seat of the cabin 10 and is operation input means for operating various operation elements (the lower traveling body 1, the upper pivot body 3, the boom 4, the arm 5, the bucket 6, and the like) by the operator. In other words, the operation device 26 is operation input means for operating the hydraulic actuators (that is, the traveling hydraulic motors 2ML, 2MR, the pivot hydraulic motor 2A, the boom cylinder 7, the arm cylinder 8, the bucket cylinder 9, or the like) for driving the respective operation elements by the operator.

As shown in FIGS. 3 and 4A to 4D, the operation device 26 is a hydraulic pilot type. The operation device 26 is connected directly to the control valve 17 through a secondary side pilot line, directly or via a shuttle valve 32, which will be described later, on the secondary side pilot line. Thus, the control valve 17 can input a pilot pressure corresponding to an operation state of the lower traveling body 1, the upper pivot body 3, the boom 4, the arm 5, and the bucket 6 in the operation device 26. Therefore, the control valve 17 can drive the respective hydraulic actuators according to the operation state of the operation device 26.

The operation device 26 includes an attachment AT, i.e. the boom 4 (the boom cylinder 7), the arm 5 (the arm cylinder 8), the bucket 6 (the bucket cylinder 9), and a left operation lever 26L and a right operation lever 26R for operating the upper pivot body 3. The operation device 26 includes a traveling lever 26D for operating the lower traveling body 1, and further the traveling lever 26D includes a left traveling lever 26DL for operating the left crawler 1CL, and a right traveling lever 26DR for operating the right crawler 1CR.

The left operation lever 26L is used for the turning operation of the upper pivot body 3 and the operation of the arm 5. When the left operation lever 26L is operated in the longitudinal direction (i.e. the longitudinal direction of the upper pivot body 3) viewed from the operator in the cabin 10, operating oil discharged from the pilot pump 15 is utilized to output a control pressure (pilot pressure) corresponding to a lever operation amount to the secondary side pilot line. Moreover, when the left operation lever 26L is operated in the lateral direction (i.e. the lateral direction of the upper pivot body 3) viewed from the operator in the cabin 10, the operating oil discharged from the pilot pump 15 is utilized to output the control pressure (pilot pressure) corresponding to the lever operation amount to the secondary side pilot line.

The right operation lever 26R is used for the operation of the boom 4 and the operation of the bucket 6. When the right operation lever 26R is operated in the longitudinal direction viewed from an operator in the cabin 10, the operating oil discharged from the pilot pump 15 is used to output the control pressure (pilot pressure) corresponding to a lever operation amount to the secondary side pilot line. Moreover, when the right operation lever 26R is operated in the lateral direction, the operating oil discharged from the pilot pump 15 is used to output the control pressure (pilot pressure) corresponding to the lever operation amount to the secondary side pilot line.

The left traveling lever 26DL may be configured to be used in the operation of the left crawler 1CL, and interlocked with a left traveling pedal (not shown), as described above. When the left traveling lever 26DL is operated in the longitudinal direction viewed from the operator in the cabin 10, the operating oil discharged from the pilot pump 15 is utilized to output the control pressure (pilot pressure) corresponding to the lever operation amount to the secondary side pilot line. The secondary pilot lines corresponding to the operations regarding the longitudinal directions of the left traveling lever 26DL are connected directly to the corresponding pilot ports of the control valve 171. That is, operation contents of the left traveling lever 26DL are reflected at a spool position of the control valve 171 for driving the traveling hydraulic motor 2ML.

The right traveling lever 26DR may be configured to be used for the operation of the right crawler 1CR, as described above, and interlocked with a right traveling pedal (not shown). When the right traveling lever 26DR is operated in the longitudinal direction viewed from the operator in the cabin 10, the operating oil discharged from the pilot pump 15 is utilized to output the control pressure (pilot pressure) corresponding to a lever operation amount to the secondary side pilot line. The secondary pilot lines corresponding to the operations regarding the longitudinal directions of the right traveling lever 26DR are connected directly to the corresponding pilot ports of the control valve 172. That is, operation contents of the left traveling lever 26DL are reflected at a spool position of the control valve 172 for driving the traveling hydraulic motor 2ML.

Moreover, the operation device 26 (the left operation lever 26L, the right operation lever 26R, the left traveling lever 26DL, and the right traveling lever 26DR) may be an electric type that outputs an electric signal (hereinafter referred to as an "operation signal") instead of the hydraulic pilot type for outputting a pilot pressure. In this case, the electric signal (operation signal) from the operation device 26 is input to the controller 30, and the controller 30 controls each of the control valves 171 to 176 in the control valve 17 according to the electric signal to be input, thereby the operation of the various hydraulic actuators is realized corresponding to the operation contents to the operation device 26. For example, the control valves 171 to 176 in the control valve 17 may be electromagnetic solenoid spool valves that are driven by a command from the controller 30. For example, a hydraulic control valve (hereinafter referred to as a "control valve for operation") operating according to an electric signal from the controller 30 may be disposed between the pilot pump 15 and the pilot port of each control valve 171 to 176. The control valve for operation may be, for example, a proportional valve 31 and the shuttle valve 32 is omitted. In this case, when a manual operation using the electric operation device 26 is performed, the controller 30 controls the control valve for operation to increase/decrease the pilot pressure according to the electric signal corresponding to the operation amount (for example, the lever operation amount), so that the control valves 171 to 176 can be operated in accordance with the operation contents of the operation device 26. Hereinafter, the description will proceed with the assumption that the proportional valve is a proportional valve 31.

The discharge pressure sensor 28 detects a discharge pressure of the main pump 14. The detection signal corresponding to the discharge pressure detected by the discharge pressure sensor 28 is taken into the controller 30. The discharge pressure sensor 28 includes discharge pressure sensors 28L and 28R for detecting discharge pressures of the main pumps 14L and 14R, respectively.

The operation pressure sensor 29 detects a pilot pressure on the secondary side of the operation device 26, that is, pilot pressures corresponding to the operation states of the operation elements (i.e. the hydraulic actuators) in the operation device 26. Detection signals of the pilot pressures corresponding to the operation states of the lower traveling body 1, the upper pivot body 3, the boom 4, the arm 5, and the bucket 6 in the operation device 26 by the operation pressure sensor 29 is taken into the controller 30. The operation pressure sensor 29 includes operation pressure sensors 29LA, 29LB, 29RA, 29RB, 29DL, and 29DR.

The operation pressure sensor 29LA detects operation contents (for example, operation direction and an amount of operation) in the longitudinal direction with respect to the left operation lever 26L by the operator in the form of a pressure of the operating oil of the pilot line on the secondary side of the left operation lever 26L (hereinafter referred to as an "operating pressure").

The operation pressure sensor 29LB detects operation contents (for example, operation direction and an amount of operation) in the lateral direction with respect to the left operation lever 26L by the operator in the form of an operating pressure of the pilot line on the secondary side of the left operation lever 26L.

The operation pressure sensor 29RA detects operation contents (for example, operation direction and an amount of operation) in the longitudinal direction with respect to the right operation lever 26R by the operator in the form of an operating pressure of the pilot line on the secondary side of the right operation lever 26R.

The operation pressure sensor 29RB detects operation contents (for example, operation direction and an amount of operation) in the lateral direction with respect to the right operation lever 26R by the operator in the form of an operating pressure of the pilot line on the secondary side of the right operation lever 26R.

The operation pressure sensor 29DL detects operation contents (for example, operation direction and an amount of operation) in the longitudinal direction with respect to the left traveling lever 26DL by the operator in the form of an operating pressure of the pilot line on the secondary side of the left traveling lever 26DL.

The operation pressure sensor 29DR detects operation contents (for example, operation direction and an amount of operation) in the longitudinal direction with respect to the right traveling lever 26DR by the operator in the form of an operating pressure of the pilot line on the secondary side of the right traveling lever 26DR.

The operation contents of the operation device 26 (the left operation lever 26L, the right operation lever 26R, the left traveling lever 26DL, and the right traveling lever 26DR) may be detected by a sensor other than the operation pressure sensor 29 (for example, a potentiometer attached to the right operation lever 26R, the left traveling lever 26DL, and the right traveling lever 26DR).

The controller 30 (an example of the control device) is provided in the cabin 10, for example, and controls the drive of the shovel 100. A function of the controller 30 may be implemented by any hardware, software, or a combination thereof. For example, the controller 30 is mainly configured with a microcomputer including a CPU (Central Processing Unit), a ROM (Read Only Memory), a RAM (Random Access Memory), a nonvolatile auxiliary storage device, various I/O interfaces and the like. The controller 30 implements various functions by executing various programs stored in, for example, the ROM or the non-volatile auxiliary storage device on the CPU.

It should be noted that some of the functions of the controller 30 may be implemented by other controllers (control devices). That is, the function of the controller 30 may be implemented in a manner that is distributed by a plurality of controllers.

As shown in FIG. 3, in the hydraulic system of the shovel 100, the hydraulic system portion of the drive system for driving the hydraulic actuator circulates operating oil from the main pump 14 driven by the engine 11 to the operating oil tank through the center bypass oil passage 40 and the parallel oil passage.

The center bypass oil passage 40 includes center bypass oil passages 40L and 40R.

The center bypass oil passage 40L sequentially passes through the control valves 171, 173, 175L, and 176L arranged in the control valve 17 with the main pump 14L as a starting point, and reaches the operating oil tank.

The center bypass oil passage 40R sequentially passes through the control valves 172, 174, 175R, and 176R arranged in the control valve 17 with the main pump 14R as a starting point and reaches the operating oil tank.

The control valve 171 is a spool valve for supplying operating oil discharged from the main pump 14L to the traveling hydraulic motor 2ML and discharging operating oil discharged from the traveling hydraulic motor 2ML to the operating oil tank.

The control valve 172 is a spool valve for supplying operating oil discharged from the main pump 14R to the traveling hydraulic motor 2MR and discharging operating oil discharged from the traveling hydraulic motor 2MR to the operating oil tank.

The control valve 173 is a spool valve for supplying operating oil discharged from the main pump 14L to the pivot hydraulic motor 2A and discharging operating oil discharged from the pivot hydraulic motor 2A to the operating oil tank.

The control valve 174 is a spool valve for supplying operating oil discharged from the main pump 14R to the bucket cylinder 9 and discharging operating oil in the bucket cylinder 9 to the operating oil tank.

The control valves 175L and 175R are spool valves that supply operating oil discharged from the main pumps 14L and 14R, respectively, to the boom cylinder 7 and discharge operating oil in the boom cylinder 7 to the operating oil tank.

The control valves 176L and 176R are spool valves for supplying operating oil discharged from the main pumps 14L and 14R, respectively, to the arm cylinder 8 and discharging operating oil in the arm cylinder 8 to the operating oil tank.

The control valves 171, 172, 173, 174, 175L, 175R, 176L, and 176R, respectively, adjust flow rate of operating oil supplied to hydraulic actuator or switch a flowing direction according to a pilot pressure acting on the pilot port.

The parallel oil passage 42 includes parallel oil passages 42L and 42R.

The parallel oil passage 42L supplies operating oil of the main pump 14L to the control valves 171, 173, 175L, and 176L in parallel with the center bypass oil passage 40L. Specifically, the parallel oil path 42L is branched from the center bypass oil path 40L on the upstream side of the control valve 171, and is configured to supply operating oil of the main pump 14L in parallel to the control valves 171, 173, 175L, and 176R. This allows the parallel oil passage 42L to supply operating oil to a downstream control valve when the flow of operating oil passing through the center bypass oil passage 40L is restricted or blocked by either of the control valves 171, 173 and 175L.

The parallel oil passage 42R supplies operating oil of the main pump 14R to the control valves 172, 174, 175R, and 176R in parallel with the center bypass oil passage 40R. Specifically, the parallel oil path 42R is branched from the center bypass oil path 40R on the upstream side of the control valve 172, and is configured to supply operating oil of the main pump 14R in parallel to the control valves 172, 174, 175R, and 176R. The parallel oil path 42R can supply operating oil to a downstream control valve when the flow of operating oil through the center bypass oil path 40R is restricted or blocked by either of the control valves 172, 174, and 175R.

The regulators 13L and 13R adjust the amount of discharge of the main pumps 14L and 14R by adjusting the tilt angle of the swash plate of the main pumps 14L and 14R under the control of the controller 30.

The discharge pressure sensor 28L detects a discharge pressure of the main pump 14L, and a detection signal corresponding to the detected discharge pressure is taken into the controller 30. The same applies to the discharge pressure sensor 28R. Thus, the controller 30 can control the regulators 13L and 13R according to the discharge pressure of the main pumps 14L and 14R.

In the center bypass oil passages 40L and 40R, negative control throttles 18L and 18R are provided between the control valves 176L and 176R on the most downstream side and the operating oil tank, respectively. Thus, the flows of operating oil discharged by the main pumps 14L and 14R are limited by the negative control throttles 18L and 18R. The negative control throttles 18L and 18R generate a control pressure (hereinafter referred to as a "negative control pressure") for controlling the regulators 13L and 13R.

The negative control pressure sensors 19L and 19R detect negative control pressures, and detection signals corresponding to the detected negative control pressures are taken into the controller 30.

The controller 30 may control the regulators 13L and 13R according to the discharge pressures of the main pumps 14L and 14R detected by the discharge pressure sensors 28L and 28R, to adjust the discharge amounts of the main pumps 14L and 14R. For example, the controller 30 may control the regulator 13L in response to an increase in the discharge pressure of the main pump 14L, and adjust the swash plate tilt angle of the main pump 14L to reduce the discharge amount. The same applies to the regulator 13R. Thus, the controller 30 can control the total power of the main pumps 14L and 14R so that the absorption power of the main pumps 14L and 14R expressed by a product of the discharge pressure and the discharge amount does not exceed the output power of the engine 11.

The controller 30 may adjust the discharge amounts of the main pumps 14L and 14R by controlling the regulators 13L and 13R according to the negative control pressures detected by the negative control pressure sensors 19L and 19R. For example, the controller 30 decreases the discharge amounts of the main pumps 14L and 14R as the negative control pressures are larger, and increases the discharge amounts of the main pumps 14L and 14R as the negative control pressures are smaller.

Specifically, in the case of a standby state in which none of the hydraulic actuators in the shovel 100 is operated (shown in FIG. 3), operating oil discharged from the main pumps 14L and 14R reaches the negative control throttles 18L and 18R through the center bypass oil passages 40L and 40R. The flow of operating oil discharged from the main pumps 14L and 14R increases the negative control pressure generated upstream of the negative control throttles 18L and 18R. As a result, the controller 30 reduces the discharge amounts of the main pumps 14L and 14R to an allowable minimum discharge amount, and suppresses pressure loss (pumping loss) when the discharged operating oil passes through the center bypass oil passages 40L and 40R.

Conversely, when any hydraulic actuator is operated through the operation device 26, the operating oil discharged from the main pumps 14L and 14R flows into the hydraulic actuator to be operated via a control valve corresponding to the hydraulic actuator to be operated. The flow of operating oil discharged from the main pumps 14L and 14R reduces or eliminates the amount of the operating oil to reach the negative control throttles 18L and 18R, and reduces the negative control pressure generated upstream of the negative control throttles 18L and 18R. As a result, the controller 30 increases the discharge amount of the main pumps 14L and 14R, circulates sufficient operating oil to the hydraulic actuator to be operated, and reliably drives the hydraulic actuator to be operated.

As shown in FIGS. 3 and 4, in the hydraulic system of the shovel 100, the hydraulic system portion relating to the operating system includes the pilot pump 15, the operation device 26 (the left operation lever 26L, the right operation lever 26R, the left traveling lever 26DL, and the right traveling lever 26DR), a proportional valve 31, a shuttle valve 32, and a pressure reducing proportional valve 33.

The proportional valve 31 is provided in a pilot line connecting the pilot pump 15 and the shuttle valve 32, and is configured to change a channel area (cross-sectional area where operating oil can flow). The proportional valve 31 operates in response to a control command input from the controller 30. Thus, even if the operation device 26 (specifically, the left operation lever 26L and the right operation lever 26R) is not operated by the operator, the controller 30 can supply operating oil discharged from the pilot pump 15 to the pilot ports of corresponding control valves in the control valve 17 (specifically, the control valves 173 to 176) via the proportional valve 31 and the shuttle valve 32. Therefore, the controller 30 can realize an automatic driving function and a remote control function of the shovel 100 by controlling the proportional valve 31. The proportional valve 31 includes proportional valves 31AL, 31AR, 31BL, 31BR, 31CL, 31CR, 31DL, and 31DR.

The shuttle valve 32 has two inlet ports and one outlet port, and outputs operating oil having a higher pilot pressure of pilot pressures of operating oil input to the two inlet ports to the outlet port. One of the two inlet ports of the shuttle valve 32 is connected to the operation device 26 and the other is connected to the proportional valve 31. The outlet port of shuttle valve 32 is connected through a pilot line to a pilot port of a corresponding control valve in the control valve 17. Therefore, the shuttle valve 32 can cause a higher pilot pressure of the pilot pressure generated by the operation device 26 and the pilot pressure generated by the proportional valve 31 to act on the pilot port of the corresponding control valve. That is, the controller 30 outputs a pilot pressure, higher than the pilot pressure on the secondary side output from the operation device 26, from the proportional valve 31, and thereby controls the corresponding control valve irrespectively of the operation of the operation device 26 by the operator and controls the operation of the lower traveling body 1, the upper pivot body 3 and the attachment AT. The shuttle valve 32 includes shuttle valves 32AL, 32AR, 32BL, 32BR, 32CL, 32CR, 32DL and 32DR.

The pressure reducing proportional valve 33 is provided in a pilot line connecting the operation device 26 and the shuttle valve 32. The pressure reducing proportional valve 33 is configured to change a channel area, for example. The pressure reducing proportional valve 33 operates in response to a control command input from the controller 30. Thus, the controller 30 can forcibly reduce the pilot pressure output from the operation device 26 when the operation device 26 (specifically, lever devices 26A to 26C) are operated by the operator. Therefore, even when the operation device 26 is operated, the controller 30 can forcibly suppress or stop the operation of the hydraulic actuator corresponding to the operation of the operation device 26. Moreover, the controller 30 can reduce the pilot pressure output from the operation device 26 so as to be lower than the pilot pressure output from the proportional valve 31 even when the operation device 26 is operated. Therefore, the controller 30 controls the proportional valve 31 and the pressure reducing proportional valve 33 so that a desired pilot pressure can be reliably applied to the pilot port of the control valve in the control valve 17 regardless of the operation content of the operation device 26. Accordingly, the controller 30, for example, controls the pressure reducing proportional valve 33 in addition to the proportional valve 31, and thereby more appropriately realize the automatic driving function and the remote control function of the shovel 100. The pressure reducing proportional valve 33 includes pressure reducing proportional valves 33AL, 33AR, 33BL, 33BR, 33CL, 33CR, 33DL and 33DR, as will be described later.

Moreover, the pressure reducing proportional valve 33 may be replaced by a selector valve. The selector valve switches between a communication state of the pilot line between the operation device 26 and the shuttle valve 32 and a non-communication state under control by the controller 30.

Figure 4A:
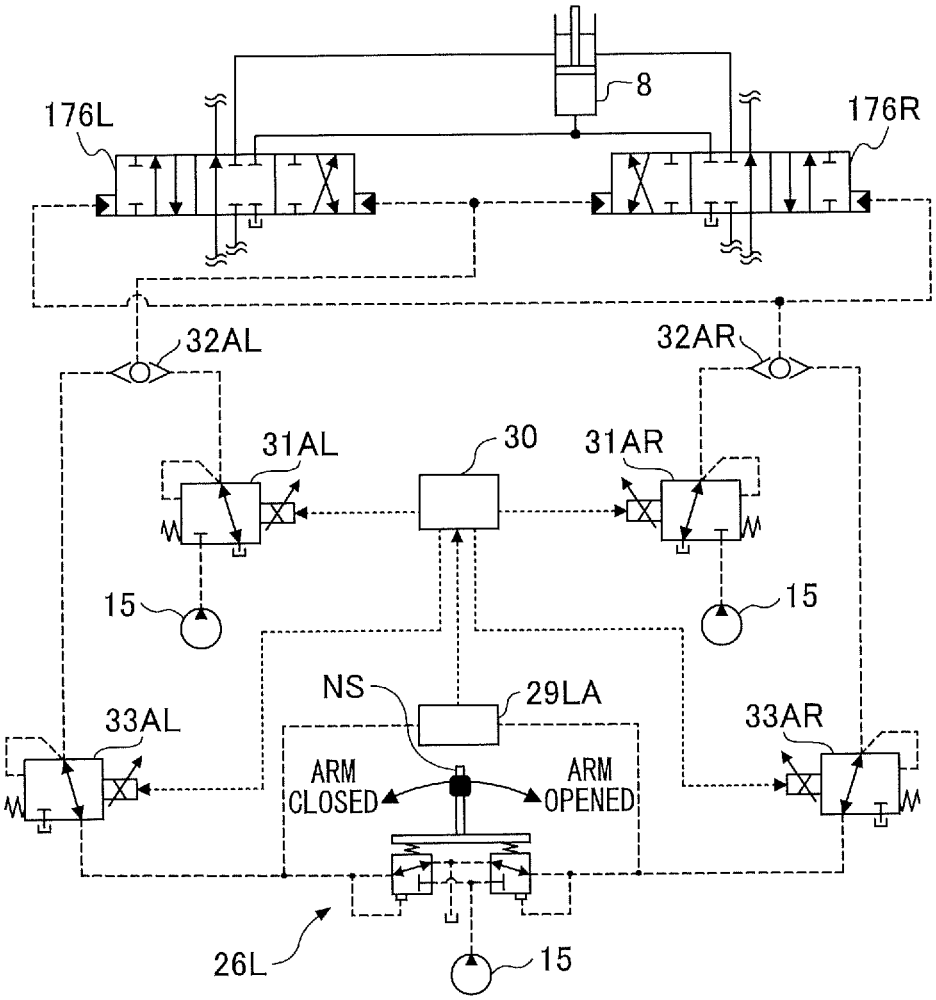
FIG. 4A is a diagram illustrating an example arrangement portion of an operation system related to an arm in the hydraulic system.

As shown in FIG. 4A, the left operation lever 26L is used to operate the arm cylinder 8 corresponding to the arm 5 in such a manner that the operator tilts in the longitudinal direction. That is, when the left operation lever 26L is tilted in the longitudinal direction, the operation of the arm 5 is an operation element to be operated. The left operation lever 26L uses operating oil discharged from the pilot pump 15 to output a pilot pressure corresponding to operation contents in the longitudinal direction to the secondary side.

Two inlet ports of the shuttle valve 32AL are connected to the secondary side pilot line of the left operation lever 26L corresponding to the closing direction operation of the arm 5 (hereinafter referred to as an "arm closing operation") and the pilot line on the secondary side of the proportional valve 31AL, respectively, and an outlet port is connected to the pilot port on the right side of the control valve 176L and the pilot port on the left side of the control valve 176R.

Two inlet ports of the shuttle valve 32AR is connected to the secondary side pilot line of the left operation lever 26L corresponding to the opening direction operation (hereinafter referred to as an "arm opening operation") of the arm 5 and the pilot line on the secondary side of the proportional valve 31AR, and an outlet port is connected to the pilot port on the left side of the control valve 176L and the pilot port on the right side of the control valve 176R.

That is, the left operation lever 26L applies the pilot pressure according to the operation contents in the longitudinal direction to the pilot ports of the control valves 176L and 176R via the shuttle valves 32AL and 32AR. Specifically, the left operation lever 26L outputs a pilot pressure corresponding to the operation amount to one inlet port of the shuttle valve 32AL when the arm is closed, and causes the pilot port on the right side of the control valve 176L and the pilot port on the left side of the control valve 176R through the shuttle valve 32AL. When the arm is opened, the left operation lever 26L outputs a pilot pressure corresponding to the operation amount to one inlet port of the shuttle valve 32AR, and acts on the pilot port on the left side of the control valve 176L and the pilot port on the right side of the control valve 176R via the shuttle valve 32AR.

The proportional valve 31AL operates in accordance with control current input from the controller 30. Specifically, the proportional valve 31AL uses operating oil discharged from the pilot pump 15 to output the pilot pressure corresponding to the control current input from the controller 30 to another pilot port of the shuttle valve 32AL. This allows the proportional valve 31AL to adjust the pilot pressure acting on the pilot port on the right side of the control valve 176L and the pilot port on the left side of the control valve 176R via the shuttle valve 32AL.

The proportional valve 31AR operates in accordance with control current input from the controller 30. Specifically, the proportional valve 31AR uses operating oil discharged from the pilot pump 15 to output the pilot pressure corresponding to the control current input from the controller 30 to the other pilot port of the shuttle valve 32AR. This allows the proportional valve 31AR to adjust the pilot pressure acting on the pilot port on the left side of the control valve 176L and the pilot port on the right side of the control valve 176R via the shuttle valve 32AR.

That is, the proportional valves 31AL and 31AR can adjust the pilot pressure to be output to the secondary side so that the control valves 176L and 176R can be held at any valve position independently of the operation state of the left operation lever 26L.

The pressure reducing proportional valve 33AL operates according to the control current input from the controller 30. Specifically, when the control current from the controller 30 is not input, the pressure reducing proportional valve 33AL outputs the pilot pressure corresponding to the arm closing operation of the left operation lever 26L to the secondary side as is. Conversely, when the control current is input from the controller 30, the pressure reducing proportional valve 33AL reduces the pilot pressure of the secondary side pilot line corresponding to the arm closing operation of the left operation lever 26L to an extent corresponding to the control current, and outputs the reduced pilot pressure to one inlet port of the shuttle valve 32AL. Thus, even when the arm closing operation is performed by the left operation lever 26L, the operation of the arm cylinder 8 corresponding to the arm closing operation can be forcibly suppressed or stopped as necessary. The pressure reducing proportional valve 33AL can reduce the pilot pressure acting on the one inlet port of the shuttle valve 32AL so as to be lower than the pilot pressure acting on another inlet port of the shuttle valve 32AL from the proportional valve 31AL, even when the arm closing operation is performed by the left operation lever 26L. Therefore, the controller 30 controls the proportional valve 31AL and the pressure reducing proportional valve 33AL, and reliably applies the desired pilot pressure to the pilot port on the arm closing side of the control valves 176L and 176R.

The pressure reducing proportional valve 33AR operates according to the control current input from the controller 30. Specifically, when the control current from the controller 30 is not input, the pressure reducing proportional valve 33AR outputs the pilot pressure corresponding to the arm opening operation of the left operation lever 26L to the secondary side as is. Conversely, when the control current is input from the controller 30, the pressure reducing proportional valve 33AR reduces the pilot pressure of the secondary side pilot line corresponding to the arm opening operation of the left operation lever 26L to an extent corresponding to the control current, and outputs the reduced pilot pressure to one inlet port of the shuttle valve 32AR. Thus, even when the arm opening operation is performed by the left operation lever 26L, the operation of the arm cylinder 8 corresponding to the arm opening operation can be forcibly suppressed or stopped as necessary. The pressure reducing proportional valve 33AR can reduce the pilot pressure acting on the one inlet port of the shuttle valve 32AR so as to be lower than the pilot pressure acting on another inlet port of the shuttle valve 32AR from the proportional valve 31AR, even when the arm opening operation is performed by the left operation lever 26L. Therefore, the controller 30 controls the proportional valve 31AR and the pressure reducing proportional valve 33AR, and reliably applies the desired pilot pressure to the pilot port on the arm opening side of the control valves 176L and 176R.

Thus, the pressure reducing proportional valves 33AL and 33AR can forcibly suppress or stop the operation of the arm cylinder 8 corresponding to the operation state of the left operation lever 26L in the longitudinal direction. In addition, the pressure reducing proportional valves 33AL and 33AR reduce the pilot pressure acting on one inlet ports of the shuttle valves 32AL and 32AR, and can assist the pilot pressures of the proportional valves 31AL and 31AR to act on the pilot ports of the control valves 176L and 176R reliably through the shuttle valves 32AL and 32AR.

In addition, the controller 30 may forcibly suppress or stop the operation of the arm cylinder 8 corresponding to the arm closing operation of the left operation lever 26L by controlling the proportional valve 31AR instead of controlling the pressure reducing proportional valve 33AL. For example, when the arm closing operation is performed by the left operation lever 26L, the controller 30 may control the proportional valve 31AR, to apply a predetermined pilot pressure to the pilot ports on the arm opening side of the control valves 176L and 176R via the shuttle valve 32AR from the proportional valve 31AR. Thus, the pilot pressure acts on the pilot ports on the arm opening side of the control valves 176L and 176R so as to oppose the pilot pressure acting on the pilot ports on the arm closing side of the control valves 176L and 176R through the shuttle valve 32AL from the left operation lever 26L. Therefore, the controller 30 can forcibly bring the control valves 176L and 176R close to the neutral position and suppress or stop the operation of the arm cylinder 8 corresponding to the arm closing operation of the left operation lever 26L. Similarly, the controller 30 may forcibly suppress or stop the operation of the arm cylinder 8 corresponding to the arm opening operation of the left operation lever 26L by controlling the proportional valve 31AL instead of controlling the pressure reducing proportional valve 33AR.

The pressure reducing proportional valves 33AL and 33AR may each be replaced by a selector valve. The same applies to the pressure reducing proportional valves 33BL, 33BR, 33CL, 33CR, 33DL, and 33DR.

The selector valve corresponding to the pressure reducing proportional valve 33AL is provided in a pilot line between the secondary side port of the left operation lever 26L corresponding to the arm closing operation and the shuttle valve 32AL, and a communication state and a non-communication state of the pilot line is switched according to the control command input from the controller 30. For example, the selector valve is normally open to maintain the pilot line in a communication state. In response to the control command from the controller 30, the selector valve switches the pilot line to the non-communication state, and operating oil corresponding to the arm closing operation output from the left operation lever 26L may be discharged to the operating oil tank.

The selector valve corresponding to the pressure reducing proportional valve 33AR is provided in a pilot line between the secondary side port of the left operation lever 26L corresponding to the arm opening operation and the shuttle valve 32AR, ad a communication state and a non-communication state of the pilot line is switched according to the control command input from the controller 30. For example, the selector valve is normally open to maintain the pilot line in a communication state. In response to the control command from the controller 30, the selector valve switches the pilot line to the non-communication state, and operating oil corresponding to the arm opening operation output from the left operation lever 26L may be discharged to the operating oil tank.

That is, the selector valve can prevent the pilot pressure corresponding to the operation of the arm 5 in the left operation lever 26L from being input to the shuttle valves 32AL and 32AR.

The operation pressure sensor 29LA detects the operation content in the longitudinal direction with respect to the left operation lever 26L by the operator in the form of pressure (operating pressure), and a detection signal corresponding to the detected pressure is taken into the controller 30. Thus, the controller 30 obtains the operation contents in the longitudinal direction with respect to the left operation lever 26L. The operation content in the longitudinal direction with respect to the left operation lever 26L to be detected may include, for example, an operation direction, and an operation amount (operation angle). The same applies to the operation contents in the lateral directions with respect to the left operation lever 26L, and the operation contents in the longitudinal direction and the lateral direction with respect to the right operation lever 26R.

Irrespectively of the arm closing operation for the left operation lever 26L by the operator, the controller 30 can supply operating oil discharged from the pilot pump 15 to the pilot port on the right side of the control valve 176L and the pilot port on the left side of the control valve 176R via the proportional valve 31AL and the shuttle valve 32AL. Moreover, the controller 30 can supply operating oil discharged from the pilot pump 15 to the pilot port on the left side of the control valve 176L and the pilot port on the right side of the control valve 176R via the proportional valve 31AR and the shuttle valve 32AR irrespectively of the arm opening operation to the left operation lever 26L by the operator. That is, the controller 30 automatically controls the opening/closing operation of the arm 5 to realize an automatic driving function and a remote control function of the shovel 100.

Moreover, as described above, the controller 30 can control the pressure reducing proportional valves 33AL and 33AR and the selector valve, to reduce the pilot pressure input to the shuttle valves 32AL and 32AR from the pilot line on the secondary side of the left operation lever 26L corresponding to the operation of the arm 5 so as to be relatively lower. As a result, the controller 30 can operate as a master element, which will be described later, the operation elements other than the arm 5 (for example, the boom 4 and the bucket 6) so as to correspond to the operation contents in the longitudinal direction in the left operation lever 26L, and can operate the arm 5 as a slave element to be operated in accordance with the master element.

Figure 4B:
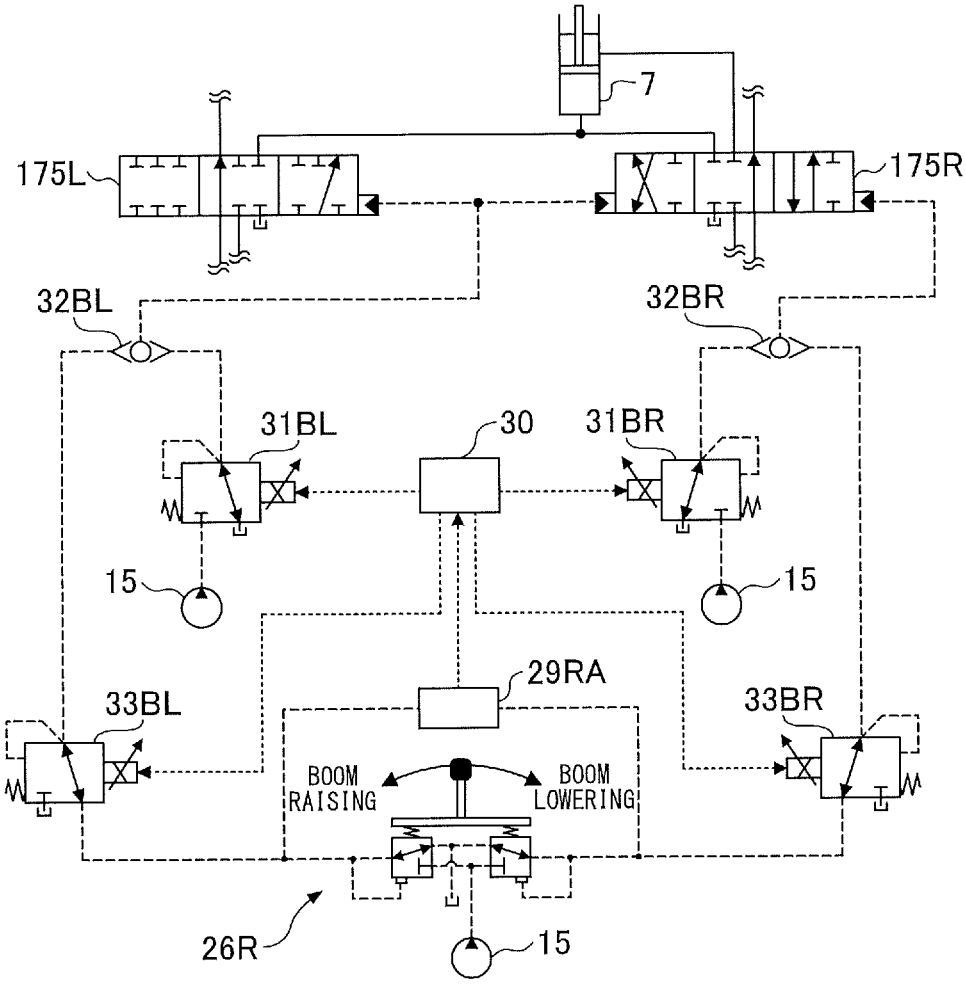
FIG. 4B is a diagram illustrating an example arrangement portion of an operation system related to a boom in the hydraulic system.

Moreover, as shown in FIG. 4B, for example, the right operation lever 26R is used to operate the boom cylinder 7 corresponding to the boom 4 in such a manner that the operator tilts in the longitudinal direction. That is, when the right operation lever 26R is tilted in the longitudinal direction, the operation of the boom 4 is an operation object. The right operation lever 26R uses operating oil discharged from the pilot pump 15 to output the pilot pressure corresponding to the operation contents in the longitudinal direction to the secondary side.

Two inlet ports of the shuttle valve 32BL are connected to the secondary side pilot line of the right operation lever 26R corresponding to the operation in a raising direction (hereinafter referred to as a "boom raising operation") of the boom 4, and the pilot line on the secondary side of the proportional valve 31BL, respectively, and an outlet port is connected to the pilot port on the right side of the control valve 175L and the pilot port on the left side of the control valve 175R.

Two inlet ports of the shuttle valve 32BR are connected to the secondary side pilot line of the right operation lever 26R corresponding to the operation in a lowering direction (hereinafter referred to as a "boom lowering operation") of the boom 4, and the pilot line on the secondary side of the proportional valve 31BR, respectively, and an outlet port is connected to the pilot port on the right side of the control valve 175R.

That is, the right operation lever 26R causes the pilot pressure according to the operation contents in the longitudinal direction to act on the pilot ports of the control valves 175L and 175R via the shuttle valves 32BL and 32BR. Specifically, the right operation lever 26R outputs the pilot pressure corresponding to the operation amount to one inlet port of the shuttle valve 32BL when the boom is operated to be raised, and causes the pilot pressure to act on the pilot port on the right side of the control valve 175L and the pilot port on the left side of the control valve 175R via the shuttle valve 32BL. Moreover, the right operation lever 26R outputs the pilot pressure corresponding to the operation amount to one inlet port of the shuttle valve 32BR when the boom is operated to be lowered, and causes the pilot pressure to act on the pilot port on the right side of the control valve 175R via the shuttle valve 32BR.

The proportional valve 31BL operates according to a control current input from the controller 30. Specifically, the proportional valve 31BL uses operating oil discharged from the pilot pump 15 to output the pilot pressure corresponding to the control current input from the controller 30 to another inlet port of the shuttle valve 32BL. This allows the proportional valve 31BL to adjust the pilot pressure acting on the pilot port on the right side of the control valve 175L and the pilot port on the left side of the control valve 175R via the shuttle valve 32BL.

The proportional valve 31BR operates according to a control current input from the controller 30. Specifically, the proportional valve 31BR uses operating oil discharged from the pilot pump 15 to output the pilot pressure corresponding to the control current input from the controller 30 to another inlet port of the shuttle valve 32BR. This allows the proportional valve 31BR to adjust the pilot pressure acting on the pilot port on the right side of the control valve 175R via the shuttle valve 32BR.

That is, the proportional valves 31BL and 31BR can adjust the pilot pressure to be output to the secondary side so that the control valves 175L and 175R can be held at any valve position irrespectively of the operation state of the right operation lever 26R.

The pressure reducing proportional valve 33BL operates according to the control current input from the controller 30. Specifically, when the control current is not input from the controller 30, the pressure reducing proportional valve 33BL outputs the pilot pressure corresponding to the boom raising operation of the right operation lever 26R to the secondary side as is. Conversely, when the control current is input from the controller 30, the pressure reducing proportional valve 33BL reduces the pilot pressure of the secondary side pilot line corresponding to the boom raising operation of the right operation lever 26R to an extent corresponding to the control current, and outputs the reduced pilot pressure to one inlet port of the shuttle valve 32BL. Thus, even when the boom raising operation is performed by the right operation lever 26R, the pressure reducing proportional valve 33BL can forcibly suppress or stop the operation of the boom cylinder 7 corresponding to the boom raising operation as necessary. Moreover, the pressure reducing proportional valve 33BL can make the pilot pressure acting on one inlet port of the shuttle valve 32BL lower than the pilot pressure acting on another inlet port of the shuttle valve 32BL from the proportional valve 31BL, even when the boom raising operation is performed by the right operation lever 26R. Therefore, the controller 30 controls the proportional valve 31BL and the pressure reducing proportional valve 33BL, and can reliably apply the desired pilot pressure to the pilot ports on the boom raising side of the control valves 175L and 175R.

The pressure reducing proportional valve 33BR operates according to the control current input from the controller 30. Specifically, when the control current is not input from the controller 30, the pressure reducing proportional valve 33BR outputs the pilot pressure corresponding to the boom lowering operation of the right operation lever 26R to the secondary side as is. Conversely, when the control current is input from the controller 30, the pressure reducing proportional valve 33BR reduces the pilot pressure of the secondary side pilot line corresponding to the boom lowering operation of the right operation lever 26R to an extent corresponding to the control current, and outputs the reduced pilot pressure to one inlet port of the shuttle valve 32BR. Thus, even when the boom lowering operation is performed by the right operation lever 26R, the pressure reducing proportional valve 33BR can forcibly suppress or stop the operation of the boom cylinder 7 corresponding to the boom lowering operation as necessary. Moreover, the pressure reducing proportional valve 33BR can make the pilot pressure acting on one inlet port of the shuttle valve 32BR lower than the pilot pressure acting on another inlet port of the shuttle valve 32BR from the proportional valve 31BR, even when the boom lowering operation is performed by the right operation lever 26R. Therefore, the controller 30 controls the proportional valve 31BR and the pressure reducing proportional valve 33BR, and can reliably apply the desired pilot pressure to the pilot ports on the boom lowering side of the control valves 175L and 175R.

Thus, the pressure reducing proportional valves 33BL and 33BR can forcibly suppress or stop the operation of the boom cylinder 7 corresponding to the operation state of the right operation lever 26R in the longitudinal direction. In addition, the pressure reducing proportional valves 33BL and 33BR reduce the pilot pressure acting on one inlet port of the shuttle valves 32BL and 32BR, and can assist the pilot pressures of the proportional valves 31BL and 31BR to reliably act on the pilot ports of the control valves 175L and 175R through the shuttle valves 32BL and 32BR.

The controller 30 may forcibly suppress or stop the operation of the boom cylinder 7 corresponding to the boom raising operation of the right operation lever 26R by controlling the proportional valve 31BR instead of controlling the pressure reducing proportional valve 33BL. For example, the controller 30 may control the proportional valve 31BR when the boom raising operation is performed by the right operation lever 26R, and may apply a predetermined pilot pressure to the pilot port on the boom lowering side of the control valves 175L and 175R via the shuttle valve 32BR from the proportional valve 31BR. Thus, the pilot pressure acts on the pilot port on the boom lowering side of the control valves 175L and 175R in a form opposed to the pilot pressure acting on the pilot port on the boom raising side of the control valves 175L and 175R through the shuttle valve 32BL from the right operation lever 26R. Therefore, the controller 30 can forcibly bring the control valves 175L and 175R close to the neutral position, and suppress or stop the operation of the boom cylinder 7 corresponding to the boom raising operation of the right operation lever 26R. Similarly, the controller 30 may forcibly suppress or stop the operation of the boom cylinder 7 corresponding to the boom lowering operation of the right operation lever 26R by controlling the proportional valve 31BL instead of controlling the pressure reducing proportional valve 33BR.

The operation pressure sensor 29RA detects operation content in the longitudinal direction with respect to the right operation lever 26R by the operator in a form of pressure (operating pressure), and a detection signal corresponding to the detected pressure is taken into the controller 30. Thus, the controller 30 obtains the operation contents in the longitudinal direction with respect to the right operation lever 26R.

Regardless of the boom raising operation for the right operation lever 26R by the operator, the controller 30 can supply operating oil discharged from the pilot pump 15 to the pilot port on the right side of the control valve 175L and the pilot port on the left side of the control valve 175R via the proportional valve 31BL and the shuttle valve 32BL. Moreover, the controller 30 can supply operating oil discharged from the pilot pump 15 to the pilot port on the right side of the control valve 175R via the proportional valve 31BR and the shuttle valve 32BR irrespectively of the boom lowering operation for the right operation lever 26R by the operator. That is, the controller 30 automatically controls the operation of raising and lowering the boom 4 and can realize an automatic driving function, a remote control function, and the like for the shovel 100.

Figure 4C:
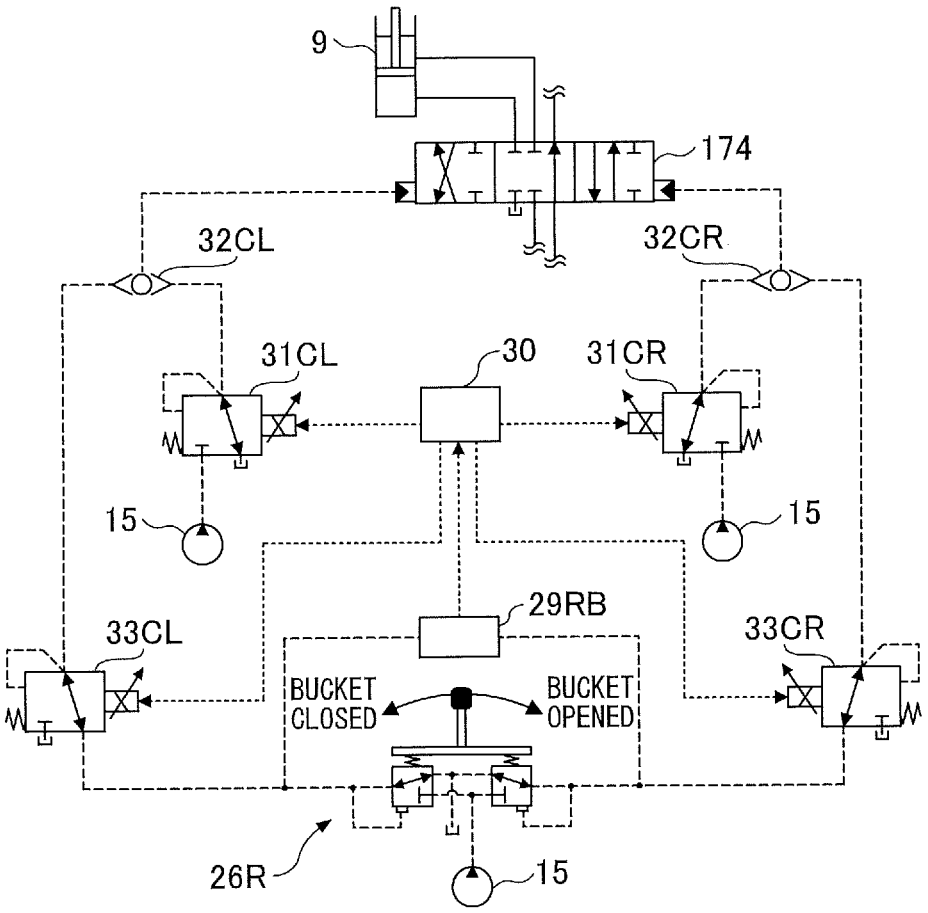
FIG. 4C is a diagram illustrating an example arrangement portion of an operation system related to a bucket in the hydraulic system.

As shown in FIG. 4C, the right operation lever 26R is used to operate the bucket cylinder 9 dealing with the bucket 6 in such a manner that the operator tilts in the lateral direction. That is, when the right operation lever 26R is tilted in the lateral direction, the operation of the bucket 6 is controlled. The right operation lever 26R uses operating oil discharged from the pilot pump 15 to output the pilot pressure corresponding to the operation contents in the lateral direction to the secondary side.

Two inlet ports of the shuttle valve 32CL are connected to the secondary side pilot line of the right operation lever 26R corresponding to the closing direction operation (hereinafter referred to as a "bucket closing operation") of the bucket 6 and the pilot line on the secondary side of the proportional valve 31CL, respectively, and an outlet port is connected to the pilot port on the left side of the control valve 174.

Two inlet ports of the shuttle valve 32CR are connected to the secondary side pilot line of the right operation lever 26R corresponding to the opening direction operation (hereinafter referred to as a "bucket opening operation") of the bucket 6 and the pilot line on the secondary side of the proportional valve 31CR, respectively, and an outlet port is connected to the pilot port on the right side of the control valve 174.

That is, the right operation lever 26R causes the pilot pressure corresponding to the operation contents in the lateral direction to act on the pilot port of the control valve 174 via the shuttle valves 32CL and 32CR. Specifically, the right operation lever 26R outputs a pilot pressure corresponding to the operation amount to one inlet port of the shuttle valve 32CL when the bucket is closed, and causes the pilot pressure to act on the pilot port on the left side of the control valve 174 via the shuttle valve 32CL. Moreover, when the bucket is opened, the right operation lever 26R outputs the pilot pressure corresponding to the operation amount to one inlet port of the shuttle valve 32CR, and causes the pilot pressure to act on the pilot port on the right side of the control valve 174 via the shuttle valve 32CR.

The proportional valve 31CL operates according to a control current input from the controller 30. Specifically, the proportional valve 31CL uses operating oil discharged from the pilot pump 15 to output the pilot pressure corresponding to the control current input from the controller 30 to another pilot port of the shuttle valve 32CL. This allows the proportional valve 31CL to adjust the pilot pressure acting on the pilot port on the left side of the control valve 174 via the shuttle valve 32CL.

The proportional valve 31CR operates according to a control current output by the controller 30. Specifically, the proportional valve 31CR uses operating oil discharged from the pilot pump 15 to output the pilot pressure corresponding to the control current input from the controller 30 to another pilot port of the shuttle valve 32CR. This allows the proportional valve 31CR to adjust the pilot pressure acting on the pilot port on the right side of the control valve 174 via the shuttle valve 32CR.

That is, the proportional valves 31CL and 31CR can adjust the pilot pressure to be output to the secondary side so that the control valve 174 can be held at an arbitrary valve position regardless of the operation state of the right operation lever 26R.

The pressure reducing proportional valve 33CL operates according to the control current input from the controller 30. Specifically, when the control current is not input from the controller 30, the pressure reducing proportional valve 33CL outputs the pilot pressure corresponding to the bucket closing operation of the right operation lever 26R to the secondary side as is. Conversely, when the control current is input from the controller 30, the pressure reducing proportional valve 33CL reduces the pilot pressure of the secondary side pilot line corresponding to the bucket closing operation of the right operation lever 26R to an extent corresponding to the control current, and outputs the reduced pilot pressure to one inlet port of the shuttle valve 32CL. Thus, even when the bucket closing operation is performed by the right operation lever 26R, the pressure reducing proportional valve 33CL can forcibly suppress or stop the operation of the bucket cylinder 9 corresponding to the bucket closing operation as necessary. Moreover, the pressure reducing proportional valve 33CL can make the pilot pressure acting on one inlet port of the shuttle valve 32CL lower than the pilot pressure acting on another inlet port of the shuttle valve 32CL from the proportional valve 31CL, even when the bucket closing operation is performed by the right operation lever 26R. Therefore, the controller 30 can control the proportional valve 31CL and the pressure reducing proportional valve 33CL, to reliably apply a desired pilot pressure to the pilot port on the bucket closing side of the control valve 174.

The pressure reducing proportional valve 33CR operates according to the control current input from the controller 30. Specifically, when the control current is not input from the controller 30, the pressure reducing proportional valve 33CR outputs the pilot pressure corresponding to the bucket opening operation of the right operation lever 26R to the secondary side as is. Conversely, when the control current is input from the controller 30, the pressure reducing proportional valve 33CR reduces the pilot pressure of the secondary side pilot line corresponding to the bucket opening operation of the right operation lever 26R to an extent corresponding to the control current, and outputs the reduced pilot pressure to one inlet port of the shuttle valve 32CR. Thus, even when the bucket opening operation is performed by the right operation lever 26R, the pressure reducing proportional valve 33CR can forcibly suppress or stop the operation of the bucket cylinder 9 corresponding to the bucket opening operation as necessary. Moreover, the pressure reducing proportional valve 33CR can make the pilot pressure acting on one inlet port of the shuttle valve 32CR lower than the pilot pressure acting on another inlet port of the shuttle valve 32CR from the proportional valve 31CR, even when the bucket opening operation is performed by the right operation lever 26R. Therefore, the controller 30 can control the proportional valve 31CR and the pressure reducing proportional valve 33CR to reliably apply a desired pilot pressure to the pilot port on the bucket opening side of the control valve 174.

In this way, the pressure reducing proportional valves 33CL and 33CR can forcibly suppress or stop the operation of the bucket cylinder 9 corresponding to the operation state of the right operation lever 26R in the lateral direction. In addition, the pressure reducing proportional valves 33CL and 33CR reduce the pilot pressures acting on one inlet port of the shuttle valves 32CL and 32CR, and can assist the pilot pressures of the proportional valves 31CL and 31CR to reliably act on the pilot port of the control valve 174 through the shuttle valves 32CL and 32CR.

The controller 30 may forcibly suppress or stop the operation of the bucket cylinder 9 corresponding to the bucket closing operation of the right operation lever 26R by controlling the proportional valve 31CR instead of controlling the pressure reducing proportional valve 33CL. For example, the controller 30 may control the proportional valve 31CR when the bucket closing operation is performed by the right operation lever 26R, and may apply a predetermined pilot pressure to the pilot port on the bucket opening side of the control valve 174 via the shuttle valve 32CR from the proportional valve 31CR. Thus, the pilot pressure acts on the pilot port on the bucket opening side of the control valve 174 in a manner that opposes the pilot pressure acting on the pilot port on the bucket closing side of the control valve 174 via the shuttle valve 32CL from the right operation lever 26R. Therefore, the controller 30 can forcibly bring the control valve 174 close to the neutral position, and suppress or stop the operation of the bucket cylinder 9 corresponding to the bucket closing operation of the right operation lever 26R. Similarly, the controller 30 may forcibly suppress or stop the operation of the bucket cylinder 9 corresponding to the bucket opening operation of the right operation lever 26R by controlling the proportional valve 31CL instead of controlling the pressure reducing proportional valve 33CR.

The operation pressure sensor 29RB detects the operation contents in the lateral directions with respect to the right operation lever 26R by the operator in a form of pressure (operating pressure), and a detection signal corresponding to the detected pressure is taken into the controller 30. Thus, the controller 30 obtains the operation contents in the lateral directions with respect to the right operation lever 26R.

Regardless of the bucket closing operation for the right operation lever 26R by the operator, the controller 30 can supply operating oil discharged from the pilot pump 15 to the pilot port on the left side of the control valve 174 via the proportional valve 31CL and the shuttle valve 32CL. Moreover, the controller 30 can also supply operating oil discharged from the pilot pump 15 to the pilot port on the right side of the control valve 174 via the proportional valve 31CR and the shuttle valve 32CR irrespectively of the bucket opening operation for the right operation lever 26R by the operator. That is, the controller 30 automatically controls the opening/closing operation of the bucket 6, to realize an automatic driving function and a remote control function for the shovel 100.

Figure 4D:
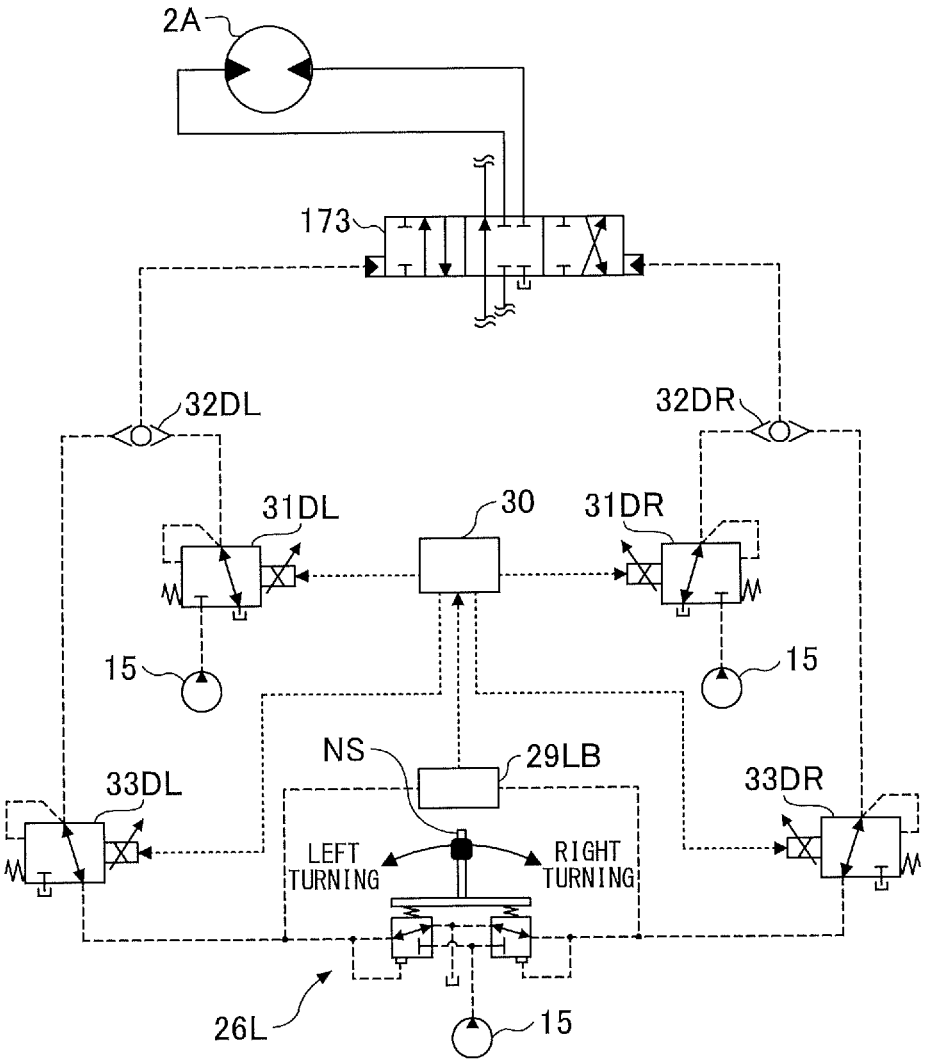
FIG. 4D is a diagram illustrating an example arrangement portion of an operation system related to an upper pivot body in the hydraulic system.

Moreover, as shown in FIG. 4D, for example, the left operation lever 26L is used for operating the pivot hydraulic motor 2A dealing with the upper pivot body 3 (pivot mechanism 2) in such a manner that the operator tilts in the lateral direction. That is, when the left operation lever 26L is tilted in the lateral direction, the turning operation of the upper pivot body 3 is an operation object. The left operation lever 26L uses operating oil discharged from the pilot pump 15 to output the pilot pressure corresponding to the operation contents in the lateral direction to the secondary side.

Two inlet ports of the shuttle valve 32DL are connected to the secondary side pilot line of the left operation lever 26L corresponding to the turning operation to the left (hereinafter referred to as a "left turning operation") of the upper pivot body 3, and the pilot line on the secondary side of the proportional valve 31DL, respectively, and an outlet port is connected to the pilot port on the left side of the control valve 173.

Two inlet ports of the shuttle valve 32DR are connected to the secondary side pilot line of the left operation lever 26L corresponding to the turning operation to the right (hereinafter referred to as a "right turning operation") of the upper pivot body 3 and the pilot line on the secondary side of the proportional valve 31DR, respectively, and an outlet port is connected to the pilot port on the right side of the control valve 173.

That is, the left operation lever 26L causes the pilot pressure corresponding to the operation contents in the lateral direction to act on the pilot port of the control valve 173 via the shuttle valves 32DL and 32DR. Specifically, the left operation lever 26L outputs a pilot pressure corresponding to the operation amount to one inlet port of the shuttle valve 32DL when the left turning operation is performed, and causes the pilot pressure to act on the pilot port on the left side of the control valve 173 via the shuttle valve 32DL. Moreover, the left operation lever 26L outputs a pilot pressure corresponding to the operation amount to one inlet port of the shuttle valve 32DR when the right turning operation is performed, and causes the pilot pressure to act on the pilot port on the right side of the control valve 173 via the shuttle valve 32DR.

The proportional valve 31DL operates according to a control current input from the controller 30. Specifically, the proportional valve 31DL utilizes operating oil discharged from the pilot pump 15 to output the pilot pressure corresponding to the control current input from the controller 30 to another pilot port of the shuttle valve 32DL. This allows the proportional valve 31DL to adjust the pilot pressure acting on the pilot port on the left side of the control valve 173 via the shuttle valve 32DL.

The proportional valve 31DR operates according to a control current output by the controller 30. Specifically, the proportional valve 31DR uses operating oil discharged from the pilot pump 15 to output the pilot pressure corresponding to the control current input from the controller 30 to another pilot port of the shuttle valve 32DR. This allows the proportional valve 31DR to adjust the pilot pressure acting on the pilot port on the right side of the control valve 173 via the shuttle valve 32DR.

That is, the proportional valves 31DL and 31DR can adjust the pilot pressure to be output to the secondary side so that the control valve 173 can be held at an arbitrary valve position regardless of the operation state of the left operation lever 26L.

The pressure reducing proportional valve 33DL operates according to the control current input from the controller 30. Specifically, when the control current is not input from the controller 30, the pressure reducing proportional valve 33DL outputs the pilot pressure corresponding to the left turning operation of the left operation lever 26L to the secondary side as is. Conversely, when the control current is input from the controller 30, the pressure reducing proportional valve 33DL reduces the pilot pressure of the secondary side pilot line corresponding to the left turning operation of the left operation lever 26L to an extent corresponding to the control current, and outputs the reduced pilot pressure to one inlet port of the shuttle valve 32DL. Thus, even when the left operation lever 26L performs the left turning operation, the pressure reducing proportional valve 33DL can forcibly suppress or stop the operation of the pivot hydraulic motor 2A corresponding to the left turning operation as necessary. Moreover, the pressure reducing proportional valve 33DL can make the pilot pressure acting on one inlet port of the shuttle valve 32DL lower than the pilot pressure acting on another inlet port of the shuttle valve 32DL from the proportional valve 31DL, even when the left turning operation is performed by the left operation lever 26L. Therefore, the controller 30 can control the proportional valve 31DL and the pressure reducing proportional valve 33DL, to reliably apply a desired pilot pressure to the pilot port on a left turning side of the control valve 173.

The pressure reducing proportional valve 33DR operates according to the control current input from the controller 30.

Specifically, when the control current is not input from the controller 30, the pressure reducing proportional valve 33DR outputs the pilot pressure corresponding to the right turning operation of the left operation lever 26L to the secondary side as is. Conversely, when the control current is input from the controller 30, the pressure reducing proportional valve 33DR reduces the pilot pressure of the secondary side pilot line corresponding to the right turning operation of the left operation lever 26L to an extent corresponding to the control current, and outputs the reduced pilot pressure to one inlet port of the shuttle valve 32DR. Thus, even when the right turning operation is performed by the left operation lever 26L, the pressure reducing proportional valve 33DR can forcibly suppress or stop the operation of the pivot hydraulic motor 2A corresponding to the right turning operation as necessary. Moreover, the pressure reducing proportional valve 33DR can make the pilot pressure acting on one inlet port of the shuttle valve 32DR lower than the pilot pressure acting on another inlet port of the shuttle valve 32DR from the proportional valve 31DR, even when the right turning operation is performed by the left operation lever 26L. Therefore, the controller 30 can control the proportional valve 31DR and the pressure reducing proportional valve 33DR, to reliably apply a desired pilot pressure to the pilot port on a right turning side of the control valve 173.

In this way, the pressure reducing proportional valves 33DL and 33DR can forcibly suppress or stop the operation of the pivot hydraulic motor 2A corresponding to the operation state of the left operation lever 26L in the lateral direction. In addition, the pressure reducing proportional valves 33DL and 33DR reduce the pilot pressure acting on one inlet port of the shuttle valves 32DL and 32DR, and can assist the pilot pressures of the proportional valves 31DL and 31DR to reliably act on the pilot port of the control valve 173 through the shuttle valves 32DL and 32DR.

The controller 30 may forcibly suppress or stop the operation of the pivot hydraulic motor 2A corresponding to the left turning operation of the left operation lever 26L by controlling the proportional valve 31DR instead of controlling the pressure reducing proportional valve 33DL. For example, the controller 30 may control the proportional valve 31DR when the left operation lever 26L performs the left turning operation, to apply a predetermined pilot pressure to the pilot port on the right turning side of the control valve 173 via the shuttle valve 32DR from the proportional valve 31DR. Thus, the pilot pressure acts on the pilot port on the right turning side of the control valve 173 in a manner that opposes the pilot pressure acting on the pilot port on the left turning side of the control valve 173 from the left operation lever 26L through the shuttle valve 32DL. Therefore, the controller 30 can forcibly bring the control valve 173 close to the neutral position, and suppress or stop the operation of the pivot hydraulic motor 2*a* corresponding to the left turning operation of the left operation lever 26L. Similarly, the controller 30 may forcibly suppress or stop the operation of the pivot hydraulic motor 2A corresponding to the right turning operation of the left operation lever 26L by controlling the proportional valve 31DL instead of controlling the pressure reducing proportional valve 33DR.

The operation pressure sensor 29LB detects the operation state of the left operation lever 26L by the operator as pressure, and a detection signal corresponding to the detected pressure is taken into the controller 30. Thus, the controller 30 obtains the operation contents in the lateral directions with respect to the left operation lever 26L.

Regardless of the left turning operation for the left operation lever 26L by the operator, the controller 30 can supply operating oil discharged from the pilot pump 15 to the pilot port on the left side of the control valve 173 via the proportional valve 31DL and the shuttle valve 32DL. Moreover, the controller 30 can supply operating oil discharged from the pilot pump 15 to the pilot port on the right side of the control valve 173 via the proportional valve 31DR and the shuttle valve 32DR irrespectively of the right turning operation for the left operation lever 26L by the operator. That is, the controller 30 automatically controls the turning operation in the lateral directions of the upper pivot body 3, to realize an automatic driving function and a remote control function for the shovel 100.

For the lower traveling body 1, a configuration capable of automatic control by the controller 30 may be adopted in the same manner as the boom 4, the arm 5, the bucket 6, and the upper pivot body 3. In this case, for example, the shuttle valve 32 is installed in the pilot line on the secondary side between the left traveling lever 26DL and the right traveling lever 26DR and the control valves 171 and 172, respectively, and a proportional valve 31 connected to the shuttle valve 32 and capable of being controlled by the controller 30 may be installed. Thus, the controller 30 can automatically control the traveling operation of the lower traveling body 1 by outputting a control current to the proportional valve 31, and thereby realize an automatic driving function, a remote control function, and the like for the shovel 100.

Next, a control system of the shovel 100 according to the present embodiment includes a controller 30; a space recognition device 70; a direction detection device 71; an input device 72; a positioning device 73; a display device D1; a sound output device D2; a boom angle sensor S1; an arm angle sensor S2; a bucket angle sensor S3; a machine body inclination sensor S4; and a turning state sensor S5.

The controller 30 controls the shovel 100 as described above.

For example, the controller 30 sets a target rotation speed on a basis of a work mode or the like preset by a predetermined operation for the input device 72 by the operator or the like, to perform drive control for making the engine 11 rotate constantly.

For example, the controller 30 outputs a control command to the regulator 13 as required, to change the discharge amount from the main pump 14.

For example, when the operation device 26 is an electric type, the controller 30 may control the proportional valve 31, to implement the operation of the hydraulic actuator according to operation contents from the operation device 26, as described above.

Moreover, for example, the controller 30 may implement the remote operation of the shovel 100 using the proportional valve 31. Specifically, the controller 30 may output a control command corresponding to the content of the remote operation designated by a remote operation signal received from an external device to the proportional valve 31. The proportional valve 31 may output a pilot pressure corresponding to the control command from the controller 30 using operating oil supplied from the pilot pump 15, and apply the pilot pressure to the pilot port of the corresponding control valve in the control valve 17. Thus, the content of the remote operation is reflected in the operation of the control valve 17, and the operation of various operation elements (driven elements) in accordance with the contents of the remote operation is realized by the hydraulic actuator.

Moreover, for example, the controller 30 controls a peripheral monitoring function. In the peripheral monitoring function, an entry of an object to be monitored into a predetermined range (hereinafter referred to as a "monitoring range") around the shovel 100 is monitored on a basis of information acquired by the space recognition device 70. The determination of entry of the object to be monitored into the monitoring range may be performed by the space recognition device 70 or by a device outside the space recognition device 70 (e.g. the controller 30). The object to be monitored may include, for example, people, trucks, other construction machines, utility poles, suspended loads, pylons, or buildings.

For example, the controller 30 controls an object detection notification function. In the object detection notification function, when the peripheral monitoring function determines that there is an object to be monitored within the monitoring range, the presence of the object to be monitored is notified to the operator in the cabin 10 and the surroundings of the shovel 100. The controller 30 may implement the object detection notification function using, for example, the display device D1 and the sound output device D2.

For example, the controller 30 controls an operation limiting function. The operation limiting function restricts the operation of the shovel 100, for example, when the peripheral monitoring function determines that an object to be monitored exists in the monitoring range. Hereinafter, the object to be monitored will be described mainly with reference to the case where the object is a person.

When an object to be monitored such as a person is determined to be present within the predetermined range (within the monitoring range) around the shovel 100 on the basis of the information acquired by the space recognition device 70 before the actuator is operated, the controller 30 may limit the actuator to be inoperable or in a slow-speed state even if the operator operates the operation device 26. Specifically, the controller 30 may disable the actuator by locking the gate lock valve when a person is determined to be present within the monitoring range. In the case of the electric type operation device 26, the actuator can be disabled by disabling the signal from the controller 30 to the proportional valve for operation (proportional valve 31). The same applies to the case of another type operation device 26, when the proportional valve for operation (proportional valve 31) for outputting a pilot pressure corresponding to the control command from the controller 30, and applying the pilot pressure to the pilot port of the corresponding control valve in the control valve 17 is used. When the operation of the actuator is desired to be slow, the control signal from the controller 30 to the proportional valve for operation (proportional valve 31) is limited to the contents corresponding to the relatively small pilot pressure, so that the operation of the actuator can be made slow. Thus, when the object to be monitored is determined to be present within the monitoring range, the actuator is not driven even if the operation device 26 is operated or is driven at an operating speed (slow speed) smaller than the operating speed corresponding to the operation input to the operation device 26. Furthermore, when an object to be monitored such as a person is determined to be present within the monitoring range while the operator operates the operation device 26, the operation of the actuator may be stopped or decelerated regardless of the operation of the operator. Specifically, when a person is determined to be present within the monitoring range, the actuator may be stopped by bringing the gate lock valve into a locked state. In the case where the proportional valve for operation (proportional valve 31) for outputting a pilot pressure corresponding to the control command from the controller 30, and applying the pilot pressure to the pilot port of the corresponding control valve in the control valve 17 is used, a signal from the controller 30 to the proportional valve for operation (proportional valve 31) is made invalid, or a deceleration command is output to the proportional valve for operation (proportional valve 31), so that the controller 30 may limit the actuator to be inoperable or in a slow-speed state. In addition, when the detected object to be monitored is a truck, the control for stopping or decelerating the actuator is not necessarily performed. For example, the actuator may be controlled to avoid the detected truck. As described above, the type of detected object may be recognized, and the actuator may be controlled based on the recognition.

The space recognition device 70 is configured to recognize an object existing in a three-dimensional space around the shovel 100, and measure (calculate) a positional relationship such as a distance from the space recognition device 70 or the shovel 100 to the recognized object. The space recognition device 70 may include, for example, an ultrasonic sensor, a millimeter-wave radar, a monocular camera, a stereo camera, a LIDAR (Light Detecting and Ranging) device, a distance image sensor, an infrared sensor, and the like. In the present embodiment, the space recognition device 70 includes a front recognition sensor 70F attached to a front end of an upper surface of the cabin 10, a rear recognition sensor 70B attached to a rear end of an upper surface of the upper pivot body 3, a left recognition sensor 70L attached to a left end of the upper surface of the upper pivot body 3, and a right recognition sensor 70R attached to a right end of the upper surface of the upper pivot body 3. Moreover, an upper recognition sensor for recognizing an object existing in a space above the upper pivot body 3 may be attached to the shovel 100.

The direction detection device 71 detects information relating to the relative relationship between the orientation of the upper pivot body 3 and the orientation of the lower traveling body 1 (for example, a turning angle of the upper pivot body 3 with respect to the lower traveling body 1)

The direction detection device 71 may include, for example, a combination of a geomagnetic sensor attached to the lower traveling body 1 and a geomagnetic sensor attached to the upper pivot body 3. Moreover, the direction detection device 71 may include a combination of a GNSS receiver attached to the lower traveling body 1 and a GNSS receiver attached to the upper pivot body 3. Moreover, the direction detection device 71 may include the above-described turning state sensor S5, such as a rotary encoder or a rotary position sensor, that is capable of detecting a relative turning angle of the upper pivot body 3 to the lower traveling body 1, and attached to a center joint provided in relation to the pivot mechanism 2 for realizing relative rotation between the lower traveling body 1 and the upper pivot body 3. The direction detection device 71 may include a camera mounted to the upper pivot body 3. In this case, the direction detection device 71 applies a known image processing to an image (input image) captured by the camera attached to the upper pivot body 3, and detects an image of the lower traveling body 1 included in the input image. Then, the direction detection device 71 may detect the image of the lower traveling body 1 by using a known image recognition technique, thereby specifying the longitudinal direction of the lower traveling body 1, and deriving an angle formed between the longitudinal axis direction of the upper pivot body 3 and the longitudinal direction of the lower traveling body 1. At this time, the direction of the longitudinal axis of the upper pivot body 3 can be derived from the mounting position of the camera. In particular, since the crawler 1C projects from the upper pivot body 3, the direction detection device 71 can specify the longitudinal direction of the lower traveling body 1 by detecting the image of the crawler 1C.

In the case where the upper pivot body 3 is turning driven by an electric motor instead of the pivot hydraulic motor 2*a*, the direction detection device 71 may be a resolver.

The input device 72 is provided within a range where the operator in the cabin 10 can reach in a sitting posture, receives various operation inputs from the operator, and outputs to the controller 30 a signal corresponding to the operation input. For example, the input device 72 may include a touch panel implemented on a screen of the display device that displays various information images. Moreover, for example, the input device 72 may include a button switch, a lever, a toggle, or the like, installed around the display device D1. The input device 72 may also include a knob switch (e.g. a switch NS provided in the left operation lever 26L) provided in the operation device 26. The signal corresponding to the operation content for the input device 72 is captured by the controller 30.

The switch NS is, for example, a push button switch provided at the tip of the left operation lever 26L. The operator can operate the left operation lever 26L while pressing the switch NS. Moreover, the switch NS may be provided in the right operation lever 26R and may be provided at another position in the cabin 10.

The positioning device 73 measures the position and orientation of the upper pivot body 3. The positioning device 73 is, for example, a GNSS (Global Navigation Satellite System) compass, and detects the position and orientation of the upper pivot body 3. A detection signal corresponding to the position and orientation of the upper pivot body 3 is taken into the controller 30. Moreover, the function of detecting the orientation of the upper pivot body 3 among the functions of the positioning device 73 may be substituted by an azimuth sensor attached to the upper pivot body 3.

The display device D1 is provided at a position easily visible from the operator in the cabin 10 in a sitting posture, and displays various information images under control by the controller 30. The display device D1 may be connected to the controller 30 via an on-vehicle communication network such as CAN (Controller Area Network), or may be connected to the controller 30 via a one-to-one dedicated line.

The sound output device D2 is provided, for example, in the cabin 10, connected to the controller 30, and outputs sound under control by the controller 30. The sound output device D2 is, for example, a speaker or a buzzer. The sound output device D2 outputs various kinds of information in response to a sound output command from the controller 30.

The boom angle sensor S1 is attached to the boom 4, and detects an angle of depression/elevation of the boom 4 with respect to the upper pivot body 3 (in the following, referred to as a "boom angle"), e.g. an angle formed by a straight line connecting the fulcrums of both ends of the boom 4 with respect to the turning plane of the upper pivot body 3 in a side view. The boom angle sensor S1 may include, for example, a rotary encoder, an acceleration sensor, a gyro sensor (angular velocity sensor), a six-axis sensor, and an inertial measurement unit (IMU). The same applies to the arm angle sensor S2, the bucket angle sensor S3, and the machine body inclination sensor S4. The detection signal corresponding to the boom angle by the boom angle sensor S1 is taken into the controller 30.

The arm angle sensor S2 is attached to the arm 5, and detects a rotation angle of the arm 5 with respect to the boom 4 (in the following, referred to as an "arm angle"), e.g. an angle formed by a straight line connecting the fulcrums of both ends of the arm 5 with respect to the straight line connecting the fulcrums of both ends of the boom 4 in a side view. The detection signal corresponding to the arm angle by the arm angle sensor S2 is taken into the controller 30.

The bucket angle sensor S3 is attached to the bucket 6, and detects a rotation angle of the bucket 6 with respect to the arm 5 (in the following, referred to as a "bucket angle"), e.g. an angle formed by a straight line connecting the fulcrum and the tip (cutting edge) of the bucket 6 with respect to the straight line connecting the fulcrums of both ends of the arm 5, in a side view. The detection signal corresponding to the bucket angle by the bucket angle sensor S3 is taken into the controller 30.

The machine body inclination sensor S4 detects an inclination state of the machine body (for example, the upper pivot body 3) with respect to the horizontal plane. The machine body inclination sensor S4 is attached to, for example, the upper pivot body 3, and detects inclination angles of the shovel 100 (i.e. the upper pivot body 3) about two axes in the longitudinal direction and the lateral direction (hereinafter referred to as a "longitudinal inclination angle" and a "lateral inclination angle"). The machine body inclination sensor S4 may include, for example, an acceleration sensor, a gyro sensor (angular velocity sensor), a six-axis sensor and an IMU. The detection signals corresponding to the inclination angles (longitudinal inclination angle and lateral inclination angle) by the machine body inclination sensor S4 is taken into the controller 30.

The turning state sensor S5 is attached to the upper pivot body 3, and outputs detection information relating to a turning state of the upper pivot body 3. The turning state sensor S5 detects, for example, a turning angular velocity and the turning angle of the upper pivot body 3. The turning state sensor S5 includes, for example, a gyro sensor, a resolver, and a rotary encoder.

When the machine body inclination sensor S4 includes a gyro sensor, a six-axis sensor, an IMU, or the like capable of detecting angular velocities around three axes, the turning state (e.g. turning angular velocity) of the upper pivot body 3 may be detected based on the detection signal of the machine body inclination sensor S4. In this case, the turning state sensor S5 may be omitted.

[Overview of Machine Guidance Function and Machine Control Function of Shovel]

Next, referring to FIG. 5, an overview of the machine guidance function and the machine control function of the shovel will be described.

Figure 5:
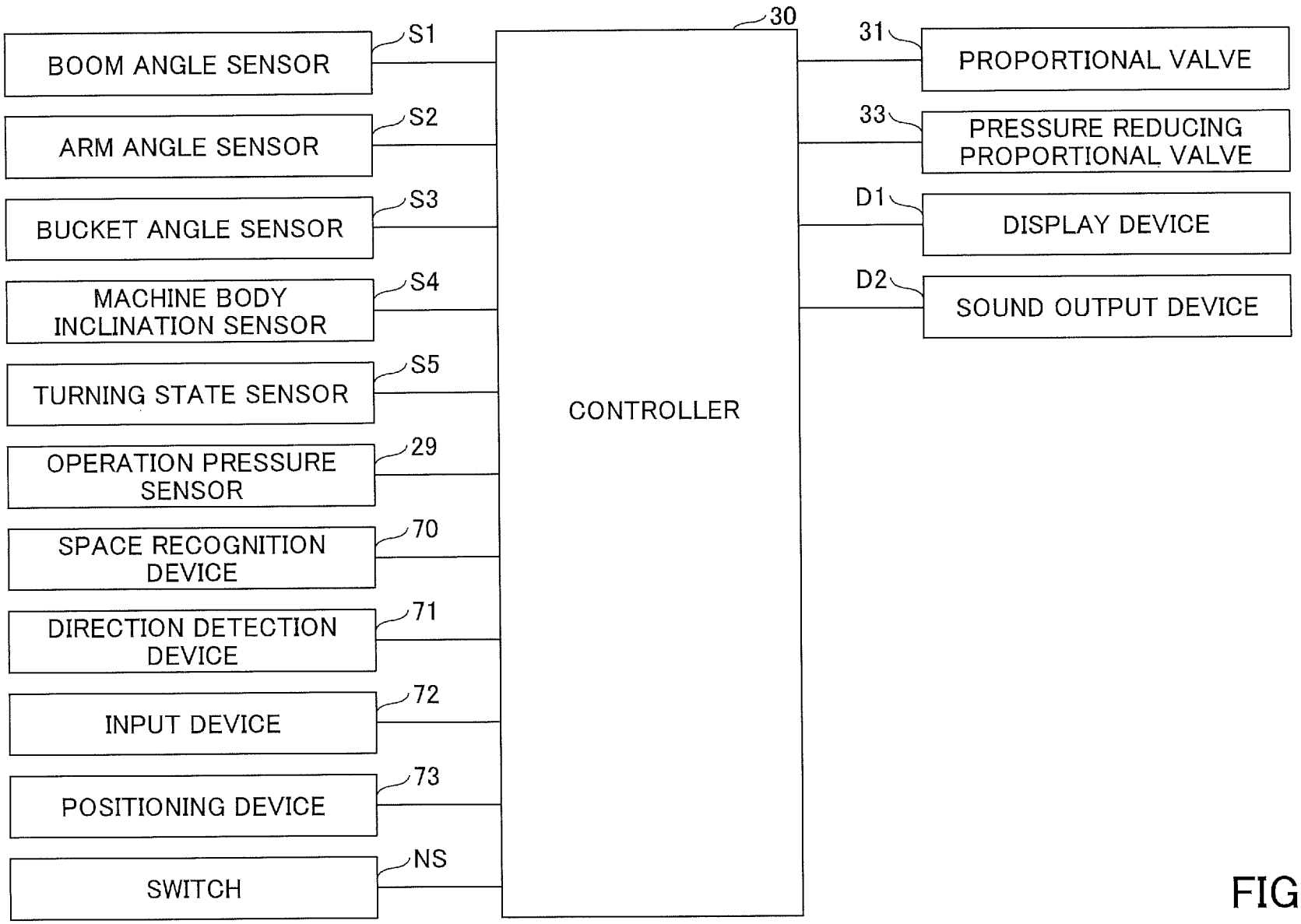
FIG. 5 is a block diagram schematically illustrating an example arrangement related to a machine guidance function and a machine control function of the shovel.

FIG. 5 is a block diagram showing an example of a configuration relating to the machine guidance function and the machine control function of the shovel 100.

The controller 30, for example, executes control of the shovel 100 related to the machine guidance function for guiding a manual operation of the shovel 100 by the operator.

The controller 30 transmits, for example, work information such as a distance between the target construction surface (an example of a design surface) and a tip of the attachment AT, specifically, a work part of the end attachment to the operator through the display device D1, the sound output device D2 or the like. Specifically, the controller 30 acquires information from the boom angle sensor S1, the arm angle sensor S2, the bucket angle sensor S3, the machine body inclination sensor S4, the turning state sensor S5, the space recognition device 70, the positioning device V1, the input device 72, and the like. Then, the controller 30 may, for example, calculate a distance between the bucket 6 and the target construction surface on a basis of the acquired information, and notify the operator of the calculated distance by an image displayed on the display device D1 and a sound output from the sound output device D2. The data on the target construction surface is stored in an internal memory or an external storage device connected to the controller 30, for example, based on a setting input through the input device 72 by the operator or by downloading from the outside (for example, a predetermined management server). The data on the target construction surface is expressed by, for example, a reference coordinate system. The reference coordinate system is, for example, a world geodetic system. The world geodetic system is a three-dimensional orthogonal XYZ coordinate system in which the origin is placed at the center of gravity of the earth and the X-axis is in the direction of the intersection of the Greenwich meridian and the equator, the Y-axis is in the direction of 90 degrees of each longitude, and the Z-axis is taken in the direction of the north pole. For example, the operator may set any point on the construction site as a reference point and set the target construction surface through the input device 72 according to the relative positional relationship with the reference point. The work part of the bucket 6 is, for example, a claw edge of the bucket 6, or a back surface of the bucket 6. When a breaker is employed as an end attachment, for example, instead of the bucket 6, a tip of the breaker corresponds to the work part. Thus, the controller 30 can notify the operator of the work information through the display device D1, the sound output device D2, and the like, and guide the operation of the shovel 100 through the operation device 26 by the operator.

Moreover, the controller 30 also executes control of the shovel 100 related to the machine control function, for example, for assisting manual operation of the shovel 100 by then operator or automatically or autonomously operating the shovel 100. Specifically, the controller 30 is configured to acquire a target trajectory which is a track traced by a position to be a control reference (hereinafter simply referred to as a "control reference") set in a work part or the like of the attachment. When there is a work object (for example, the ground surface or sediment, such as earth, sand, or the like, on a loading platform of a dump truck, to be described later), on which the end attachment can abut, in an excavation work or a rolling work, the work part of the end attachment (for example, the claw edge, the back surface or the like of the bucket 6) may be set in the control reference. Moreover, in the case of the operation where the work object on which the end attachment can abut is absent, such as a boom raising turning operation, a sediment discharge operation, or a boom lowering turning operation, which will be described later, any portion (for example, a lower end or a claw edge of the bucket 6) that can define a position of the end attachment in the operation may be set. For example, the controller 30 derives the target trajectory based on data on the target construction surface stored in an internal or external communicable non-volatile storage device. The controller 30 may derive a target trajectory based on information about the shape of the ground around the shovel 100 recognized by the space recognition device 70. Furthermore, the controller 30 may derive information about the past trajectory of the work part such as the claw edge of the bucket 6 from the past output of the posture detection device (e.g. the boom angle sensor S1, the arm angle sensor S2, the bucket angle sensor S3, or the like) stored temporarily in the internal volatile storage device, and derive the target trajectory on the basis of the information. Moreover, the controller 30 may derive the target trajectory based on the current position of the predetermined portion of the attachment and the data on the target construction surface.

The controller 30 automatically operates the boom 4, the arm 5, the bucket 6, or any combination thereof so that the target construction surface coincides with the tip position of the bucket 6, specifically, the work part such as the claw edge or the back surface of the bucket 6, when the operator manually performs the excavation operation or the leveling operation of the ground. Specifically, when the operator operates the left operation lever 26L in the longitudinal direction while operating (pushing) the switch NS, the controller 30 automatically operates the boom 4, the arm 5, the bucket 6, or any combination thereof so that the target construction surface coincides with the tip position of the bucket 6 according to the operation. More specifically, the controller 30 controls the proportional valve 31, as described above, to automatically operate the boom 4, the arm 5, the bucket 6, or any combination thereof. Thus, the operator can cause the shovel 100 to execute excavation work, leveling work, or the like along the target construction surface, only by operating the left operation lever 26L in the longitudinal direction.

Moreover, when a predetermined condition (hereinafter referred to as a "boom raising turning start condition") is satisfied, the controller 30 automatically causes the boom 4 to perform a raising operation or the like according to the turning operation by the operator, and moves the bucket 6 along a predetermined target trajectory. The boom raising turning start condition is a condition for starting work for moving sediment, such as earth, sand, or the like, stored in the bucket 6 toward a dump truck parked at a predetermined position. For example, the boom raising turning start condition may include a condition in which "the operation direction of the left operation lever 26L is switched from the longitudinal direction to the lateral direction in a state in which the machine control function is valid, i.e. the switch NS is pressed", as will be described later. Moreover, for example, the boom raising turning start condition may include a condition that the left operation lever 26L is operated in the left direction or the right direction in a state in which a predetermined switch (hereinafter referred to as a "boom raising turning start switch") provided at the tip of the left operation lever 26L that can be included in the input device 72 is pressed. For example, the boom raising turning start condition may include a condition that an amount of excavated sediment by the attachment is equal to or greater than a predetermined amount. For example, the boom raising turning start condition may include "completion of excavation by a predetermined distance or more by the attachment". In this case, the controller 30 obtains the amount of excavated sediment and the excavation distance by the attachment on the basis of, for example, an image in front of the upper pivot body 3 by a monocular camera or a stereo camera which can be included in the space recognition device 70. That is, the boom raising turning start condition is a condition for determining whether one operation of the shovel 100 such as excavation operation has been completed. Moreover, in a case where the plurality of above-described conditions are included in the boom raising turning start condition and any one of the plurality of conditions is satisfied, the boom raising turning start condition may be deemed satisfied, or when two or more of the plurality of conditions are satisfied, the boom raising turning start condition may be deemed satisfied. The same applies to the sediment discharge start condition, the boom lowering turning start condition, and the like, which will be described later. Specifically, when the operator operates the left operation lever 26L in the left direction or the right direction, the controller 30 automatically operates at least the boom 4 of the upper pivot body 3 and the attachment AT so that the target trajectory coincides with the control reference portion of the bucket 6 (for example, the lower end of the bucket 6) according to the operation. More specifically, the controller 30 controls the proportional valve 31 and automatically operates the upper pivot body 3, the boom 4, and the like, as described above. Thus, the operator can cause the shovel 100 to perform the boom raising turning operation for moving sediment stored in the bucket 6 to the dump truck, by simply operating the left operation lever 26L in the lateral direction.

When a predetermined condition (hereinafter referred to as a "sediment discharge start condition") is satisfied, the controller 30 automatically performs the opening operation of the arm 5 according to the opening operation of the bucket 6, and discharges sediment stored in the bucket 6 to the dump truck. The sediment discharge start condition is a condition for starting work for discharging sediment stored in the bucket 6 in the dump truck. For example, the sediment discharge start condition may include a condition in which "a state in which the left operation lever 26L is operated in the lateral direction is switched to a state in which the right operation lever 26R is operated in the lateral direction (specifically, the left direction corresponding to the opening operation of the bucket 6) in a state in which the machine control function is valid, i.e. the switch NS is pressed, as will be described later. For example, the sediment discharge start condition may include a condition that the right operation lever 26R is operated to the left direction (closing operation of the bucket 6) or the right direction (opening operation of the bucket 6) in a state in which a predetermined switch (hereinafter referred to as a "sediment discharge start switch") provided at the tip of the right operation lever 26R that can be included in the input device 72 is pressed. For example, the sediment discharge start condition may include a condition that the bucket 6 has reached a predetermined position above the dump truck (e.g. the end point of the target trajectory). In this case, the "predetermined position (end point of the target trajectory)" in the sediment discharge start condition may be changed each time sediment is discharged. Specifically, when the operator operates the right operation lever 26R in the right direction, the controller 30 causes the shovel 100 to perform the opening operation of the bucket 6 and the opening operation of the arm 5 so that sediment in the bucket 6 is discharged to a predetermined target position in the loading platform of the dump truck according to the operation. More specifically, the controller 30 controls the proportional valve 31 and automatically operates the arm 5 and the bucket 6, as described above. Thus, the operator can discharge sediment stored in the bucket 6 to the loading platform of the dump truck simply by operating the right operation lever 26R in the lateral direction (specifically, the right direction).

Moreover, when a predetermined condition (hereinafter referred to as a "boom lowering turning start condition") is satisfied, the controller 30 automatically causes the boom 4 to perform the lowering operation or the like according to the turning operation by the operator, and moves the bucket 6 along a predetermined target trajectory. The boom lowering turning start condition is a condition for starting work for turning and moving the attachment AT to the original position for performing excavation work or the like after discharging sediment stored in the bucket 6 to a loading platform of a dump truck. For example, the boom lowering turning start condition may include a condition in which "a state in which the right operation lever 26R is operated in the lateral direction (specifically, the right direction) is switched to a state in which the left operation lever 26L is operated in the lateral direction" as will be described later. For example, the boom lowering turning start condition may include a condition that the left operation lever 26L is operated in the left direction or the right direction while a predetermined switch (hereinafter referred to as a "boom lowering turning start switch") provided at the tip of the left operation lever 26L, which can be included in the input device 72, is pressed. Moreover, for example, the boom lowering turning start condition may include the condition of "no sediment dropping from the bucket 6 to the loading platform of the dump truck". In this case, the controller 30 obtains the amount of sediment in the bucket 6 on the basis of, for example, an image in front of the upper pivot body 3 by a monocular camera or a stereo camera which can be included in the space recognition device 70. Specifically, when the operator operates the left operation lever 26L in the left direction or the right direction, the controller 30 automatically operates at least the boom 4 of the upper pivot body 3 and the attachment AT so that the target trajectory coincides with a portion to be the control reference of the bucket 6 according to the operation. More specifically, the controller 30 controls the proportional valve 31 and automatically operates the upper pivot body 3, the boom 4 and the like, as described above. Thus, the operator can cause the shovel 100 to perform a boom lowering turning operation for moving the attachment AT to the original position for excavation work or the like after discharging the sediment stored in the bucket 6 to the loading platform of the dump truck by simply operating the left operation lever 26L in the lateral direction.

Moreover, for example, when a predetermined condition (hereinafter referred to as a "leveling operation start condition") is satisfied before the boom lowering turning operation of the shovel 100, the controller 30 may automatically perform an operation (hereinafter referred to as a "leveling operation") for flattening sediment on the loading platform of the dump truck according to an operation related to the attachment by the operator, to move the bucket 6 in accordance with a predetermined target trajectory. The leveling operation start condition is a condition for starting the leveling operation after discharging sediment of the bucket 6 to the loading platform of the dump truck. For example, the leveling operation start condition may include the condition of "sediment falling from the bucket 6 to the loading platform of the dump truck is not present". For example, the leveling operation start condition may include a condition that "the operation of the arm 5 is performed (that is, the left operation lever 26L is operated in the longitudinal direction) in a state in which the bucket 6 is located above the loading platform of the dump truck". In this case, the controller 30 may generate a target trajectory based on a pre-defined shape of the loading platform of the dump truck stored in an internal or external communicable non-volatile storage device.

When a predetermined condition (hereinafter referred to as an "excavation start condition") is satisfied after the boom lowering turning operation of the shovel 100, the controller 30 may automatically perform the excavation operation in accordance with an operation related to the attachment of the operator, and move the bucket 6 along a predetermined target trajectory. The excavation start condition is a condition for starting the excavation operation after the boom lowering turning operation of the shovel 100. For example, the excavation start condition may include a condition that the operation of the arm 5 is performed (i.e. the left operation lever 26L is operated in the longitudinal direction) in a state in which the bucket 6 is above the target construction surface.

As described above, the controller 30 automatically causes the shovel 100 to perform a predetermined operation in accordance with an operation of an operation object, and move a predetermined portion of the attachment along the target trajectory, when a predetermined condition, i.e. a condition corresponding to that an operation object, which has not been operated, starts to be operated through a predetermined operation part (for example, the operation device 26), is satisfied.

In the following, description will be continued assuming that the machine control function is valid, when the operation of the left operation lever 26L or the right operation lever 26R is performed in a state in which the switch NS is pressed.

[Example of Machine Control Function of Shovel]

Next, an example of the machine control function of the shovel 100 according to the present embodiment will be described in detail with reference to FIGS. 6A to 8B.

<Configuration Related to Machine Control Function of Shovel>

The configuration related to the example of the machine control function of the shovel 100 will be described in detail with reference to FIGS. 6A to 6C.

Figure 6A:
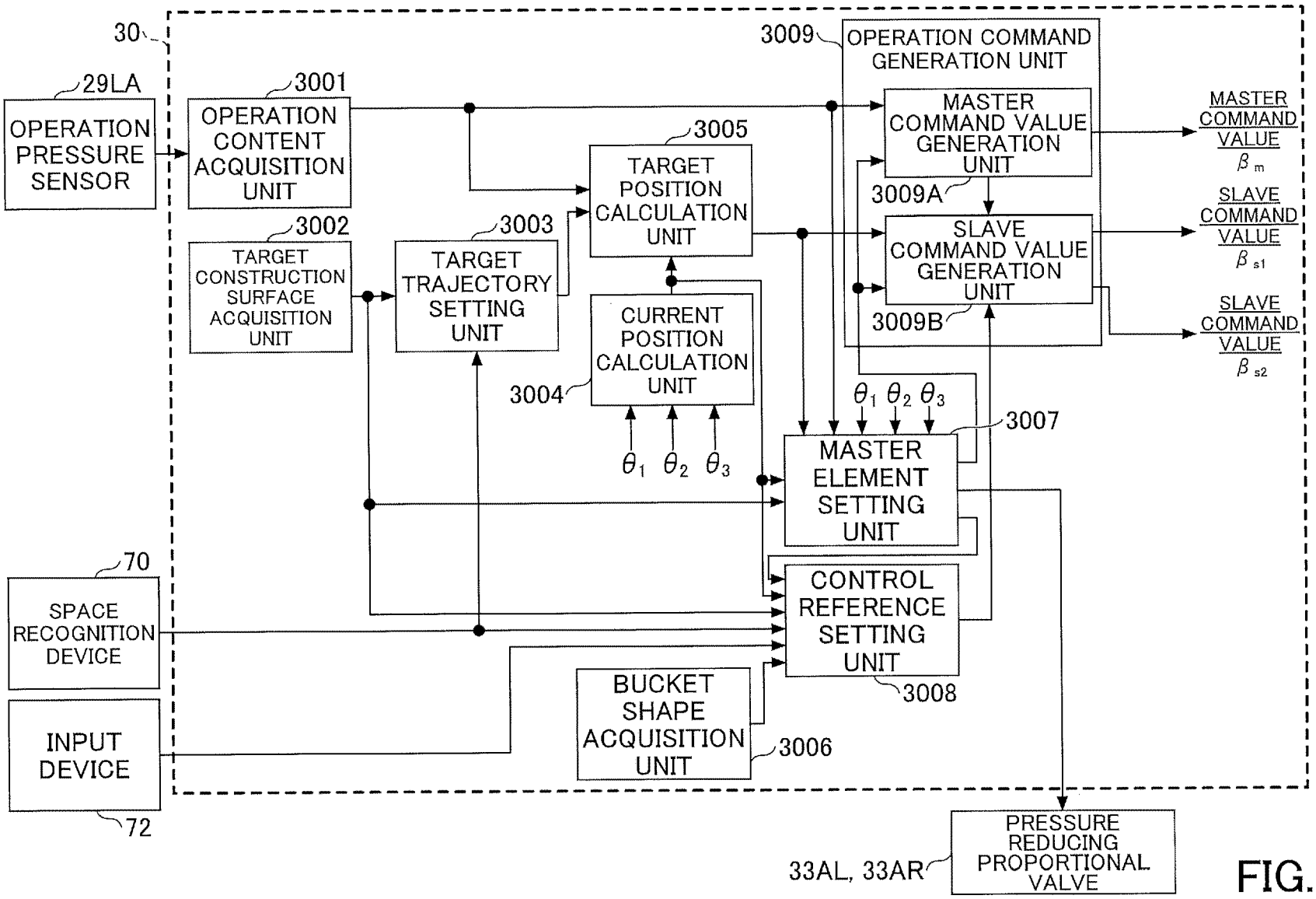
FIG. 6A is a functional block diagram illustrating an exemplary detailed arrangement related to the machine control function of the shovel.
Figure 6B:
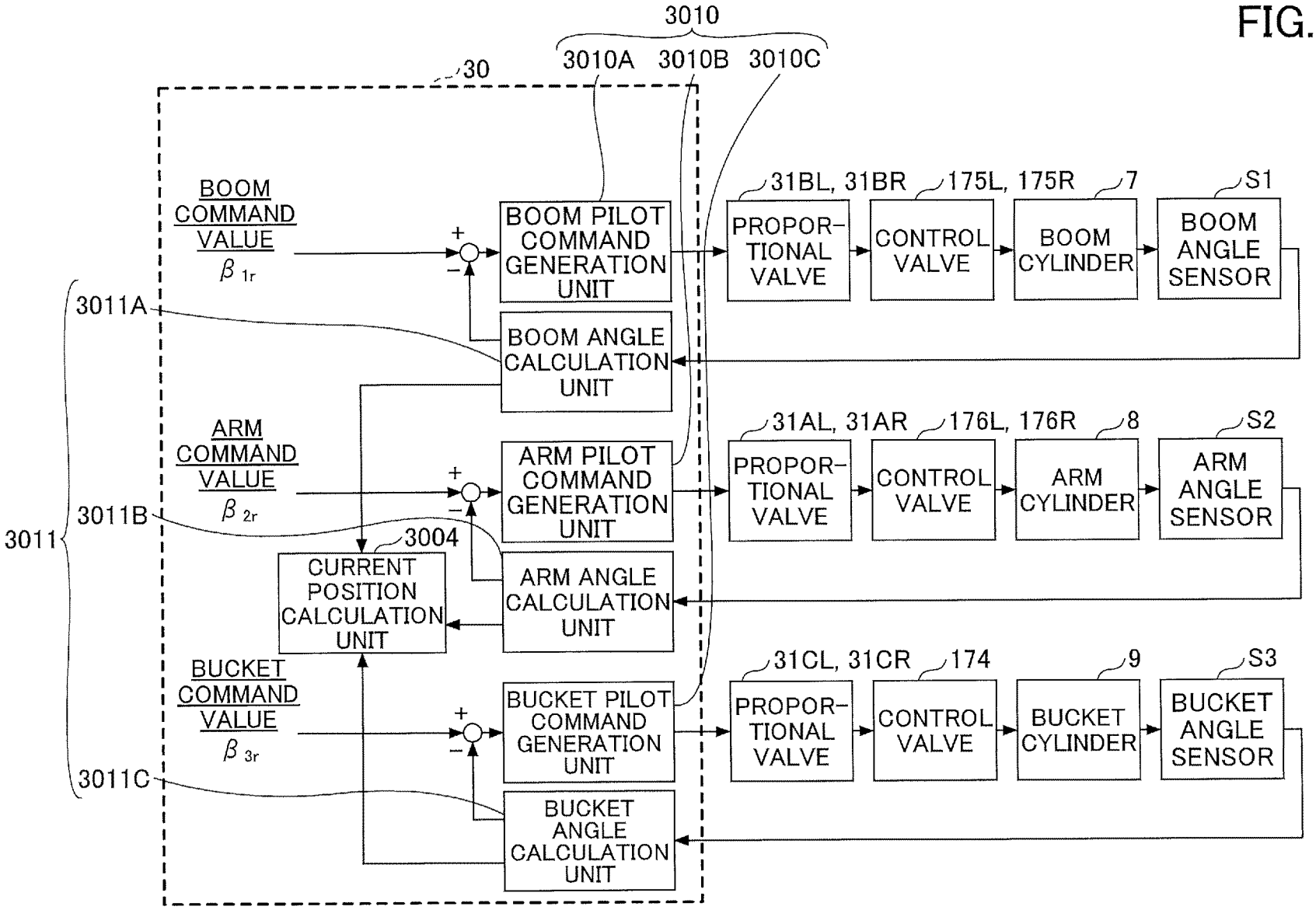
FIG. 6B is a functional block diagram illustrating an exemplary detailed arrangement related to the machine control function of the shovel.
Figure 6C:
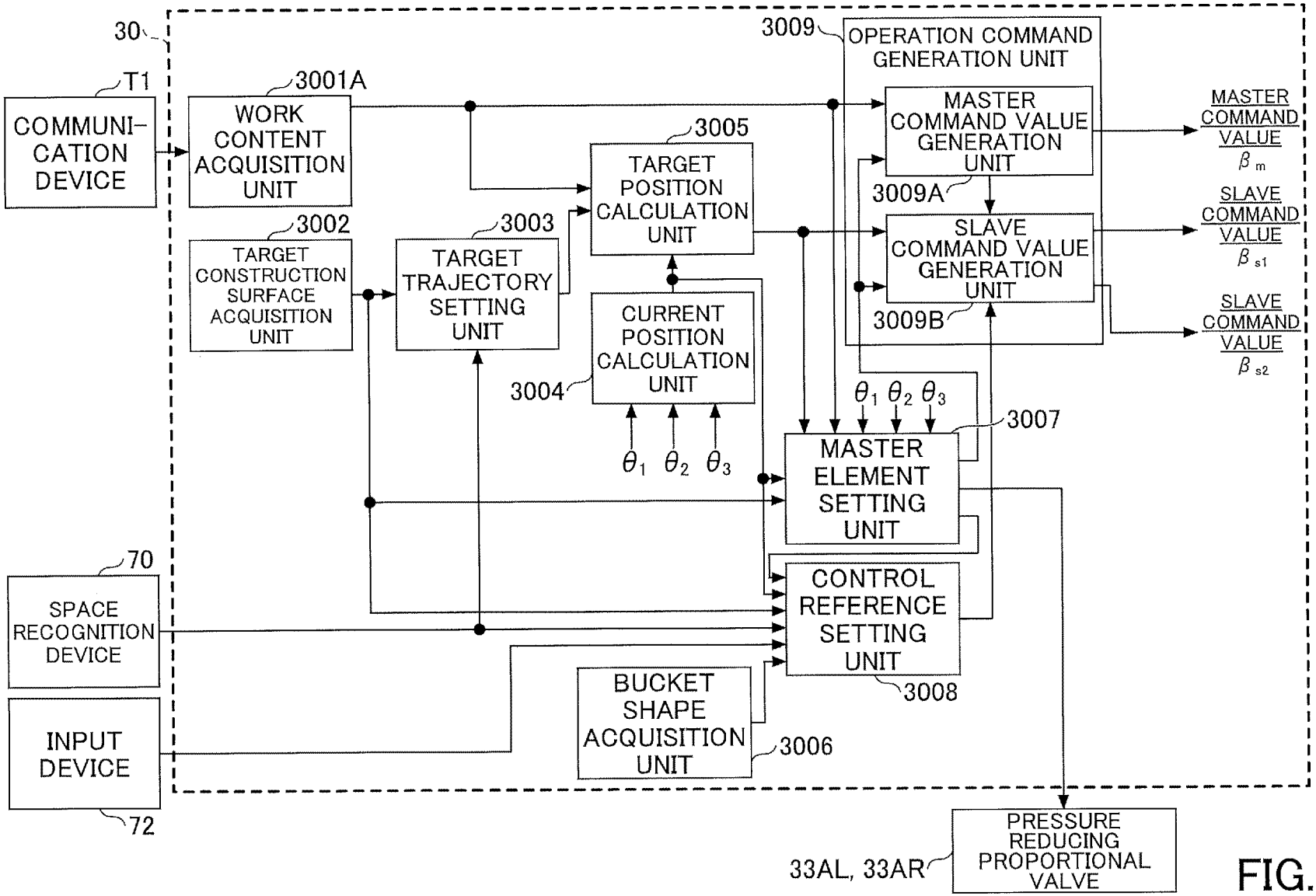
FIG. 6C is a functional block diagram illustrating an exemplary detailed arrangement related to the machine control function of the shovel.

FIGS. 6A to 6C are functional block diagrams illustrating an example of a detailed structure relating to the machine control function of the shovel 100 according to the present embodiment. Specifically, FIGS. 6A and 6B are functional block diagrams showing a detailed structure relating to a semi-automatic driving function of the shovel 100, and FIG. 6C is a functional block diagram showing a detailed structure relating to an autonomous driving function of the shovel 100. Because components described in FIG. 6B are common in both the semi-automatic driving function and the autonomous driving function, description of the components corresponding to the autonomous driving function of the shovel 100 will be omitted, and the autonomous driving function of the shovel 100 will be described with applying FIG. 6B by analogy.

As shown in FIG. 6A and FIG. 6B, the controller 30 that realizes the semi-automatic driving function of the shovel 100, includes, as function units related to the machine control function, an operation content acquisition unit 3001; a target construction surface acquisition unit 3002; a target trajectory setting unit 3003; a current position calculation unit 3004; a target position calculation unit 3005; a bucket shape acquisition unit 3006; a master element setting unit 3007; a control reference setting unit 3008; an operation command generation unit 3009; a pilot command generation unit 3010; and a posture angle calculation unit 3011. These function units 3001 to 3011 repeatedly execute operations, which will be described later, respectively, for each predetermined control period, for example, when the switch NS is pressed.

Moreover, as shown in FIG. 6B and FIG. 6C, the controller 30 that realized the autonomous driving function of the shovel 100, as function units related to the machine control function, a work content acquisition unit 3001A; a target construction surface acquisition unit 3002; a target trajectory setting unit 3003; a current position calculation unit 3004; a target position calculation unit 3005; a bucket shape acquisition unit 3006; a master element setting unit 3007; a control reference setting unit 3008; an operation command generation unit 3009; a pilot command generation unit 3010; and a posture angle calculation unit 3011. These function units 3001A and 3002 to 3011 repeatedly execute operations, which will be described later for each predetermined control period, for example, when the autonomous driving function is valid.

That is, the controller 30 in the case of realizing the autonomous driving function of the shovel 100 (FIG. 6C), is different from the controller 30 in the case of realizing the semi-automatic driving function of the shovel 100 (FIG. 6A), in that the work content acquisition unit 3001A is included instead of the operation content acquisition unit 3001.

The operation content acquisition unit 3001 acquires, on the basis of a detection signal captured from the operation pressure sensor 29LA, the operation content relating to the tilting operation in the longitudinal direction in the left operation lever 26L. For example, the operation content acquisition unit 3001 acquires (calculates) an operation direction (whether a front direction or a rear direction) and an operation amount, as operation contents. When the shovel 100 is remotely operated, the semi-automatic driving function of the shovel 100 may be realized on the basis of the content of the remote operation signal received from an external device. In this case, the operation content acquisition unit 3001 acquires the operation content related to the remote operation on the basis of the remote operation signal received from the external device.

On the other hand, the work content acquisition unit 3001*a* acquires information about work content to be executed by the shovel 100 (hereinafter referred to as "work content information") from a predetermined external device (for example, a support device 200, a management device 300, or the like, which will be described later) through a communication device T1 mounted on the shovel 100. The work content information includes, for example, content of a predetermined work performed by the shovel 100, a content of operation constituting the predetermined work, an operation condition relating to the predetermined work, or a trigger condition for starting the work. The predetermined work may include, for example, excavation work, loading work, or leveling work. The operation constituting the predetermined work includes, for example, an excavation operation, a boom raising turning operation, a sediment discharge operation, and a boom lowering turning operation when the predetermined work is an excavation work. The operation conditions include conditions related to excavation depth, excavation length, and the like, for example, when the predetermined work is excavation work. The work content acquisition unit 3001A outputs an operation command relating to an operation element (actuator) of the shovel 100 on the basis of the acquired work content information.

The target construction surface acquisition unit 3002 acquires data on a target construction surface from, for example, an internal memory or a predetermined external storage device.

The target trajectory setting unit 3003 sets, on the basis of the data on the target construction surface, information about the target trajectory of a tip of the attachment AT for moving the tip of the attachment AT, specifically, a predetermined site to be a control reference of the end attachment (for example, the claw edge or the back surface of the bucket 6) along the target construction surface. For example, the target trajectory setting unit 3003 may set, as information on the target trajectory, an angle of inclination of the target construction surface in the longitudinal direction with the machine body (upper pivot body 3) of the shovel 100 as a reference. In addition, an error range that can be allowed (hereinafter referred to as an "allowable error range") may be set in the target trajectory. In this case, the information about the target trajectory may include information about the allowable error range.

The current position calculation unit 3004 calculates a position (current position) of the control reference (e.g. the claw edge or the back surface as the work part of the bucket 6) at the attachment AT. Specifically, the current position calculation unit 3004 may calculate the (current) position of the control reference of the attachment AT on the basis of the boom angle $\theta_1$, the arm angle $\theta_2$, and the bucket angle $\theta_3$ calculated by the posture angle calculation unit 3011, which will be described later.

The target position calculation unit 3005 calculates the target position of the tip (control reference) of the attachment AT, on the basis of the content of the operator's operation input relating to the work (e.g. the operation of the left operation lever 26L in the longitudinal direction), information related to the set target trajectory, and the current position of the control reference (work part) at the attachment AT, in the semi-automatic driving function of the shovel 100. The operation content includes, for example, an operation direction and an operation amount. When the arm 5 is assumed to operate in accordance with the operation direction and the operation amount in the operation input by the operator, the target position is a position on the target trajectory to be reached in the current control period (in other words, the target construction surface). The target position calculation unit 3005 may calculate the target position of the tip of the attachment AT using a map, an arithmetic expression, or the like stored in advance in a non-volatile internal memory or the like.

Moreover, in the autonomous operation function of the shovel 100, the target position calculation unit 3005 calculates the target position of the tip (control reference) of the attachment AT, on the basis of the operation command input from the work content acquisition unit 3001A, information on the set target trajectory, and the current position of the control reference (work part) at the attachment AT. Thus, the controller 30 can autonomously control the shovel 100 independently of the operator's operation.

The bucket shape acquisition unit 3006 acquires data relating to a shape of the bucket 6 registered in advance from, for example, an internal memory or a predetermined external storage device. At this stage, the bucket shape acquisition unit 3006 may acquire data relating to the shape of the bucket 6 of the type set by the setting operation through the input device 72 among the data relating to the shape of the plurality of types of buckets 6 registered in advance.

The master element setting unit 3007 sets an operation element (actuator) (hereinafter referred to as a "master element") that operates in response to the operator's operation input or the operator's operation command from among the operation elements constituting the attachment AT (actuator for driving these operation elements). In the following, the operation element operating in accordance with the operator's operation input or the operation command relating to the autonomous driving function, and the actuator for driving the operation element may be referred to as a master element collectively or individually. The same applies to slave elements described later. When the master element setting unit 3007 sets an element other than the arm 5 (arm cylinder 8) of the attachment AT, that is, the boom 4 (boom cylinder 7) or the bucket 6 (bucket cylinder 9) to the master element, the master element setting unit 3007 outputs a command for making the pilot line in a non-communication state with respect to the pressure reducing proportional valves 33AL and 33AR or the selector valve. Thus, the controller 30 can prevent the pilot pressure corresponding to the operation of the left operation lever 26L in the longitudinal direction from acting on the control valves 176L and 176R corresponding to the arm cylinder 8 for driving the arm 5 via the shuttle valves 32AL and 32AR. A specific method of setting the master element by the master element setting unit 3007 will be described later (see FIG. 7A.)

The control reference setting unit 3008 sets a control reference at the attachment AT. For example, the control reference setting unit 3008 may set the control reference for the attachment AT in response to the operation by the operator or the like through the input device 72. Moreover, for example, the control reference setting unit 3008 may automatically change the setting of the control reference for the attachment AT when a predetermined condition is satisfied. Details of the setting method of the control reference for the attachment AT by the control reference setting unit 3008 will be described later (see FIG. 7B).

The operation command generation unit 3009 generates a command value related to the operation of the boom 4 (hereinafter referred to as a "boom command value") $\beta_{1r}$, a command value related to the operation of the arm 5 (in the following, referred to as an "arm command value") $\beta_{2r}$, and a command value related to the operation of the bucket 6 (in the following, referred to as a "bucket command value") $\beta_{3r}$, on the basis of the target position of the control reference at the attachment AT. For example, the boom command value $\beta_{1r}$, the arm command value $\beta_{2r}$, and the bucket command value $\beta_{3r}$ are the angular velocity of the boom 4 (hereinafter referred to as a "boom angular velocity"), the angular velocity of the arm 5 (hereinafter referred to as an "arm angular velocity"), and the angular velocity of the bucket 6 (hereinafter referred to as a "bucket angular velocity"), respectively, required for the control reference at the attachment AT to achieve the target position. The operation command generation unit 3009 includes a master command value generation unit 3009A and a slave command value generation unit 3009B.

The boom command value, the arm command value, and the bucket command value may be a boom angle, an arm angle, and a bucket angle when the control reference at the attachment AT achieves the target position. Moreover, the boom command value, the arm command value, and the bucket command value may be angular accelerations or the like required to achieve the target position of the control reference at the attachment AT.

The master command value generation unit 3009A generates a command value (hereinafter, referred to as a "master command value") $\beta_m$ relating to the operation of the master element among the operation elements (the boom 4, the arm 5, and the bucket 6) constituting the attachment AT. For example, when the master element set by the master element setting unit 3007 is the boom 4 (the boom cylinder 7), the master command value generation unit 3009A generates a boom command value $\beta_{1r}$ as the master command value $\beta_m$, and outputs the value to a boom pilot command generation unit 3010A, which will be described later. Moreover, for example, the master command value generation unit 3009A generates an arm command value $\beta_{2r}$ when the master element set by the master element setting unit 3007 is the arm 5 (arm cylinder 8), and outputs the value to the arm pilot command generation unit 3010B. Moreover, for example, when the master element set by the master element setting unit 3007 is the bucket 6 (bucket cylinder 9), the master command value generation unit 3009A generates a bucket command value $\beta_{3r}$ as the master command value $\beta_m$ and outputs the value to the bucket pilot command generation unit 3010C. Specifically, the master command value generation unit 3009A generates a master command value $\beta_m$ corresponding to the operation of the operator or the content of the operation command (operation direction and amount of operation). For example, the master command value generation unit 3009A may generate, as the master command value, the boom command value $\beta_{1r}$, the arm command value $\beta_{2r}$ and the bucket command value $\beta_{3r}$, on the basis of a predetermined map, conversion formula, or the like defining the relationship between the operator's operation or the content of the operation command, and each of the boom command value $\beta_{1r}$, the arm command value $\beta_{2r}$, and the bucket command value $\beta_{3r}$.

Moreover, in the case where the left operation lever 26L is operated by the operator of the cabin 10 in the semi-automatic driving function (FIG. 6A) for the shovel 100, when the master element is the arm 5, the master command value generation unit 3009A may not generate the master command value $\beta_m$ (arm command value ß2*r*). This is because, when the left operation lever 26L is operated in the longitudinal direction, the pilot pressure corresponding to the operation content acts on the control valves 176L and 176R corresponding to the arm cylinder 8 for driving the arm 5 via the shuttle valves 32AL and 32AR, and the arm 5 can operate as the master element, as described above.

The slave command value generation unit 3009B generates command values (hereinafter referred to as "slave command values") $\beta_{s1}$ and $\beta_{s2}$ relating to an operation of a slave element which operates so that the control reference of the attachment AT moves along the target construction surface in accordance with the operation of the master element (in synchronization) among the operation elements constituting the attachment AT. When the boom 4 is set to the master element by the master element setting unit 3007, for example, the slave command value generation unit 3009B generates the arm command value Bar and the bucket command value $\beta_{3r}$, as the slave command values $\beta_{s1}$ and $\beta_{s2}$, and outputs them to the arm pilot command generation unit 3010B and the bucket pilot command generation unit 3010C, respectively. When the arm 5 is set to the master element by the master element setting unit 3007, for example, the slave command value generation unit 3009B generates the boom command value $\beta_{1r}$ and the bucket command value $\beta_{3r}$ as the slave command values $\beta_{s1}$ and $\beta_{s2}$, and outputs the boom command value $\beta_{1r}$ and the bucket command value $\beta_{3r}$ to the boom pilot command generation unit 3010A and the bucket pilot command generation unit 3010C, respectively. When the bucket 6 is set to the master element by the master element setting unit 3007, the slave command value generation unit 3009B generates a boom command value $\beta_{1r}$ and an arm command value $\beta_{2r}$ as the slave command values $\beta_{s1}$ and $\beta_{s2}$, and outputs them to the boom pilot command generation unit 3010A and the arm pilot command generation unit 3010B, respectively. Specifically, the slave command value generation unit 3009B generates the slave command values $\beta_{s1}$ and $\beta_{s2}$ so that the slave element operates according to the operation of the master element (in synchronization) corresponding to the master command value $\beta_m$, and the control reference of the attachment AT can achieve the target position (i.e. move along the target construction surface). This allows the controller 30 to move the control reference of the attachment AT along the target construction surface by operating the two slave elements of the attachment AT in accordance with (i.e. synchronizing with) the operation of the master element of the attachment AT corresponding to the operation input of the operator or the operation command. That is, the master element (i.e. the hydraulic actuator of the master element) operates in response to the operator's operation input or the operation command, and the operation of the slave element (i.e. the hydraulic actuator of the slave element) is controlled in accordance with the operation of the master element (the hydraulic actuator of the master element) so that the tip (the control reference) of the attachment AT, such as the claw edge of the bucket 6, moves along the target construction surface.

The pilot command generation unit 3010 generates a command value (hereinafter referred to as a "pilot pressure command value") of a pilot pressure for acting on the control valves 174 to 176 for realizing the boom angular velocity, the arm angular velocity, and the bucket angular velocity corresponding to the boom command value $\beta_{1r}$, the arm command value $\beta_{2r}$, and the bucket command value $\beta_{3r}$. The pilot command generation unit 3010 includes a boom pilot command generation unit 3010A, an arm pilot command generation unit 3010B, and a bucket pilot command generation unit 3010C.

The boom pilot command generation unit 3010A generates a pilot pressure command value for acting on the control valves 175L and 175R corresponding to the boom cylinder 7 for driving the boom 4 on the basis of the deviation between the boom command value $\beta_{1r}$ and a calculated value (measured value) of the current boom angular velocity by the boom angle calculation unit 3011A, to be described later. Then, the boom pilot command generation unit 3010A outputs a control current corresponding to the generated pilot pressure command value to the proportional valves 31BL and 31BR. Thus, as described above, the pilot pressure corresponding to the pilot pressure command value output from the proportional valves 31BL and 31BR acts on the corresponding pilot ports of the control valves 175L and 175R via the shuttle valves 32BL and 32BR. Then, the boom cylinder 7 operates according to the action of the control valves 175L and 175R, and the boom 4 operates so as to achieve the boom angular velocity corresponding to the boom command value $\beta_{1r}$.

The arm pilot command generation unit 3010B generates a pilot pressure command value for acting on the control valves 176L and 176R corresponding to the arm cylinder 8 for driving the arm 5 on the basis of the deviation between the arm command value Bar and a calculated value (measured value) of the current arm angular velocity by the arm angle calculation unit 3011B, to be described later. Then, the arm pilot command generation unit 3010B outputs a control current corresponding to the generated pilot pressure command value to the proportional valves 31AL and 31AR. Thus, as described above, the pilot pressure corresponding to the pilot pressure command value output from the proportional valves 31AL and 31AR acts on the corresponding pilot ports of the control valves 176L and 176R via the shuttle valves 32AL and 32AR. Then, the arm cylinder 8 operates according to the action of the control valves 176L and 176R, and the arm 5 operates so as to achieve the arm angular velocity corresponding to the arm command value $\beta_{2r}$.

The bucket pilot command generation unit 3010C generates a pilot pressure command value for acting on the control valve 174 corresponding to the bucket cylinder 9 for driving the bucket 6 on the basis of the deviation between the bucket command value $\beta_{3r}$ and a calculated value (measured value) of the current bucket angular velocity by the bucket angle calculation unit 3011C, to be described later. Then, the bucket pilot command generation unit 3010C outputs a control current corresponding to the generated pilot pressure command value to the proportional valves 31CL and 31CR. Thus, as described above, the pilot pressure corresponding to the pilot pressure command value output from the proportional valves 31CL and 31CR acts on the corresponding pilot port of the control valve 174 via the shuttle valves 32CL and 32CR. Then, the bucket cylinder 9 operates according to the action of the control valve 174, and the bucket 6 operates so as to achieve the bucket angular velocity corresponding to the bucket command value $\beta_{3r}$.

The posture angle calculation unit 3011 calculates (measures) the (current) boom angle, the arm angle, and the bucket angle, and the boom angular velocity, the arm angular velocity, and the bucket angular velocity, based on the detection signals of the boom angle sensor S1, the arm angle sensor S2, and the bucket angle sensor S3. The posture angle calculation unit 3011 includes a boom angle calculation unit 3011A, an arm angle calculation unit 3011B, and a bucket angle calculation unit 3011C.

The boom angle calculation unit 3011A calculates (measures) the boom angle, the boom angular velocity, and the like, on the basis of the detection signal fetched from the boom angle sensor S1. Thus, the boom pilot command generation unit 3010A can perform a feedback control related to the operation of the boom cylinder 7 on the basis of the measurement result of the boom angle calculation unit 3011A.

The arm angle calculation unit 3011B calculates (measures) the arm angle, the arm angular velocity, and the like, on the basis of the detection signal fetched from the arm angle sensor S2. Thus, the arm pilot command generation unit 3010B can perform a feedback control related to the operation of the arm cylinder 8 on the basis of the measurement result of the arm angle calculation unit 3011B.

The bucket angle calculation unit 3011C calculates (measures) the bucket angle, the bucket angular velocity, and the like, on the basis of the detection signal fetched from the bucket angle sensor S3. Thus, the bucket pilot command generation unit 3010C can perform a feedback control related to the operation of the bucket cylinder 9 on the basis of the measurement result of the bucket angle calculation unit 3011C.

<Processing Related to Machine Control Function of Shovel>

Next, referring to FIGS. 7A to 7C, a processing flow of the controller 30 relating to an example of a machine control function of the shovel 100 will be described.

Figure 7A:
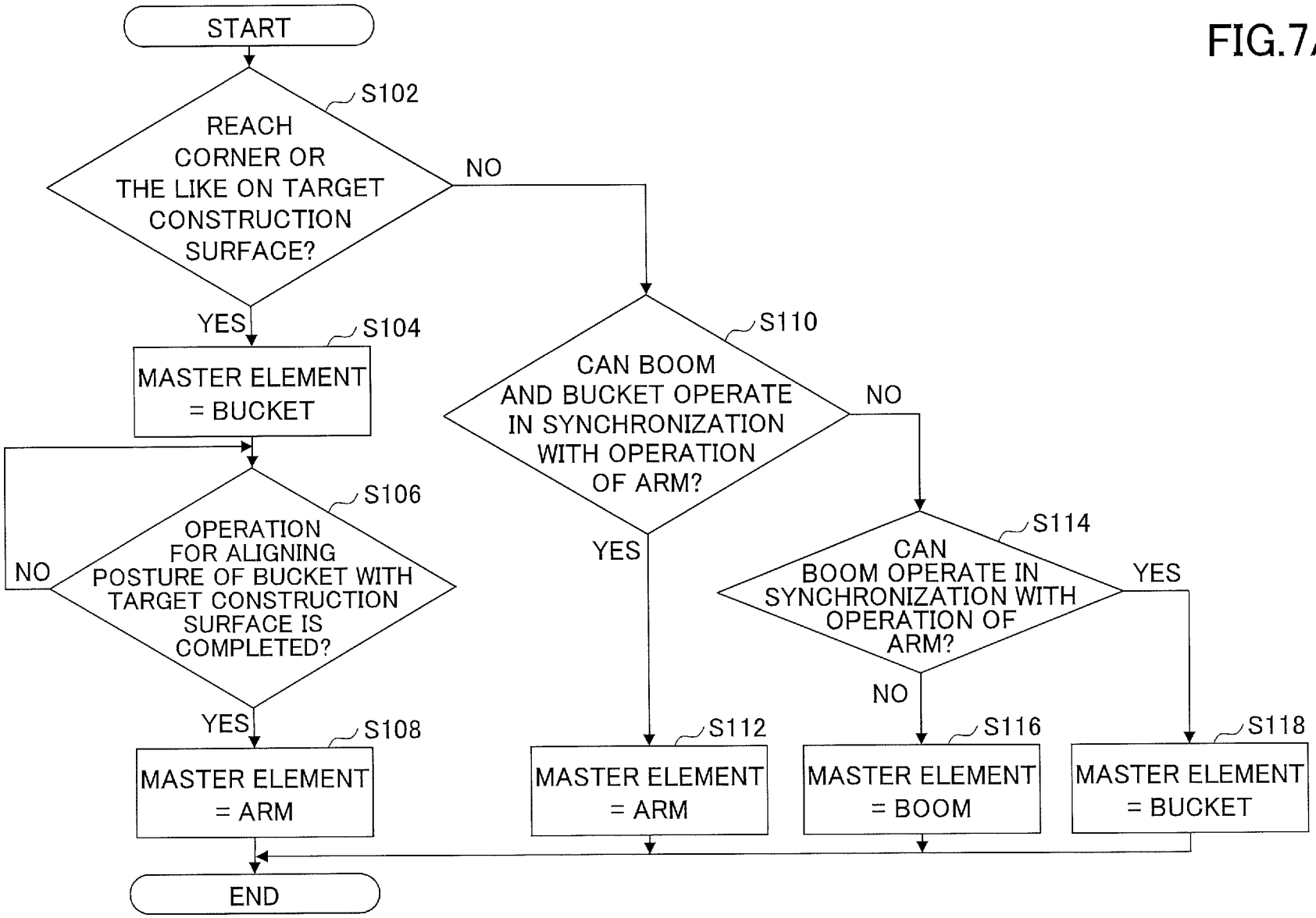
FIG. 7A is a flowchart for schematically illustrating an example of a master switching process by a controller of the shovel.
Figure 7B:
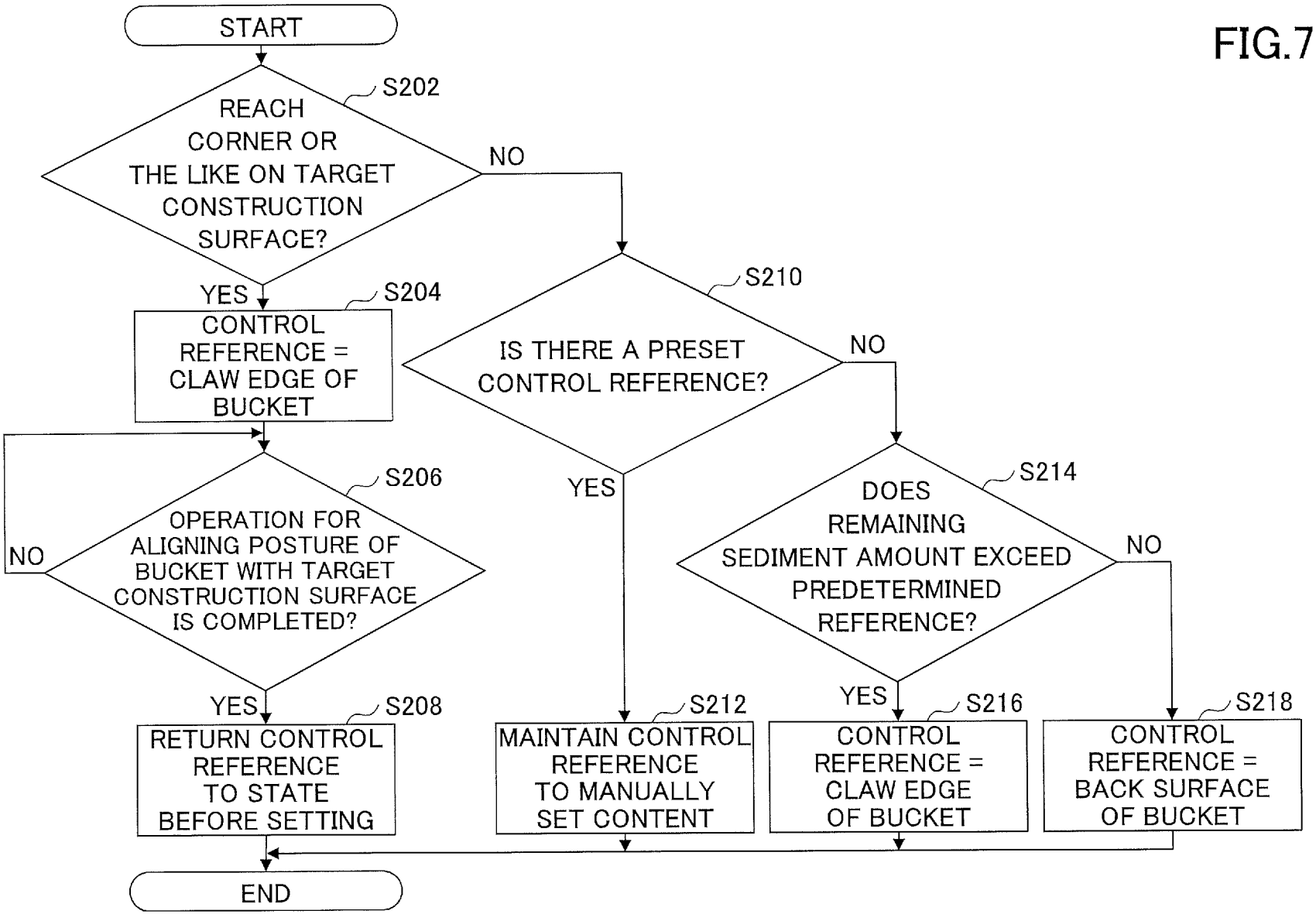
FIG. 7B is a flowchart for schematically illustrating an example of a control reference switching process by a controller of the shovel according to the embodiment.
Figure 7C:
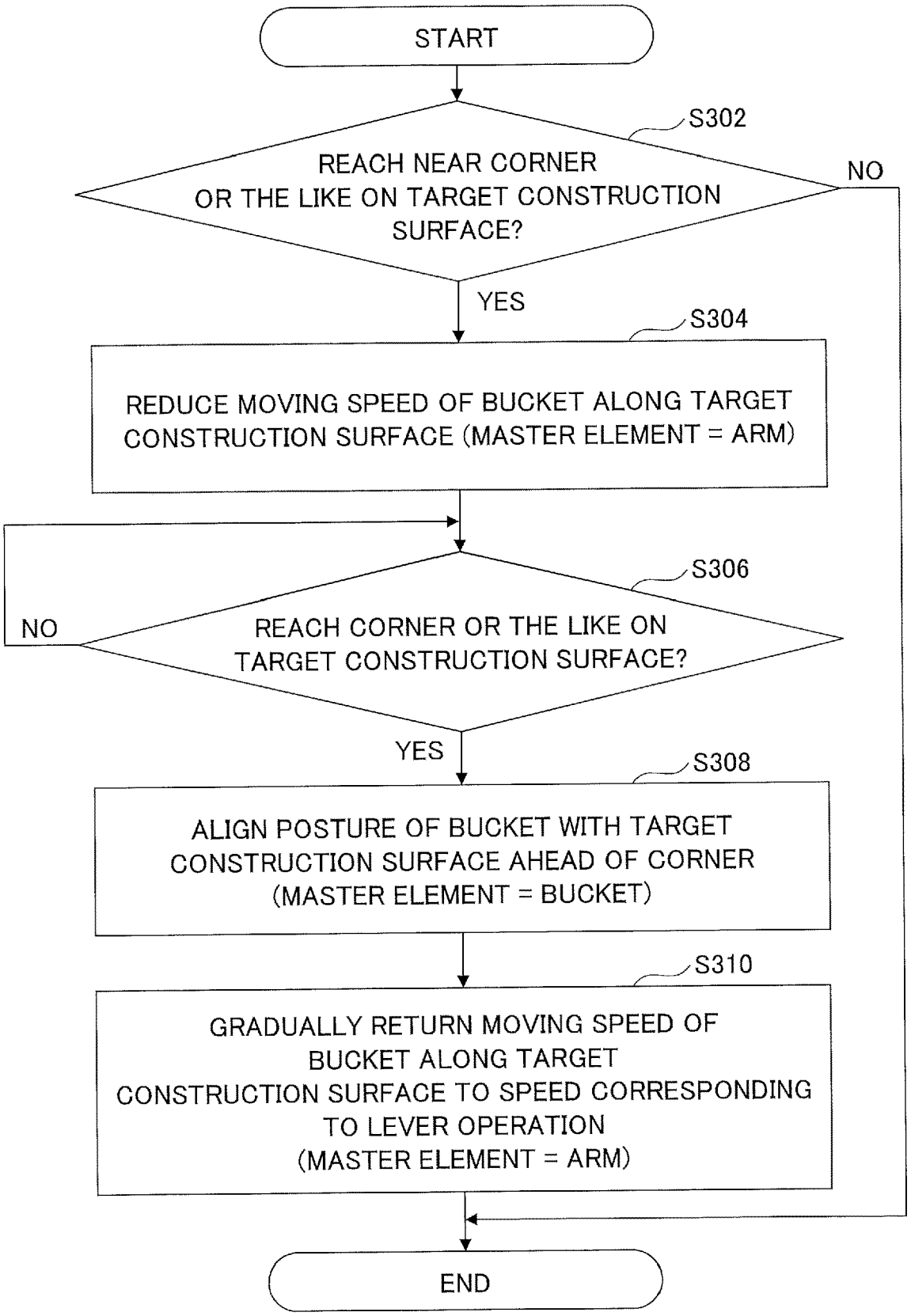
FIG. 7C is a flowchart for schematically illustrating an example of a leveling excavation control process by the controller of the shovel according to the embodiment.

FIGS. 7A to 7C are flowcharts schematically illustrating an example of processing related to the machine control function by the controller 30 of the shovel 100 according to the present embodiment. Specifically, FIG. 7A is a flowchart schematically showing an example of a control process for switching the master element (hereinafter referred to as a "master switching process") by the controller 30 (the master element setting unit 3007) of the shovel 100 according to the present embodiment. FIG. 7B is a flowchart schematically showing an example of a control process for switching the control reference of the attachment AT (hereinafter referred to as a "control reference switching process") by the controller 30 (the control reference setting unit 3008) of the shovel 100 according to the present embodiment. FIG. 7C is a flowchart schematically showing an example of a control process for moving the control reference along the target construction surface (in the following, referred to as a "leveling control process") by the controller 30 (the operation command generation unit 3009) of the shovel 100 according to the present embodiment.

<<Master Switching Process>>

The flowchart in FIG. 7A may be performed repeatedly for each processing interval corresponding to a cycle of the above-described control process when the machine control function of the shovel 100 is valid. In the following description, the arm 5 is assumed to be set to the master element when the state of the machine control function is switched from invalid to valid, as an initial setting (default).

In step S102, the master element setting unit 3007 determines whether the control reference of the attachment AT reaches a corner, a large curvature portion, or a curved portion (hereinafter, generally referred to as a "corner or the like") on the target construction surface, as the control reference of the attachment AT (for example, the claw edge, the back surface or the like of the bucket 6) moves along the target construction surface. The corner represents a portion in which an inclination of the target construction surface changes intermittently in an extension direction of the attachment with respect to the upper pivot body 3 when the shovel 100 is viewed in the top view (hereinafter referred to simply as the "extension direction of the attachment"). Moreover, the large curvature portion represents a portion in which the curvature of the target construction surface is relatively large (specifically, the curvature exceeds a predetermined reference) in the extension direction of the attachment. The curved portion represents, for example, a portion in which the direction of bending of the target construction surface changes in the extension direction of the attachment (i.e. an inflection point on a two-dimensional plane defined by each link of the attachment AT). For example, the master element setting unit 3007 may determine whether the current position of the control reference of the attachment AT has reached the corner or the like of the target construction surface. The master element setting unit 3007 may determine whether the target position of the control reference of the attachment AT corresponds to the corner or the like of the target construction surface (i.e. whether the control reference of the attachment AT reaches the corner or the like of the target construction surface immediately after). The same applies to step S202 in FIG. 7B, which will be described later. If the control reference of the attachment AT reaches the corner or the like, the master element setting unit 3007 proceeds to step S104, and otherwise proceeds to step S110.

In step S104, the master element setting unit 3007 sets the bucket 6 to the master element, and proceeds to step S106. That is, the controller 30 switches the master element from the arm 5 to the bucket 6, when a predetermined condition defined in step S104 is satisfied (hereinafter referred to as a "corner or the like reach condition"). In other words, when the corner or the like reach condition is satisfied, the controller 30 operates the bucket cylinder 9 (an example of the second actuator) corresponding to the bucket 6 in place of the arm cylinder 8 (an example of the first actuator) corresponding to the arm 5 so as to correspond to the operation input or the operation command of the operator.

In step S106, the master element setting unit 3007 determines whether an operation (hereinafter referred to as a "bucket posture adjustment operation") for aligning the posture of the bucket 6 with a portion of the target construction surface ahead of the corner or the like (hereinafter referred to as a "target construction surface portion ahead of corner") is completed. For example, the master element setting unit 3007 may determine, on the basis of the current boom angle, the arm angle, the bucket angle calculated by the posture angle calculation unit 3011, and data on the target construction surface, whether the posture of the bucket 6 and the relative posture between the bucket 6 and the target construction surface portion ahead of the corner are appropriate. Moreover, the master element setting unit 3007 may determine whether the bucket posture adjustment operation is completed by acquiring a notification indicating an end of the bucket posture adjustment operation from the operation command generation unit 3009. The same applies to step S206 of FIG. 7B, which will be described later. If the bucket posture adjustment operation is completed, the master element setting unit 3007 proceeds to step S108, and when the bucket posture adjustment operation is not completed, the master element setting unit 3007 waits until the bucket posture adjustment operation is completed (for example, repeats the process of the present step for each control cycle described above).

In step S108, the master element is set to the arm 5, and the present process ends.

On the other hand, in step S110, the master element setting unit 3007 determines whether the boom 4 and the bucket 6 can operate in synchronization with the operation of the arm 5, when the arm 5 is assumed to be operated as the master element.

For example, the master element setting unit 3007 determines whether when the arm 5 is assumed to operate in response to the operator's operation input or the operation command, the angular velocity (hereinafter referred to as a "required angular velocity"), the angular acceleration (hereinafter referred to as a "required angular acceleration") or the like of the boom 4 and the bucket 6 necessary for the control reference of the attachment AT to move along the target construction surface are greater than predetermined upper limits or have the possibility of exceeding the predetermined upper limits. This is because the boom 4 and the bucket 6 have upper limit values of the angular velocity and the angular acceleration, which can be output, due to the structure of the attachment AT. The upper limit value for the boom 4 may be different depending on various parameters such as the boom angle, the operating direction of the boom 4 (in the direction of raising or lowering), or the output power of the engine 11 (set rotation speed of the engine 11). Similarly, the upper limit for the bucket 6 may vary, for example, depending on various parameters such as the bucket angle, the operating direction of the bucket 6 (in the opening direction or the closing direction), or the output power of the engine 11. Accordingly, the master element setting unit 3007 may calculate the upper limit value by using a predetermined dynamic model or the like for the attachment of the shovel 100 on the basis of the current value of the various parameters described above. Moreover, the master element setting unit 3007 may calculate the upper limit value by using a predetermined map or the like indicating the relationship between the upper limit value and the various parameters described above. Then, the master element setting unit 3007 may determine whether the boom 4 and the bucket 6 can operate in synchronization with the operation of the arm 5 on the basis of a comparison result between the required angular velocity and the required angular acceleration, and the calculated upper limit value for the boom 4 and the bucket 6.

When the boom 4 and the bucket 6 can operate in synchronization with the operation of the arm 5, the master element setting unit 3007 proceeds to step S112, and when the boom 4, the bucket 6, or both cannot operate in synchronization with the operation of the arm 5, the master element setting unit 3007 proceeds to step S114.

In step S112, the master element setting unit 3007 sets the arm 5 to the master element, and terminates the process.

When the arm 5 has already been set to the master element, the master element setting unit 3007 may maintain the setting state, or may set the master element to the arm 5 again.

On the other hand, in step S114, the master element setting unit 3007 determines whether the boom 4 is included in an operation element that cannot be operated in synchronization with the operation of the arm 5. If the boom 4 is included in the operation element which cannot be operated in synchronization with the operation of the arm 5, the master element setting unit 3007 proceeds to step S116, and when the boom 4 is not included (i.e. only the bucket 6 cannot be synchronized), the master element setting unit 3007 proceeds to step S118.

In step S116, the master element setting unit 3007 sets the boom 4 to the master element, and terminates the process.

On the other hand, in step S118, the master element setting unit 3007 sets the bucket 6 to the master element and terminates the process.

That is, the controller 30 switches the master element from the arm 5 to the boom 4 or the bucket 6, when a predetermined condition defined in step S110 (hereinafter referred to as a "synchronization inhibiting condition") is satisfied. In other words, the controller 30 operates the boom cylinder 7 (an example of the second actuator) corresponding to the boom 4 or the bucket cylinder 9 (an example of the second actuator) corresponding to the bucket 6 in place of the arm cylinder 8 (an example of the first actuator) corresponding to the arm 5, so as to correspond to the operation input or the operation command of the operator, when the synchronization inhibiting condition is satisfied.

<<Control Reference Switching Process>>

The flowchart of FIG. 7B may be performed repeatedly for each processing interval corresponding to a cycle of the above-described control process when the machine control function of the shovel 100 is valid. In the following description, a predetermined portion of the bucket 6, which was set manually or the like in advance through the input device 72 or the like (e.g. the claw edge, the back surface, or the like as the work part of the bucket 6) is assumed to be set to the control reference as an initial setting.

In step S202, the control reference setting unit 3008 determines whether the control reference of the attachment AT reaches the corner or the like on the target construction surface, as the control reference of the attachment AT moves along the target construction surface, as in the step S102 in FIG. 7A. When the control reference of the attachment AT reaches the corner or the like of the target construction surface, the control reference setting unit 3008 proceeds to step S204, and otherwise proceeds to step S210.

In step S204, the control reference setting unit 3008 sets the claw edge of the bucket 6 to the control reference, and proceeds to step S206. That is, the controller 30 sets the control reference of the attachment AT (specifically, the bucket 6 as the end attachment) to the claw edge as the work part, when the corner or the like reach condition is satisfied.

When the claw edge of the bucket 6 is already set to the control reference, the control reference setting unit 3008 may maintain the setting state, or may set the control reference to the claw edge of the bucket 6 again. Moreover, before the control reference of the attachment AT reaches the corner or the like on the target construction surface, e.g. when the control reference of the attachment AT reaches a position that can be determined to be around the corner or the like, the control reference setting unit 3008 may set the control reference to the claw edge of the bucket 6.

In step S206, the control reference setting unit 3008 determines whether the bucket posture adjustment operation is completed in the same manner as in step S106 of FIG. 7A. When the bucket posture adjustment operation is completed, the control reference setting unit 3008 proceeds to step S208. When the bucket posture adjustment operation is not completed, the control reference setting unit 3008 waits until the bucket posture adjustment operation is completed.

In step S208, the control reference setting unit 3008 returns the control reference to the state before setting the control reference to the claw edge of the bucket 6 (the state before step S204), and terminates the process.

When the control reference set in the stage before step S204 is the claw edge of the bucket 6, the control reference setting unit 3008 may maintain the setting state, or may set the control reference to the claw edge of the bucket 6 again.

On the other hand, in step S210, the control reference setting unit 3008 determines whether a setting has been performed making the control reference fixed by the operator or the like through the input device 72. The control reference setting unit 3008 proceeds to step S212 when the setting has been performed making the control reference fixed, and the control reference setting unit 3008 proceeds to step S214 when the setting has not been performed making the control reference fixed.

In step S212, the control reference setting unit 3008 maintains the control reference to the content that was manually set (corresponding to the initial setting), and terminates the process.

On the other hand, in step S214, the control reference setting unit 3008 determines whether an amount of remaining sediment to be excavated by the bucket 6 with respect to the target construction surface (hereinafter referred to as a "remaining sediment amount") exceeds a predetermined reference. The control reference setting unit 3008 proceeds to step S216 when the remaining sediment amount exceeds the predetermined reference, that is, when the remaining sediment amount is relatively large. The control reference setting unit 3008 proceeds to step S218 when the remaining sediment amount is less than or equal to the predetermined reference, that is, the remaining sediment amount is relatively small.

In step S216, the control reference setting unit 3008 sets the control reference to the claw edge of the bucket 6 as the work part, and terminates the process.

When the control reference has already been set to the claw edge of the bucket 6, the control reference setting unit 3008 may maintain the setting state, or may set the control reference to the claw edge of the bucket 6 again. That is, when the predetermined condition defined in step S214 (hereinafter referred to as a "remaining sediment amount condition") is satisfied, the control reference setting unit 3008 sets the control reference of the attachment AT (specifically, the bucket 6 as the end attachment) to the claw edge as a work part.

On the other hand, in step S218, the control reference setting unit 3008 sets the back surface of the bucket 6 as the work part to the control reference, and terminates the process.

Moreover, when the control reference has already been set to the back surface of the bucket 6, the control reference setting unit 3008 may maintain the setting state, or may set the control reference to the back surface of the bucket 6 again.

<<Leveling Control Process>>

The flowchart in FIG. 7C may be performed repeatedly for each processing interval corresponding to a cycle of the above-described control process when the machine control function of the shovel 100 is valid.

In step S302, the operation command generation unit 3009 determines whether the control reference of the attachment AT has reached near the corner or the like on the target construction surface, as the control reference of the attachment AT moves along the target construction surface. For example, the operation command generation unit 3009 may determine that the control reference of the attachment AT has reached near the corner or the like on the target construction surface, when a distance between the control reference and the corner or the like in the extension direction of the attachment AT becomes equal to or less than a predetermined threshold. When the control reference of the attachment AT reaches near the corner or the like on the target construction surface, the operation command generation unit 3009 proceeds to step S304, and otherwise terminates the process.

In step S304, the operation command generation unit 3009 reduces the moving speed of the control reference at the attachment AT along the target construction surface, that is, the moving speed of the bucket 6. That is, the controller 30 reduces the moving speed of the bucket 6 as the end attachment, when a predetermined condition defined in step S302 (hereinafter referred to as a "corner or the like periphery reach condition") is satisfied. When the arm 5 is the master element, for example, the operation command generation unit 3009 reduces the movement speed of the bucket 6 along the target construction surface by limiting the arm angular velocity so as to be less than or equal to a predetermined limit value. At this time, the limit value may become smaller as the control reference of the attachment AT approaches the corner or the like, and may become zero when the control reference reaches the corner or the like. In this case, when the arm command value corresponding to the operation input of the operator or the content of the operation command (operation amount) exceeds the limit value, the operation command generation unit 3009 (master command value generation unit 3009A) may correct (limit) the arm command value so as to be less than or equal to the limit value. The operation command generation unit 3009 outputs the limited (corrected) arm command value 2*r* to the arm pilot command generation unit 3010B, and control the pressure reducing proportional valves 33AL and 33AR or the selector valve so that the pilot pressure corresponding to the operation in the longitudinal direction in the left operation lever 26L does not act on the pilot port of the control valve 176. Thus, the controller 30 can limit the arm angular velocity so as to be less than or equal to the limit value, reduce the moving speed of the control reference at the attachment AT along the target construction surface, and make the moving speed zero when the control reference reaches the corner or the like.

The slave command value generation unit 3009B naturally generates the boom command value $\beta_{1r}$ and the bucket command value $\beta_{3r}$ so that the control reference of the attachment AT moves along the target construction surface in response to the arm command value $\beta_{2r}$ limited to be less than or equal to the limit value. In the following, the same applies to the case of step S310.

In step S306, the operation command generation unit 3009 determines whether the control reference of the attachment AT has reached the corner or the like on the target construction surface as the control reference of the attachment AT moves along the target construction surface. When the control reference of the attachment AT reaches the target construction surface, the operation command generation unit 3009 proceeds to step S308. When the control reference does not reach the target construction surface, the operation command generation unit 3009 waits until the control reference reaches the target construction surface.

In step S308, the operation command generation unit 3009 causes the attachment AT to perform the operation of aligning the posture of the bucket 6 with the target construction surface portion ahead of corner according to the setting content by the master element setting unit 3007 and the control reference setting unit 3008, i.e. the bucket posture adjustment operation. That is, the controller 30 causes the attachment AT to perform the bucket posture adjustment operation, when a predetermined condition defined in step S306, i.e. the corner or the like reach condition is satisfied. When the control reference of the attachment AT reaches the corner or the like on the target construction surface, as described above, the master element is set to the bucket 6 (step S104 in FIG. 7A), and the control reference is set to the claw edge of the bucket 6 (step S204 in FIG. 7B). Therefore, the operation command generation unit 3009 operates the boom 4 and the arm 5 in accordance with the operation of the bucket 6 so that the bucket 6 is rotated, with the claw edge of the bucket 6 arranged along the corner or the like as a reference. Thus, the controller 30 can turn the posture of the bucket 6 until the posture of the bucket 6 becomes along the target construction surface portion ahead of corner, in a state where the claw edge of the bucket 6 is aligned with the corner or the like (for example, an apex or an inflection point of the corner). Specifically, the master command value generation unit 3009A generates the bucket command value $\beta_{3r}$ so that the rotational speed of the bucket 6 becomes an angular velocity corresponding to the operation input of the operator or the operation command content (operation amount). Then, when the bucket 6 rotates at then angular velocity corresponding to the bucket command value $\beta_{3r}$, the slave command value generation unit 3009B generates the boom command value $\beta_{1r}$ and the arm command value ß2*r* corresponding to the angular velocities of the boom 4 and the arm 5 necessary for maintaining the claw edge of the bucket 6 at the corner or the like on the target construction surface.

The turning direction of the bucket 6 may be determined such that the posture of the bucket 6 with respect to the target construction surface portion ahead of corner is in a state suitable for moving the control reference of the attachment AT along the target construction surface, when the control reference is returned to the original state (step S208 of FIG. 7B).

When the bucket posture adjustment operation is completed, in step S310, the operation command generation unit 3009 gradually returns the moving speed of the control reference at the attachment AT along the target construction surface, that is, the moving speed of the bucket 6 to the speed corresponding to the operation input of the operator or the content (operation amount) of the operation command. When the bucket posture adjustment operation is completed, the master element is set to the arm 5 as described above (step S108 in FIG. 7A), and the control reference is returned to the state before the control reference is set to the claw edge of the bucket 6 (step S208 in FIG. 7B). Therefore, the operation command generation unit 3009 gradually relaxes the limit value while limiting, for example, the arm angular velocity, i.e. the arm command value $\beta_{2r}$ so as to be less than or equal to a predetermined limit value. Thus, the controller 30 can gradually increase the moving speed of the control reference at the attachment AT so as to return to the level corresponding to the operation of the operator or the content (operation amount) of the operation command. Specifically, when the arm command value corresponding to the operation of the operator or the content of the operation command exceeds the limit value, the operation command generation unit 3009 (master command value generation unit 3009A) may correct (limit) the arm command value so as to be less than or equal to the limit value. Then, the operation command generation unit 3009 outputs the limited (corrected) arm command value Bar to the arm pilot command generation unit 3010B, and control the pressure reducing proportional valves 33AL and 33AR or the selector valve so that the pilot pressure corresponding to the operation in the longitudinal direction in the left operation lever 26L does not act on the pilot port of the control valve 176. Thus, the controller 30 can limit the arm angular velocity so as to be less than or equal to the limit value, and gradually increase the moving speed of the control reference at the attachment AT along the target construction surface. Ultimately, the controller 30 can return the moving speed of the control reference to the moving speed corresponding to the operation input of the operator or the content (operation amount) of the operation command.

<Action Related to Machine Control Function of Shovel>

Figure 8A:
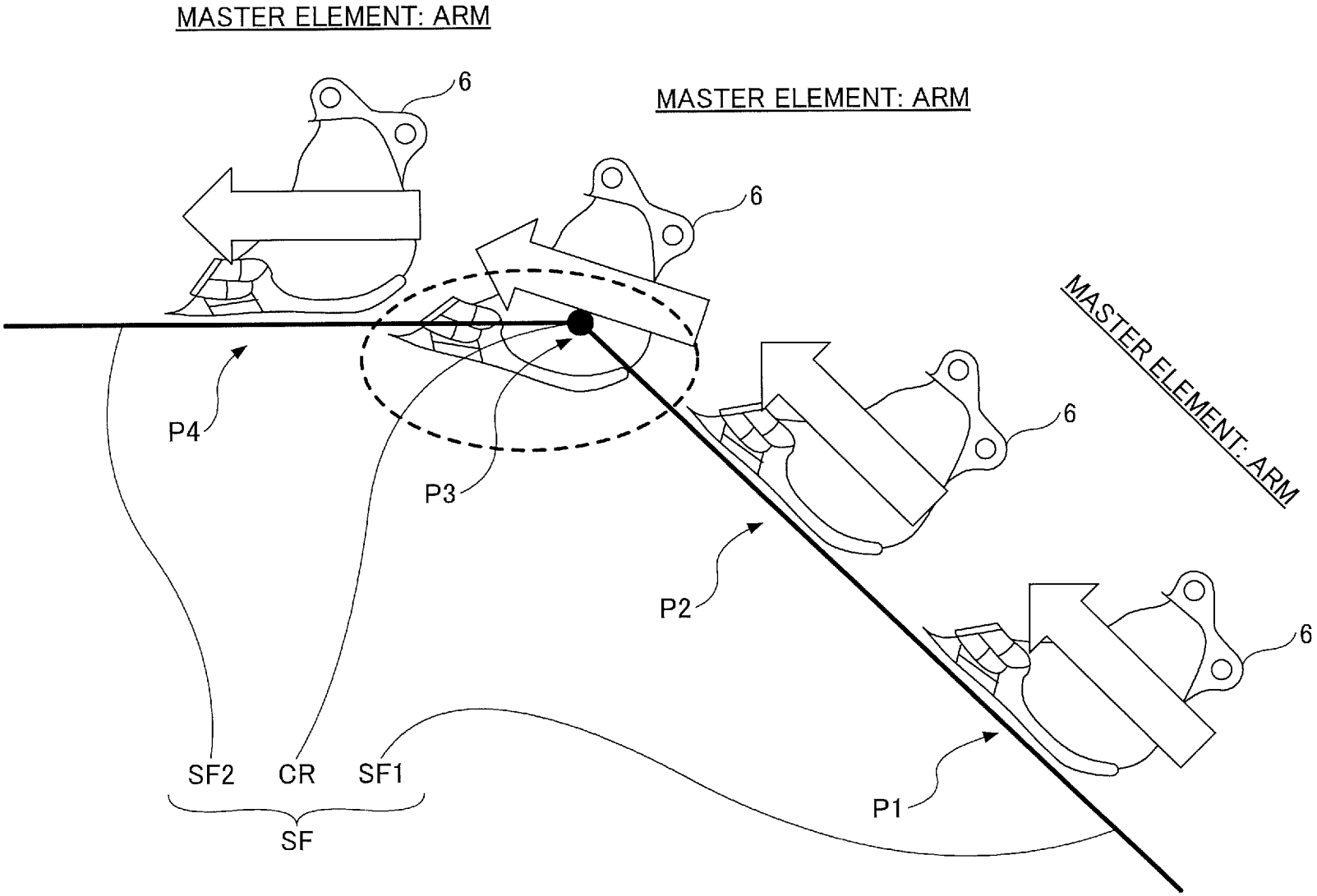
FIG. 8A is a diagram illustrating an example of an operation of an attachment by a machine control function of a shovel according to a comparative example.
Figure 8B:
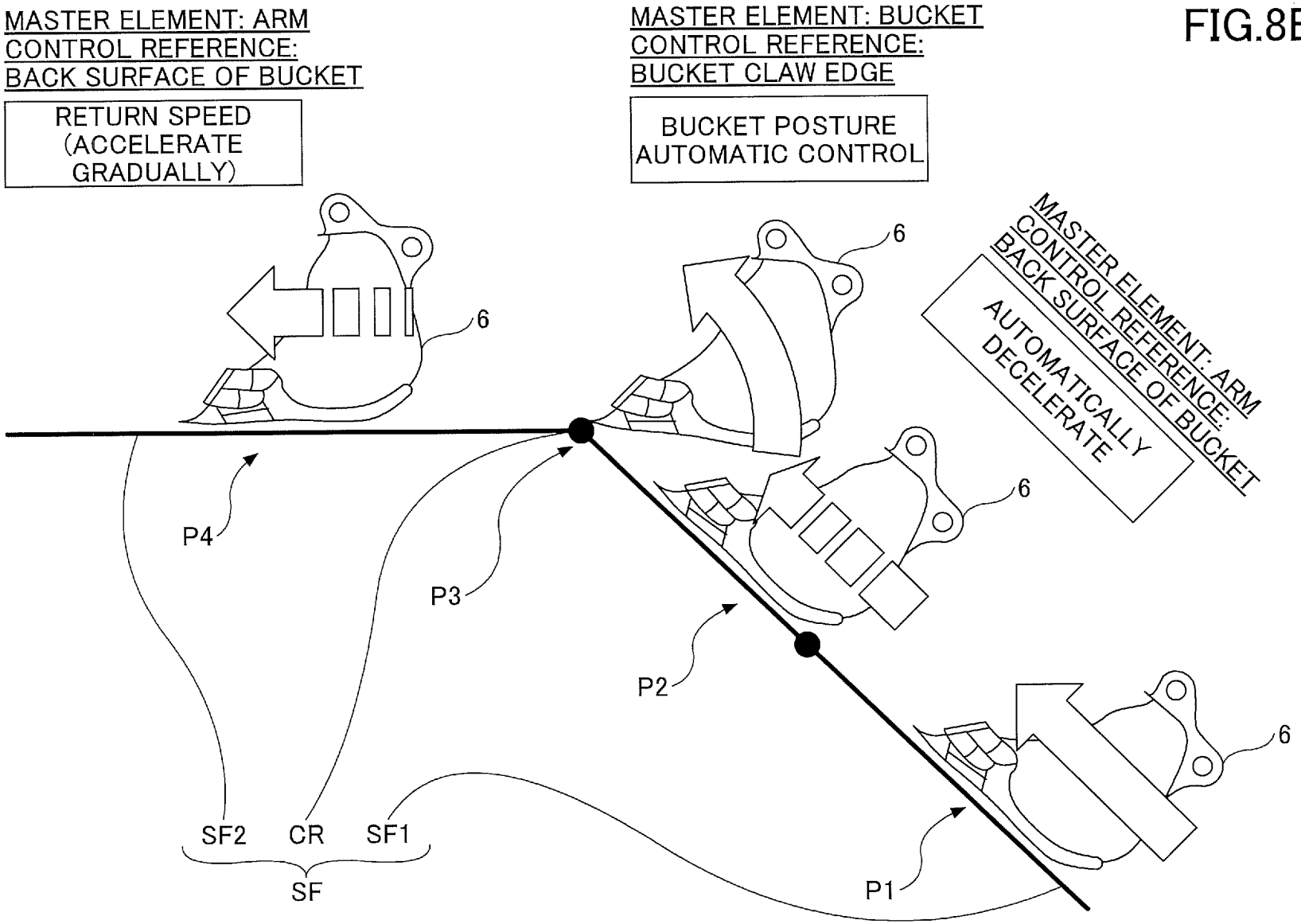
FIG. 8B is a diagram illustrating an example of an operation of the attachment by the machine control function of the shovel according to the embodiment.

Next, referring to FIG. 8A and FIG. 8B, comparing with a shovel according to a comparative example, an action related to the machine control function of the shovel 100 according to the present embodiment, specifically an action related to the machine control function illustrated in FIGS. 6A to 6C and FIGS. 7A to 7C will be described.

In the shovel according to the comparative example, at least the master element setting unit 3007 and the control reference setting unit 3008 of the shovel 100 according to the present embodiment are omitted.

<<Operation of Attachment for Corner on Target Construction Surface>>

FIGS. 8A and 8B are diagrams for explaining an action related to an example of the machine control function of the shovel 100 according to the present embodiment. Specifically, FIG. 8A shows the operation of the attachment AT by the machine control function of the shovel 100 according to the comparative example. FIG. 8B is a diagram showing the operation of the attachment AT according to an example of the machine control function of the shovel 100 according to the present embodiment. In each of FIGS. 8A and 8B, for convenience, only the tip of the attachment AT, i.e. the bucket 6, is shown, and the control reference of the attachment AT moving along the target construction surface SF from the position P1 to the position P4 is also shown.

In FIG. 8A, in the shovel according to the comparative example, the control reference of the attachment AT is set to the back surface as the work part of the bucket 6.

For example, as shown in FIGS. 8A and 8B, when the target construction surface SF includes a front-down slope portion SF1 and a horizontal portion SF2, a corner portion CR is formed between the front-down slope portion SF1 and the horizontal portion SF2. In this premise, excavation work and leveling work are assumed to be performed continuously from the slope portion SF1 to the horizontal portion SF2.

As shown in FIG. 8A, in the shovel according to the comparative example, the master element is fixed to the arm 5. Therefore, operations of the boom 4 and the bucket 6 are controlled so that the predetermined control reference of the attachment AT (in the example, the back surface of the bucket 6) moves along the target construction surface SF in accordance with the operation input of the operator or the content of the operation command.

In this case, the bucket 6 moving along the slope portion SF1 approaches the corner CR of the target construction surface SF (positions P1 and P2 in the figure) at the moving speed corresponding to the arm angular velocity corresponding to the operation input or the content of the operation command (operation amount). Even when the control reference reaches a position P3 corresponding to the corner CR of the target construction surface SF, the control reference of the attachment AT (that is, the back surface of the bucket 6) attempts to move along the target construction surface SF at the moving speed corresponding to the operation input of the operator or the operation amount of the operation command. Therefore, in the shovel according to the comparative example, the posture of the bucket 6 (specifically, the angle of the back surface of the bucket 6) may not be properly aligned with the horizontal portion SF2, even if the posture of the bucket 6 is to be aligned with the horizontal portion SF2 in accordance with a relatively large change in the inclination angle from the slope portion SF1 to the horizontal portion SF2. For example, when the posture of the bucket 6 is going to be aligned with the target construction surface portion ahead of corner (horizontal portion SF2) in early timing, in order to enhance the followability to the target construction surface, as shown in FIG. 8A, the control reference of the attachment AT may exceed the target construction surface, destroying the corner. Moreover, when the timing is delayed as much as possible so as not to destroy the corner, to align the posture of the bucket 6 with the target construction surface portion ahead of corner (horizontal portion SF2), sediment may be left in the corner CR, and the corner CR may not be properly formed. Moreover, typically, in the machine control function, the control reference such as the back surface of the bucket 6 is controlled to be along the target construction surface by operating the boom 4 in accordance with the operation of the arm 5. Then, due to the structural reason for supporting the weight of the arm 5 and the bucket 6, and due to the relatively large weight of the boom 4, the operation reaction (responsiveness) of the boom 4 is not high. With the shovel of the comparative example, a portion such as the corner CR having a relatively large inclination change cannot be properly constructed.

On the other hand, in the present embodiment, the controller 30 switches the master element taking account of the relative positional relationship between the control reference and the target construction surface, accompanying the movement of the control reference of the attachment AT along the target construction surface. Specifically, when the control reference of the attachment AT is positioned in the vicinity of the corner or the like of the target construction surface, that is, a predetermined condition (specifically, the corner or the like reach condition) is satisfied, the controller 30 sets the master element to the bucket 6. That is, when the predetermined condition is satisfied, upon being operated in the same operation unit (in this example, the operation unit in the longitudinal direction in the left operation lever 26L, or the corresponding operation unit of the remote control operation device provided in the external device), the actuator to be the master element is changed. In other words, the predetermined condition for switching the master element may be set based on the positional relationship between the target trajectory (or target construction surface) of the end attachment and the control reference (e.g. the work part of the end attachment). More specifically, the predetermined condition corresponds to, for example, that "the control reference of the end attachment (e.g. the work part of the end attachment) approaches within a predetermined distance from an inflection point of the target trajectory". Thus, the controller 30 can operate the bucket cylinder 9 (an example of the second actuator) for driving the bucket 6 instead of the arm cylinder 8 (an example of the first actuator) for driving the arm 5 so as to correspond to the operator's operation input or the operation command. The controller 30 can control the operation of the boom 4 and the arm 5, that is, the boom cylinder 7 for driving the boom 4 and the arm cylinder 8 for driving the arm 5 in accordance with the operation of the bucket 6. More specifically, as shown in FIG. 8B, the boom 4 and the arm 5 are controlled, so that the bucket 6 is rotated with the claw edge of the bucket 6 as a reference while maintaining a state in which the claw edge of the bucket 6 is on the corner CR, with the claw edge of the bucket 6 as a control reference, and thereby the posture of the bucket 6 is automatically controlled. Thus, the shovel 100 can align the posture of the bucket 6 with the construction surface portion ahead of corner (horizontal portion SF2) without destroying the corner CR. Moreover, when the bucket posture adjustment operation is completed, the controller 30 sets the master element to the arm 5. As a result, the shovel 10 can start excavation or the like for the next target construction surface CN from the state where the claw edge of the bucket 6 is aligned with the corner CR, corresponding to the operation or the operation command related to the arm 5, and the shovel 100 can appropriately form the corner CR. Accordingly, the shovel 100 according to the present embodiment can more appropriately move the tip of the attachment AT along the target trajectory (the corner CR of the target construction surface) in response to the operation by the operator or the operation command related to the autonomous driving function.

Moreover, in the present embodiment, the controller 30 switches the control reference of the attachment AT to the claw edge of the bucket 6 as the work part, when the tip of the attachment AT (that is, the control reference set to the end attachment) is located in the vicinity of the corner or the like (corner CR). That is, the controller 30 switches the control reference of the attachment AT to the claw edge of the bucket 6 when a predetermined condition (specifically, the corner or the like reach condition) is satisfied. Thus, even when the leveling control, in which the back surface of the bucket 6 as the work part is set to the control reference and the back surface of the bucket 6 is moved along the target construction surface SF (slope portion SF1), as shown in FIG. 8B, is performed, at the corner CR, the controller 30 sets the claw edge of the bucket 6 to the control reference, and can appropriately control the posture of the bucket 6.

In the present embodiment, the controller 30 reduces (limits) the speed of moving along the target construction surface (slope portion SF1) of the control reference of the attachment AT, that is, the end attachment (for example, the bucket 6) when the tip portion (control reference) of the attachment AT reaches near the corner or the like (the corner CR). That is, the controller 30 reduces the moving speed of the end attachment (bucket 6) when a predetermined condition (specifically, the corner or the like periphery reach condition) is satisfied. Thus, the shovel 100 can align more appropriately the claw edge of the bucket 6 with the corner CR, and thereby the corner CR can be formed more appropriately.

In the present embodiment, when the bucket posture adjustment operation is completed, the controller 30 sets the master element to the arm 5, while limiting the speed of moving along the target construction surface (horizontal portion SF2) of the control reference of the attachment AT. Then, the controller 30 gradually increases the moving speed while relaxing the limitation, and ultimately restores the moving speed corresponding to the operation input of the operator or the content (operation amount) of the operation command. Thus, the corner CR can be prevented from collapsing due to a rapid increase in the moving speed of the tip portion (control reference) of the attachment AT.

<<Operation when Attachment Cannot be Synchronized>>

For example, depending on an operation mode (e.g. an operation speed) or contents of an operation command relating to the arm 5, the operation of the boom 4 and the bucket 6 necessary for moving the claw edge or the like of the bucket 6 along the target construction surface, in accordance with the operation of the arm 5, may exceed a limit related to the operation of the boom 4 and the bucket 6 (for example, upper limit values of angular velocity or angular acceleration).

In such a situation, in the case of the shovel according to the comparative example, the boom 4 may not synchronize the operation of the boom 4 with the operation of the arm 5, and as a result, the trajectory of the claw edge or the like of the bucket 6 may exceed the target construction surface.

On the other hand, in the present embodiment, the controller 30 switches the master element to the boom 4, when the operation of the boom 4 cannot be synchronized or will be unable to be synchronized with the operation of the arm 5 operating according to operation content by the operator, that is, a predetermined condition (specifically, a synchronization inhibiting condition) is satisfied. The same applies to the case of the bucket 6. In other words, when the operation of the boom cylinder 7 cannot be synchronized or will be unable to be synchronized with the operation of the arm cylinder 8 (an example of the first actuator), that is, the synchronization inhibiting condition is satisfied, the controller 30 operates the boom cylinder 7 (an example of the second actuator) so as to accommodate the operation input of the operator or the operation command. The controller 30 controls the operation of the arm cylinder 8 and the bucket cylinder 9 in accordance with the operation of the boom cylinder 7. The same applies to the case of the bucket cylinder 9 for driving the bucket 6. Thus, when an operation element (the boom 4 or the bucket 6) that cannot be synchronized with the operation of the arm 5 is present, the controller 30 can change the control mode so as to operate, in accordance with the operation of the operation element, another operation element (slave element). Therefore, the attachment AT operates in synchronization as a whole and can move the control reference of the tip along the target construction surface. Accordingly, the shovel 100 according to the present embodiment can move the tip of the attachment AT (for example, the claw edge, the back surface or the like as the work part of the bucket 6 set as the control reference) along the target construction surface in response to the operation command related to the operation by the operator or the operation command related to the autonomous driving function.

For example, when the inclination of the target construction surface becomes relatively large, it is necessary to increase the amount of movement of the bucket 6 in the vertical direction in order to move the claw edge or the like of the bucket 6 along the target construction surface. That is, the operation of the boom 4 for moving the bucket 6 in the vertical direction requires higher responsiveness than that of the operation of the arm 5 for moving the bucket 6 in the horizontal direction. Therefore, in the situation where the inclination of the target construction surface is relatively large, the operation of the boom 4 necessary for moving the claw edge or the like of the bucket 6 along the target construction surface in accordance with the operation of the arm 5 corresponding to the operation input or the operation amount of the operation command related to the arm 5, tends to exceed the limit on the operation of the boom 4. As a result, the operation of the attachment AT may be interrupted, and the controller 30 may not be able to smoothly move the bucket 6 along the target construction surface.

On the other hand, in the present embodiment, the controller 30 sets the master element to the boom 4, when the operation of the boom 4 cannot be synchronized or will be unable to be synchronized with the operation of the arm 5, operating according to the operation input of the operator or the content of the operation command related to the autonomous driving function, as described above. Thus, the controller 30 can change the control mode so as to operate the arm 5 in accordance with the operation of the boom 4, as described above. Therefore, the attachment AT operates in synchronization as a whole, and can move the control reference (work part) of the tip portion along the target construction surface. Accordingly, even if the inclination of the target construction surface is relatively large, the shovel 100 according to the present embodiment can more appropriately move the tip of the attachment AT (work part) along the target construction surface according to an operation by an operator or an operation command relating to the autonomous driving function.

In the present embodiment, in the case where the inclination of the target construction surface is relatively large, the controller 30 sets the master element to the boom 4, when the operation of the boom 4 cannot be synchronized with the operation of the arm 5, as a trigger. However, the controller 30 may set the master element to the boom 4, when the inclination of the target construction surface is relatively large, as a direct trigger. That is, the controller 30 may set the master element to the boom 4, when the control reference at the attachment AT is moving along a steep slope having a relatively large inclination angle (for example, the inclination angle is greater than a predetermined reference) on the target construction surface (or a predetermined condition determining that the control reference moves along the steep slope is satisfied).

[Other Examples of Machine Control Function of Shovel]

Next, other examples of the machine control function of the shovel 100 according to the present embodiment will be described in detail with reference to FIGS. 9 to 12.

<Overview of Machine Control Function of Shovel>

First, referring to FIG. 9, an overview of the machine control function of the shovel 100 according to the present embodiment will be described.

Figure 9:
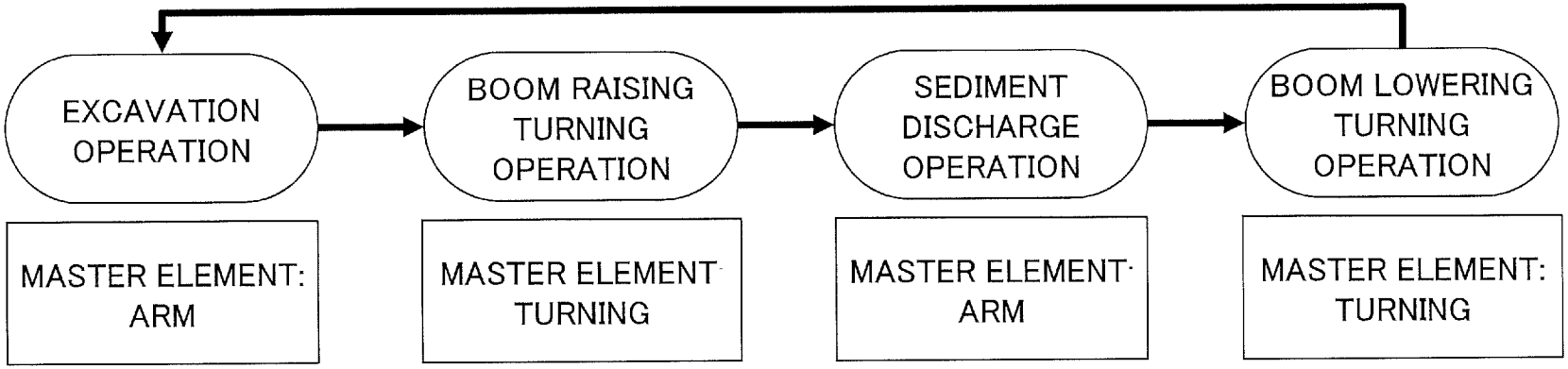
FIG. 9 is a diagram describing a series of procedures which is a subject of other examples of the machine control function of the shovel.

FIG. 9 is a diagram explaining an overview of another example of the machine control function of the shovel 100 according to the present embodiment. Specifically, FIG. 9 illustrates a series of operation processes (work processes) or an excavation work to be performed by another example of the machine control function of the shovel 100 according to the present embodiment.

In the present example, the shovel 100 repeats a series of operation steps for storing sediment in the bucket 6 in the excavation operation, performing the boom raising turning operation, discharging sediment in the bucket 6 onto a loading platform of a dump truck in the sediment discharge operation, performing the boom lowering turning operation, and returning to the excavation operation again. The controller 30 implements the machine control function with the series of work processes as an object, while switching the master element in the machine control function, i.e. the operation element operating in accordance with the operation input by the operator or the like.

Specifically, the controller 30 sets the arm 5 to the master element in the excavation operation. The controller 30 controls the operations of the boom 4 and the bucket 6 so that the control reference (work part) of the attachment AT moves along the target construction surface in accordance with the operation of the arm 5 corresponding to the operation input by the operator related to the arm 5 or the operation command related to the autonomous driving function. Thus, the controller 30 can implement the machine control function related to the excavation operation.

When the boom raising turning start condition is satisfied, the controller 30 switches the master element from the arm 5 to the upper pivot body 3 (pivot mechanism 2) (changes setting). The controller 30 controls the operation of the boom 4 or the like so that the control reference (for example, the back surface of the bucket 6) of the attachment AT moves along a predetermined target trajectory in accordance with the turning operation of the upper pivot body 3 corresponding to the operation input by the operator or the operation command related to the autonomous driving function related to the upper pivot body 3. At this time, the target trajectory is predetermined so that the bucket 6 is directed to a predetermined position in a space above a loading platform without colliding with a dump door or the like of the loading platform of a dump truck which is parked at a predetermined position. Thus, the controller 30 can realize the machine control function related to the boom raising turning operation in response to switching of the operation process from the excavation operation to the boom raising turning operation.

When the sediment discharge start condition is satisfied, the controller 30 switches the master element from the upper pivot body 3 to the bucket 6 (changes setting). Then, the controller 30 controls the operation of the arm 5 or the like so that the control reference of the attachment AT (for example, the claw edge of the bucket 6) moves along a predetermined target trajectory in accordance with an opening operation of the bucket 6 corresponding to the operation input by the operator or the operation command related to the autonomous driving function related to the bucket 6 (the opening operation of the bucket 6). Moreover, the controller 30 may control the bucket 6 or the like in accordance with an opening operation of the arm 5 corresponding to the operation input by the operator or the operation command related to the autonomous driving function related to the arm 5 (the opening operation of the arm 5). At this time, the target trajectory is predetermined so that sediment is discharged onto a predetermined target position on the loading platform of the dump truck. The target position on the loading platform of the dump truck may be changed in accordance with a predetermined condition in the series of work steps. Thus, the controller 30 can realize the machine control function related to the sediment discharge operation according to the switching of the operation process from the boom raising turning operation to the sediment discharge operation.

When the boom lowering turning start condition is satisfied, the controller 30 switches the master element from the bucket 6 or the arm 5 to the upper pivot body 3 (changes setting). The controller 30 controls the operation of the boom 4 or the like so that the control reference of the attachment AT moves along a predetermined target trajectory in accordance with the turning operation of the upper pivot body 3 corresponding to the operation input by the operator or the operation command related to the autonomous driving function related to the upper pivot body 3. At this time, the target trajectory is predetermined so that the bucket 6 returns to the original work position where the excavation operation was performed from the space above the loading platform of the dump truck without colliding with the dump door or the like of the loading platform. Thus, the controller 30 can realize the machine control function related to the boom lowering turning operation in response to switching of the operation process from the sediment discharge operation to the boom lowering turning operation.

Moreover, when the boom lowering turning operation is completed and a predetermined condition in which the excavation operation can be determined to be started again (hereinafter referred to as an "excavation start condition") is satisfied, the controller 30 switches the master element from the upper pivot body 3 to the arm 5 (changes setting). Thus, the controller 30 can return the shovel 100 to the excavation operation based on the machine control function again, after the loading process of loading sediment to the dump truck is completed.

<Configuration Related to Machine Control Function of Shovel>

Next, referring to FIGS. 10A to 10D, a detailed configuration relating to another example of the machine control function of the shovel 100 according to the present embodiment will be described. In the following, to a configuration similar or corresponding to the example of the machine control function (see FIGS. 6A and 6B) described above, the same reference numeral will be assigned and different part will be mainly described.

Figure 10A:
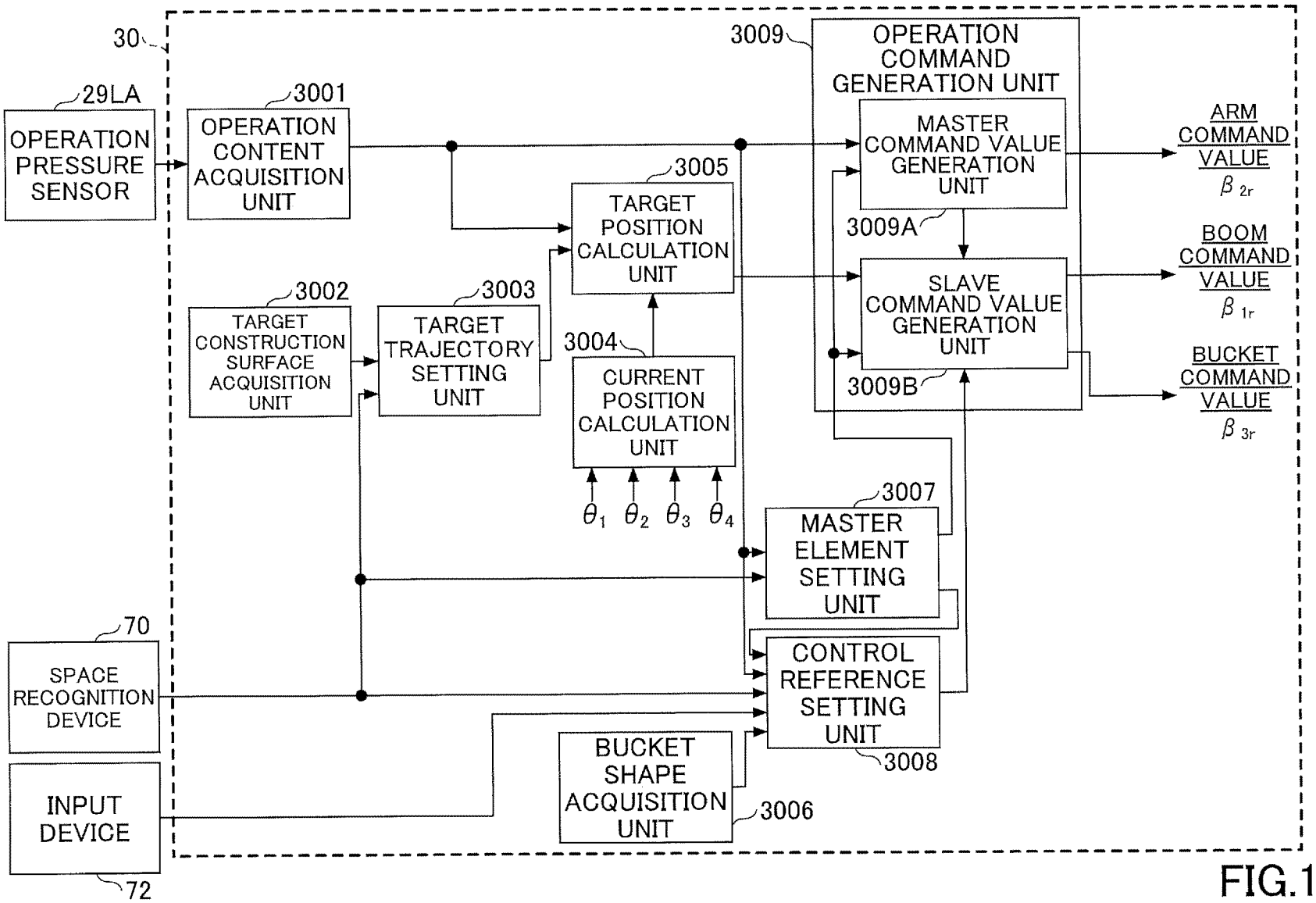
FIG. 10A is a functional block diagram illustrating another example of the detailed arrangement related to the machine control function of the shovel.
Figure 10B:
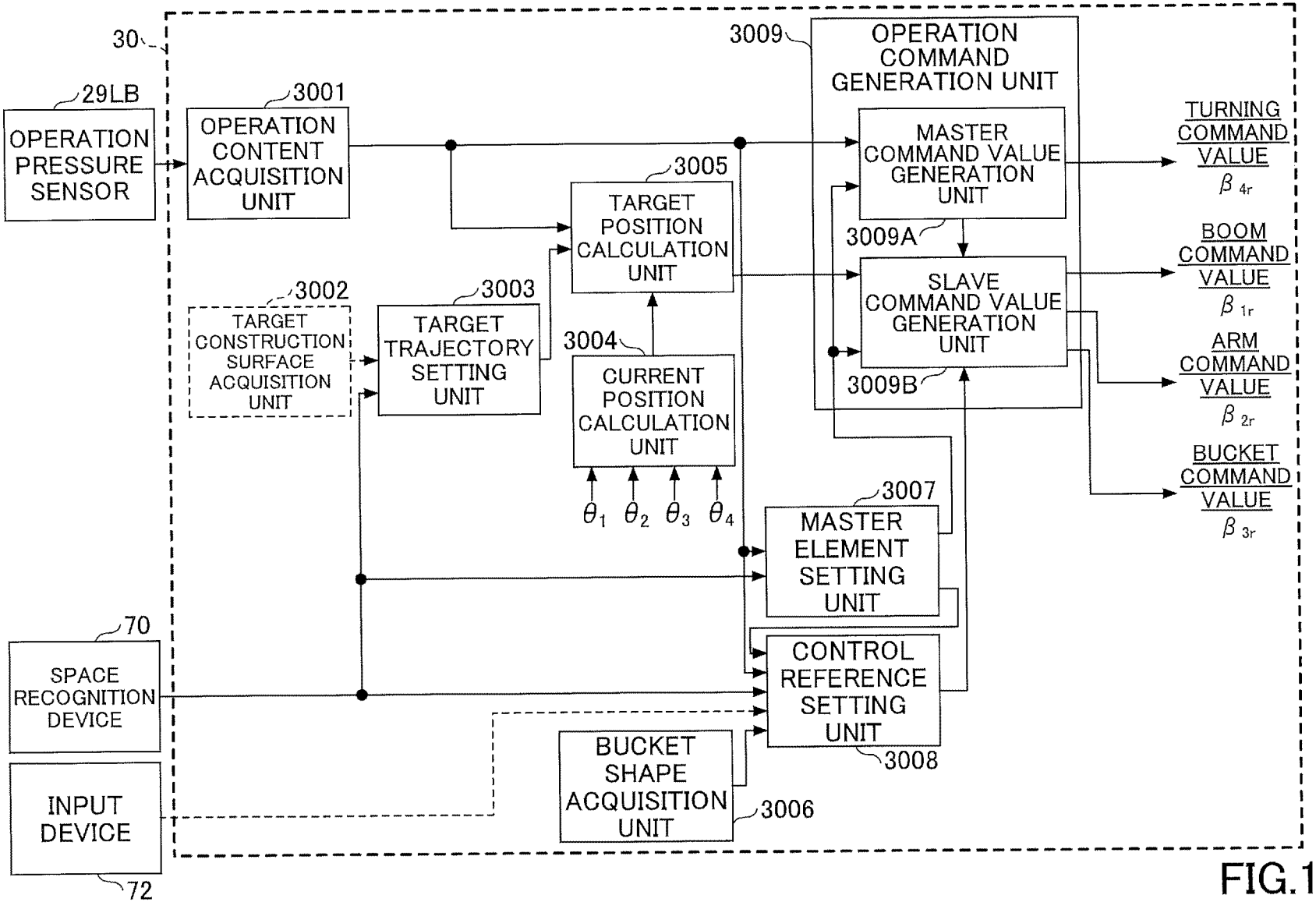
FIG. 10B is a functional block diagram illustrating another example of the detailed arrangement related to the machine control function of the shovel.
Figure 10C:
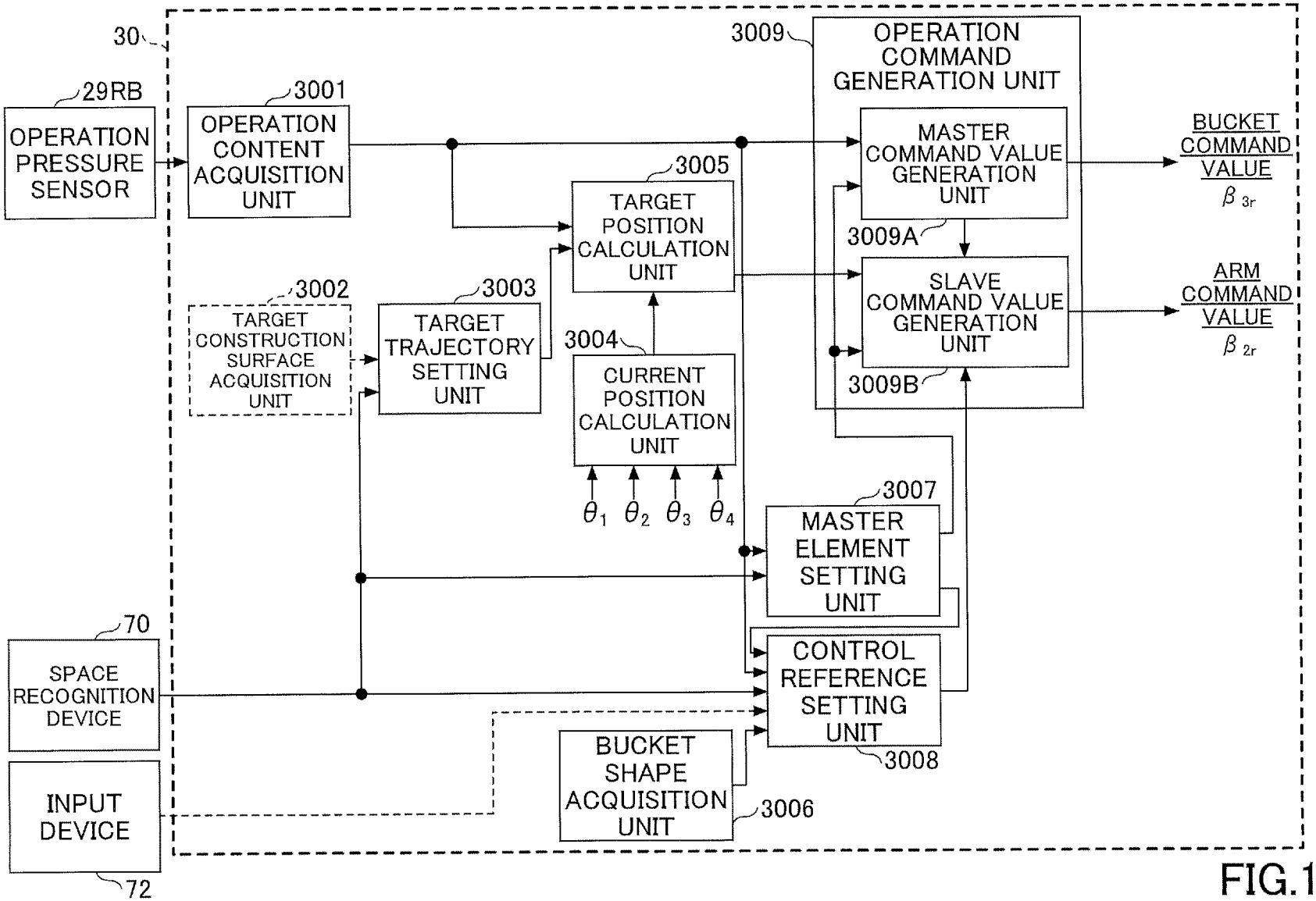
FIG. 10C is a functional block diagram illustrating another example of the detailed arrangement related to the machine control function of the shovel.
Figure 10D:
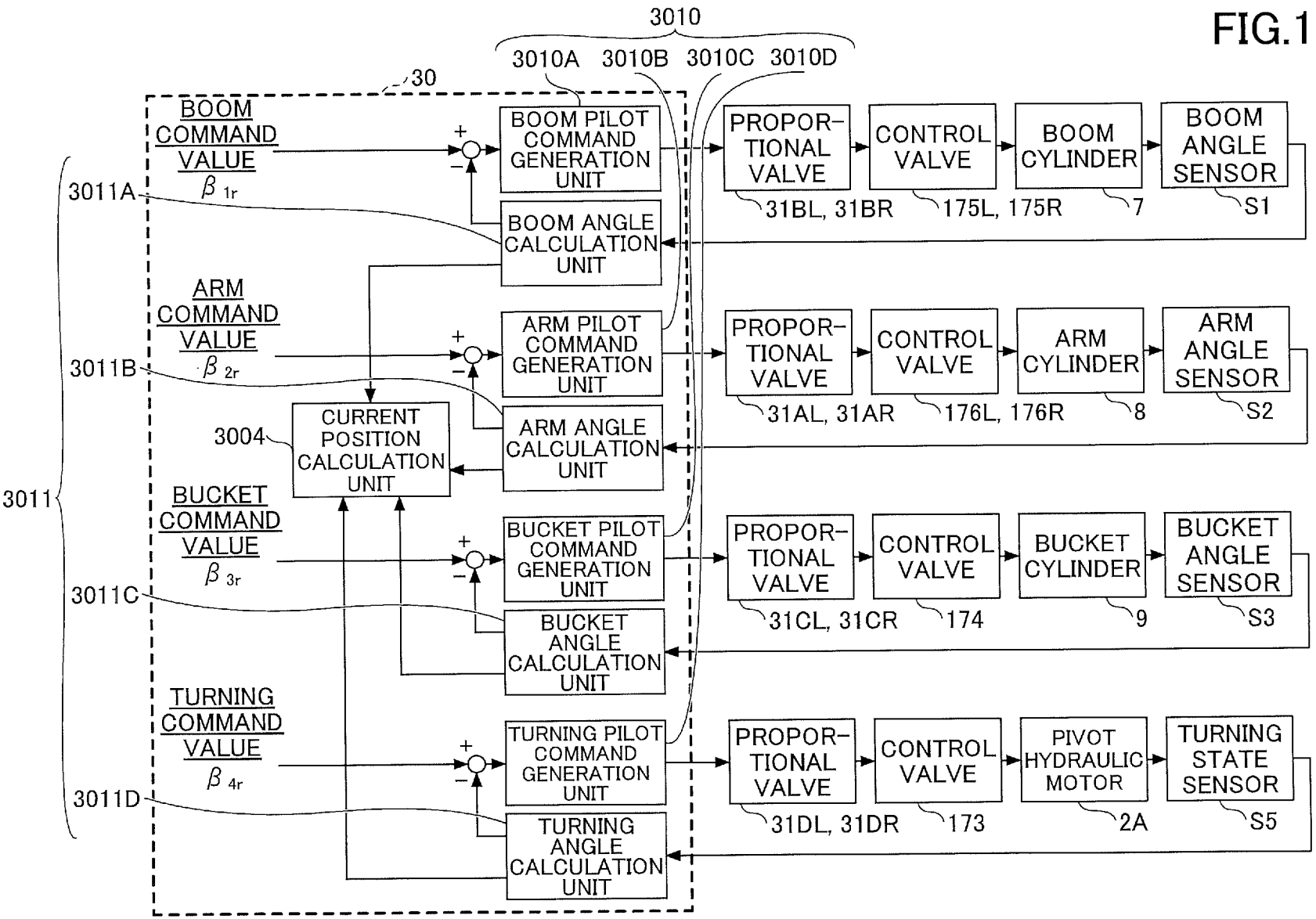
FIG. 10D is a functional block diagram illustrating another example of the detailed arrangement related to the machine control function of the shovel.

FIGS. 10A to 10D are functional block diagrams showing the other examples of detailed configurations relating to the machine control function of the shovel 100 according to the present embodiment. Specifically, FIG. 10A is a functional block diagram showing a part of the configuration corresponding to the machine control function related to the excavation operation of the shovel 100. FIG. 10B is a functional block diagram showing a part of the configuration corresponding to the machine control function relating to the boom raising turning operation and a boom lowering turning operation of the shovel 100. FIG. 10C is a functional block diagram showing a part of the configuration corresponding to the machine control function relating to the sediment discharge operation of the shovel 100. FIG. 10D is a functional block diagram showing the other parts of the configuration of the machine control function, common to the series of operation steps of the shovel 100.

In FIGS. 10A to 10C, types of the master command value and the slave command value mainly generated and output by the operation command generation unit 3009 are different, and the other parts are common. Moreover, in FIGS. 10B and 10C, for the controller 30, a function block or an input element which is not related to the operation process of the corresponding shovel 100 is shown by a dotted line in FIG. 10B and FIG. 10C.

The controller 30, similarly to the above-described example (FIGS. 6A and 6B), includes, as function units related to the machine control function, an operation content acquisition unit 3001, a target construction surface acquisition unit 3002, a target trajectory setting unit 3003, a current position calculation unit 3004, a target position calculation unit 3005, a bucket shape acquisition unit 3006, a master element setting unit 3007, a control reference setting unit 3008, an operation command generation unit 3009, a pilot command generation unit 3010, and a posture angle calculation unit 3011. For example, when the switch NS is pressed, the functions 3001 to 3011 repeatedly execute operations described below for each predetermined control period.

The operation content acquisition unit 3001 acquires operation contents of the operation device 26 (the left operation lever 26L and the right operation lever 26R) on the basis of a detection signal fetched from the operation pressure sensors 29LA, 29LB, and 29RB. For example, the operation content acquisition unit 3001 acquires (calculates), as the operation content, an operation amount, and an operation direction of the left operation lever 26L or the right operation lever 26R (in the front direction or in the rear direction; or in the right direction or the left direction). When the shovel 100 is remotely operated, the semi-automatic driving function of the shovel 100 may be realized on the basis of a content of a remote operation signal received from the external device. In this case, similarly to the above-described example (FIG. 6A), the operation content acquisition unit 3001 acquires operation content related to the remote operation on the basis of the remote operation signal received from the external device.

The target trajectory setting unit 3003 sets information on the target trajectory of the control reference at the attachment AT. For example, the target trajectory setting unit 3003 sets a target trajectory for moving along the target construction surface (for example, an inclination angle in the longitudinal direction of the target construction surface based on the machine body of the shovel 100, as described above) for the excavation operation by the shovel 100. Moreover, the target trajectory setting unit 3003 sets a target trajectory such that the bucket 6 is moved toward a space above a loading platform of a dump truck parked at a predetermined position, for the boom raising turning operation performed by the shovel 100. At this time, the target trajectory setting unit 3003 may read, for example, data relating to a predetermined target trajectory from the internal memory or the like, assuming a condition relating to the position of the dump truck and the loading platform of the dump truck (for example, the height of the dump door). Moreover, the target trajectory setting unit 3003 may, for example, obtain the position of the dump truck and the condition related to the loading platform on the basis of the recognition result for objects around the shovel 100 by the space recognition device 70, and derive the target trajectory in accordance with the situation. In the following, the same applies to the setting of a target trajectory corresponding to the boom lowering turning operation of the shovel 100. Furthermore, the target trajectory setting unit 3003 sets a target trajectory such that sediment is loaded in a predetermined target position of the loading platform of the dump truck for the sediment discharge operation of the shovel 100. At this time, the target trajectory setting unit 3003 may read data relating to a predetermined target trajectory from the internal memory, for example, assuming a condition related to the loading platform of the dump truck (e.g. length, width, depth of the loading platform or the like). Moreover, the target trajectory setting unit 3003 may, for example, obtain a condition related to the loading platform of the dump truck on the basis of the obtained result of objects around the shovel 100 by the space recognition device 70, and set the target trajectory in accordance with the situation. The target trajectory setting unit 3003 sets a target trajectory such that the bucket 6 returns from the space above the loading platform of the dump truck to the position corresponding to the original excavation operation, for the boom lowering turning operation performed by the shovel 100. At this time, the target trajectory setting unit 3003 may read data related to a predetermined target trajectory from the internal memory or the like, assuming a condition relating to the position of the dump truck and the loading platform of the dump truck. The target trajectory setting unit 3003 may, for example, obtain the position of the dump truck and the condition related to the loading platform on the basis of the recognition result of objects around the shovel 100 by the space recognition device 70, and derive the target trajectory in accordance with the situation.

The current position calculation unit 3004 calculates a position (a current position) of the control reference (the claw edge of the bucket 6 or the like) at the attachment AT. Specifically, the current position calculation unit 3004 may calculate the (current) position of the control reference of the attachment AT on the basis of the boom angle $\theta_1$, the arm angle $\theta_2$, the bucket angle $\theta_3$, and the turning angle $\theta_4$ calculated by the posture angle calculation unit 3011, which will be described later.

The target position calculation unit 3005 calculates the target position of the tip (control reference) of the attachment AT on the basis of the operation content (an operation direction and an operation amount) in the operation device 26, the information on the set target trajectory, and the current position of the control reference at the attachment AT. When the control reference is assumed to operate in accordance with the operation direction and the operation amount in the operation input related to the arm 5, the target position is on the target construction surface to be reached in the present control period (in other words, the target trajectory). The target position calculation unit 3005 may calculate the target position of the tip of the attachment AT using, for example, a map or an arithmetic expression, stored in advance in the non-volatile internal memory or the like.

The master element setting unit 3007 sets an operation element that operates in response to the operator's operation input, among the operation elements constituting the attachment AT (the boom 4, the arm 5, and the bucket 6) and the upper pivot body 3 (pivot mechanism 2), that is, the master element.

Specifically, as described above, the master element setting unit 3007 sets the arm 5 to the master element for the excavation operation by the shovel 100. Moreover, the master element setting unit 3007 switches the master element from the arm 5 to the upper pivot body 3 when the boom raising turning start condition (an example of the third condition) is satisfied. At this time, as described above, the boom raising turning start condition is that the state in which the left operation lever 26L (an example of the first operation unit and the second operation unit) is operated in the longitudinal direction is switched to the state in which the left operation lever 26L is operated in the lateral direction. When the shovel 100 is remotely operated, the boom raising turning start condition may be, for example, that the content of the remote operation designated by the remote operation signal is switched from the state representing the operation related to the arm 5 to the state representing the operation related to the upper pivot body 3. That is, the boom raising and turning start condition may be that the state in which the operation related to the arm 5 is performed is switched to the state in which the operation related to the upper pivot body 3 is performed. Moreover, the master element setting unit 3007 switches the master element from the upper pivot body 3 to the bucket 6, when the sediment discharge start condition (an example of the fourth condition) is satisfied. At this time, as described above, the sediment discharge start condition is that, for example, the state in which the left operation lever 26L (an example of the third operation section) is operated in the lateral direction is switched to the state in which the right operation lever 26R (an example of the fourth operation section) is operated in the lateral direction (in particular, the right direction). Furthermore, when the shovel 100 is remotely operated, the sediment discharge start condition may be, for example, that the content of the remote operation designated by the remote operation signal is switched from the state representing the operation related to the upper pivot body 3 to the state representing the operation related to the bucket 6 (specifically, the opening operation). That is, the sediment discharge start condition may be that the state in which the operation related to the upper pivot body 3 is performed is switched to the state in which the (opening) operation related to the bucket 6 is performed. When the boom lowering turning start condition is satisfied, the master element setting unit 3007 switches the master element from the bucket 6 to the upper pivot body 3. At this time, the boom lowering turning start condition is that, for example, the state in which the right operation lever 26R is operated in the lateral direction is switched to the state in which the left operation lever 26L is operated in the lateral direction, as described above. Moreover, when the shovel 100 is remotely operated, the boom lowering turning start condition may be, for example, that the content of the remote operation designated by the remote operation signal is switched from the state representing the (opening) operation related to the bucket 6 (or the arm 5) to the state representing the operation related to the upper pivot body 3. That is, the boom lowering turning start condition may be that the state in which the (opening) operation related to the bucket 6 (or the arm 5) is performed is switched to the state in which the operation related to the upper pivot body 3 is performed. When the excavation start condition is satisfied, the master element setting unit 3007 switches the master element from the upper pivot body 3 to the arm 5. At this time, the excavation start condition is that, for example, the state in which the left operation lever 26L is operated in the lateral direction is switched to the state in which the left operation lever 26L is operated in the longitudinal direction. When the shovel 100 is remotely operated, the excavation start condition may be, for example, that the content of the remote operation designated by the remote operation signal is switched from the state representing the operation related to the upper pivot body 3 to the state representing the operation related to the arm 5. That is, the excavation start condition may be that the state in which the operation related to the upper pivot body 3 is performed is switched to the state in which the operation related to the arm 5 is performed. A specific setting method of the master element by the master element setting unit 3007 will be described later (see FIGS. 11A to 11C).

In the left operation lever 26L, a portion accommodating the tilting operation in the longitudinal direction corresponds to an example of the first operation unit, and a portion accommodating the tilting operation in the lateral direction corresponds to an example of the second operation unit.

The control reference setting unit 3008 sets a control reference at the attachment AT. For example, the control reference setting unit 3008 may automatically set (change) the control reference of the attachment AT according to the switching of the operation step by the shovel 100. Specifically, the control reference setting unit 3008 switches the control reference predetermined for each of the operation steps, that is, the excavation operation, the boom raising turning operation, the sediment discharge operation, and the boom lowering turning operation, according to the switching of the operation steps. At this time, the control reference for each operation step may be predetermined or may be set (changed) in response to the operation by the operator or the like through the input device 72. Moreover, the control reference setting unit 3008 may determine the switching of the operation step in the same manner as the case of the above-described switching (change setting) of the master element.

The operation command generation unit 3009 generates, on the basis of the target position of the control reference at the attachment AT, at least two of a command value related to the operation of the boom 4 (hereinafter referred to as a "boom command value") $\beta_{1r}$, a command value relating to the operation of the arm 5 (hereinafter referred to as an "arm command value") $\beta_{2r}$, a command value relating to the operation of the bucket 6 (hereinafter referred to as a "bucket command value") $\beta_{3r}$, and a command value relating to the turning operation of the upper pivot body 3 (hereinafter referred to as a "turning command value") $\beta_{4r}$. For example, the boom command value $\beta_{1r}$, the arm command value $\beta_{2r}$, the bucket command value $\beta_{3r}$, and the turning command value Bar are the boom angular velocity, the arm angular velocity, the bucket angular velocity, and the turning angular velocity of the upper pivot body 3, respectively, required for the control reference at the attachment AT to achieve the target position. The operation command generation unit 3009 includes a master command value generation unit 3009A and a slave command value generation unit 3009B.

The boom command value, the arm command value, the bucket command value, and the turning command value may be the boom angle, the arm angle, the bucket angle, and the turning angle, respectively, when the control reference at the attachment AT achieves the target position. Moreover, the boom command value, the arm command value, the bucket command value, and the turning command value may be the angular acceleration or the like required for the control reference at the attachment AT to achieve the target position.

The master command value generation unit 3009A generates a command value relating to the operation of the master element among the operation elements (the boom 4, the arm 5, and the bucket 6) constituting the attachment AT and the upper pivot body 3 (pivot mechanism 2), that is, a master command value.

As shown in FIG. 10A, for example, when the master element set by the master element setting unit 3007 is the arm 5, that is, the shovel 100 performs the excavation operation, the master command value generation unit 3009A generates the arm command value $\beta_{2r}$ as the master command value and outputs the value to the arm pilot command generation unit 3010B. Specifically, the master command value generation unit 3009A generates the arm command value $\beta_{2r}$ corresponding to the content (the operation direction and the operation amount) of the operation input with respect to the arm 5. For example, the master command value generation unit 3009A may generate the arm command value $\delta_{2r}$ on the basis of a predetermined map, a conversion formula or the like defining the relationship between the content of the operation input relating to the arm 5 and the arm command value $\beta_{2r}$.

As shown in FIG. 10B, for example, when the master element set by the master element setting unit 3007 is the upper pivot body 3, that is, the boom raising turning operation or the boom lowering turning operation is performed by the shovel 100, the master command value generation unit 3009A generates the turning command value $\beta_{4r}$ as the master command value, and outputs the value to the turning pilot command generation unit 3010D, which will be described later. Specifically, the master command value generation unit 3009A generates the turning command value $\beta_{4r}$ corresponding to the content (the operating direction and the operation amount) of the operation input with respect to the upper pivot body 3. For example, the master command value generation unit 3009A may generate the turning command value $\beta_{4r}$ on the basis of a predetermined map, a conversion formula or the like defining the relationship between the content of the operation input related to the upper pivot body 3 and the turning command value $\beta_{4r}$.

As shown in FIG. 10C, for example, when the master element set by the master element setting unit 3007 is the bucket 6, that is, when the sediment discharge operation is performed by the shovel 100, the master command value generation unit 3009A generates the bucket command value $\beta_{3r}$ as the master command value, and outputs the value to the bucket pilot command generation unit 3010C. Specifically, the master command value generation unit 3009A generates the bucket command value $\beta_{3r}$ corresponding to the content (the operation direction and the operation amount) of the operation input relating to the bucket 6. For example, the master command value generation unit 3009A may generate the bucket command value $\beta_{3r}$ on the basis of a predetermined map, a conversion formula or the like defining the relationship between the content of the operation input related to the bucket 6 and the bucket command value $\beta_{3r}$.

When the operation device 26 is operated by the operator in the cabin 10, the master command value generation unit 3009A need not generate the master command value. This is because when the excavation operation of the shovel 100 is performed, the pilot pressure corresponding to the operation in the longitudinal direction of the left operation lever 26L acts on the pilot port of the control valves 176L and 176R corresponding to the arm cylinder 8 via the shuttle valves 32AL and 32AR, and thereby the arm 5 can operate as the master element. Moreover, this is because when the boom raising turning operation or the boom lowering turning operation of the shovel 100 is performed, the pilot pressure corresponding to the operation in the lateral direction of the left operation lever 26L acts on the pilot port of the control valve 173 corresponding to the pivot hydraulic motor 2A via the shuttle valves 32DL and 32DR, and thereby the upper pivot body 3 can operate as the master element. Furthermore, this is because when the sediment discharge operation of the shovel 100 is performed, the pilot pressure corresponding to the operation in the lateral direction of the right operation lever 26R acts on the control valve 174 corresponding to the bucket cylinder 9 via the shuttle valves 32CL and 32CR, and thereby the bucket 6 can operate as the master element.

The slave command value generation unit 3009B generates a command value related to the operation of the operation element (slave element) operating so that the control reference of the attachment AT moves along the target trajectory in accordance (synchronization) with the operation of the master element among the operation elements constituting the attachment AT and the upper pivot body 3, that is, the slave command value.

As shown in FIG. 10A, for example, when the arm 5 is set to the master element by the master element setting unit 3007, that is, the shovel 100 performs the excavation operation, the slave command value generation unit 3009B generates the boom command value $\beta_{1r}$ and the bucket command value $\beta_{3r}$ as the slave command values. Specifically, the slave command value generation unit 3009B generates the boom command value $\beta_{1r}$ and the bucket command value $\beta_{3r}$ so that the boom 4 and the bucket 6 operate in accordance (synchronization) with the operation of the arm 5 and the control reference of the attachment AT can achieve the target position (i.e. move along the target construction surface). Then, the slave command value generation unit 3009B outputs the boom command value $\beta_{1r}$ and the bucket command value $\beta_{3r}$ to the boom pilot command generation unit 3010A and the bucket pilot command generation unit 3010C, respectively. As a result, the controller 30 can move the control reference of the attachment AT along the target construction surface by operating the boom 4 and the bucket 6 in accordance (synchronization) with the operation of the arm 5 corresponding to the operation input related to the arm 5. That is, the arm 5 (the arm cylinder 8) operates in response to the operation input related to the arm 5, and operations of the boom 4 (the boom cylinder 7) and the bucket 6 (the bucket cylinder 9) are controlled in accordance with the operation of the arm 5 (the arm cylinder 8) so that the tip (work part) of the attachment AT, such as the claw edge of the bucket 6, moves along the target construction surface.

As shown in FIG. 10B, for example, when the upper pivot body 3 is set to the master element by the master element setting unit 3007, that is, the boom raising turning operation or the boom lowering turning operation is performed by the shovel 100, the boom command value $\beta_{1r}$, the arm command value $\beta_{2r}$ and the bucket command value $\beta_{3r}$ are generated as the slave command values. Specifically, the slave command value generation unit 3009B generates the boom command value $\beta_{1r}$, the arm command value $\beta_{2r}$, and the bucket command value $\beta_{3r}$ so that the boom 4, the arm 5, and the bucket 6 operate in accordance (synchronization) with the turning operation of the upper pivot body 3 and the control reference of the attachment AT can achieve the target position (i.e. move along the target trajectory). Then, the slave command value generation unit 3009B outputs the boom command value $\beta_{1r}$, the arm command value $\beta_{2r}$, and the bucket command value $\beta_{3r}$ to the boom pilot command generation unit 3010A, the arm pilot command generation unit 3010B, and the bucket pilot command generation unit 3010C, respectively. As a result, the controller 30 can move the control reference of the attachment AT along the target trajectory by operating the boom 4, the arm 5, and the bucket 6 in accordance (synchronization) with the turning operation of the upper pivot body 3 corresponding to the operation input related to the upper pivot body 3. That is, the upper pivot body 3 (pivot hydraulic motor 2A) operates in response to the operation input related to the upper pivot body 3, and operations of the boom 4 (the boom cylinder 7), the arm 5 (the arm cylinder 8), and the bucket 6 (bucket cylinder 9) are controlled in accordance with the operation of the upper pivot body 3 (the pivot hydraulic motor 2A) so that the tip (work part) of the attachment AT, such as the back surface of the bucket 6, moves along the target trajectory.

As shown in FIG. 10C, for example, when the bucket 6 is set to the master element by the master element setting unit 3007, that is, the shovel 100 performs the sediment discharge operation, the slave command value generation unit 3009B generates the arm command value $\beta_{2r}$ as the slave command value. Specifically, the slave command value generation unit 3009B generates the arm command value $\beta_{2r}$ so that the arm 5 operates in accordance (synchronization) with the opening operation of the bucket 6, and the control reference of the attachment AT can achieve the target position (i.e. move along the target trajectory). Then, as shown in FIG. 10D, the slave command value generation unit 3009B outputs the arm command value $\beta_{2r}$ to the boom pilot command generation unit 3010A, the arm pilot command generation unit 3010B, and the bucket pilot command generation unit 3010C, respectively. Thus, the controller 30 can move the control reference of the attachment AT along the target trajectory by operating the arm 5 in accordance (synchronization) with the operation of the bucket 6 corresponding to the (opening) operation related to the bucket 6. That is, the bucket 6 (the bucket cylinder 9) operates in response to the operation input related to the bucket 6, and the operation of the arm 5 (the arm cylinder 8) is controlled in accordance with the operation of the bucket 6 (bucket cylinder 9) so that the tip (control reference) of the attachment AT, such as the claw edge of the bucket 6, moves along the target trajectory.

The pilot command generation unit 3010 generates a command value of the pilot pressure acting on control valves 173 to 176 (hereinafter referred to as a "pilot pressure command value") for realizing the boom angular velocity, the arm angular velocity, the bucket angular velocity, and the turning angular velocity corresponding to the boom command value $\beta_{1r}$, the arm command value $\beta_{2r}$, the bucket command value $\beta_{3r}$, and the turning command value $\beta_{4r}$. The pilot command generation unit 3010 includes a boom pilot command generation unit 3010A, an arm pilot command generation unit 3010B, a bucket pilot command generation unit 3010C, and a turning pilot command generation unit 3010D.

The turning pilot command generation unit 3010D generates a pilot pressure command value for acting on the control valve 173 corresponding to the pivot hydraulic motor 2A for turning driving the upper pivot body 3, on the basis of the deviation between the turning command value $\beta_{4r}$ and a calculated value (a measured value) of the turning angular velocity of the current upper pivot body 3 by the turning angle calculation unit 3011D, which will be described later. The turning pilot command generation unit 3010D outputs a control current corresponding to the generated pilot pressure command value to the proportional valves 31DL and 31DR. Thus, as described above, the pilot pressure corresponding to the pilot pressure command value output from the proportional valves 31DL and 31DR acts on the corresponding pilot port of the control valve 173 via the shuttle valves 32DL and 32DR. Then, by the action of the control valve 173, the pivot hydraulic motor 2A is operated, and the upper pivot body 3 is turned so as to realize the turning angular velocity corresponding to the turning command value $\beta_{4r}$.

The posture angle calculation unit 3011 calculates (measures) the (current) boom angle, the arm angle, the bucket angle, and the turning angle; and the boom angular velocity, the arm angular velocity, the bucket angular velocity, and the turning angular velocity on the basis of the detection signals from the boom angle sensor S1, the arm angle sensor S2, the bucket angle sensor S3, and the turning state sensor S5. The posture angle calculation unit 3011 includes a boom angle calculation unit 3011A, an arm angle calculation unit 3011B, a bucket angle calculation unit 3011C, and a turning angle calculation unit 3011D.

The turning angle calculation unit 3011*d* calculates (measures) the turning angle, the turning angular velocity and the like, on the basis of the detection signal fetched from the turning state sensor S5.

<Processing Related to Machine Control Function of Shovel>

Next, referring to FIGS. 11A to 11C, a process flow related to another example of the machine control function of the shovel 100 according to the present embodiment will be described.

Figure 11A:
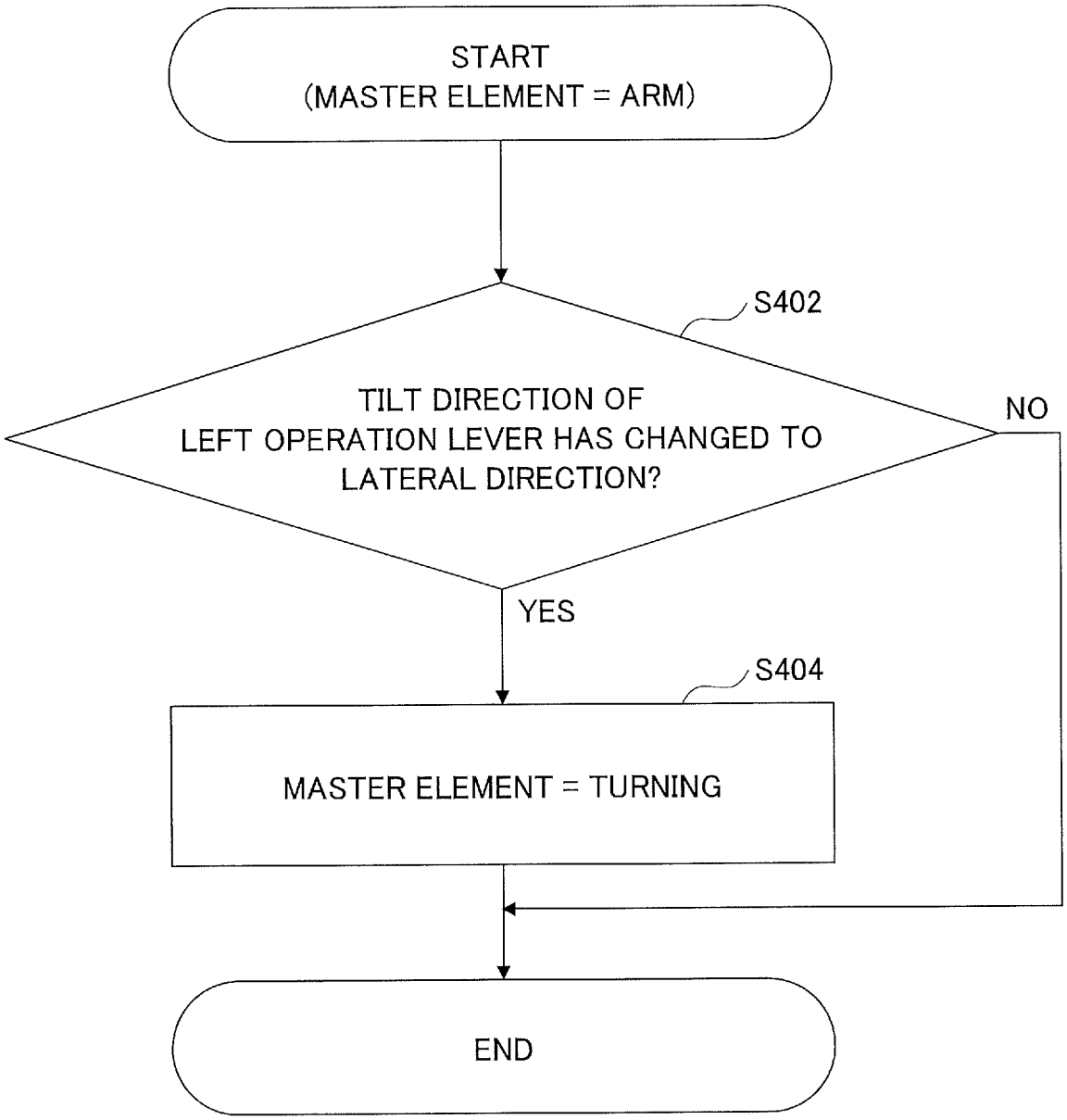
FIG. 11A is a functional block diagram schematically illustrating another example of the master switching process by the controller of the shovel.
Figure 11B:
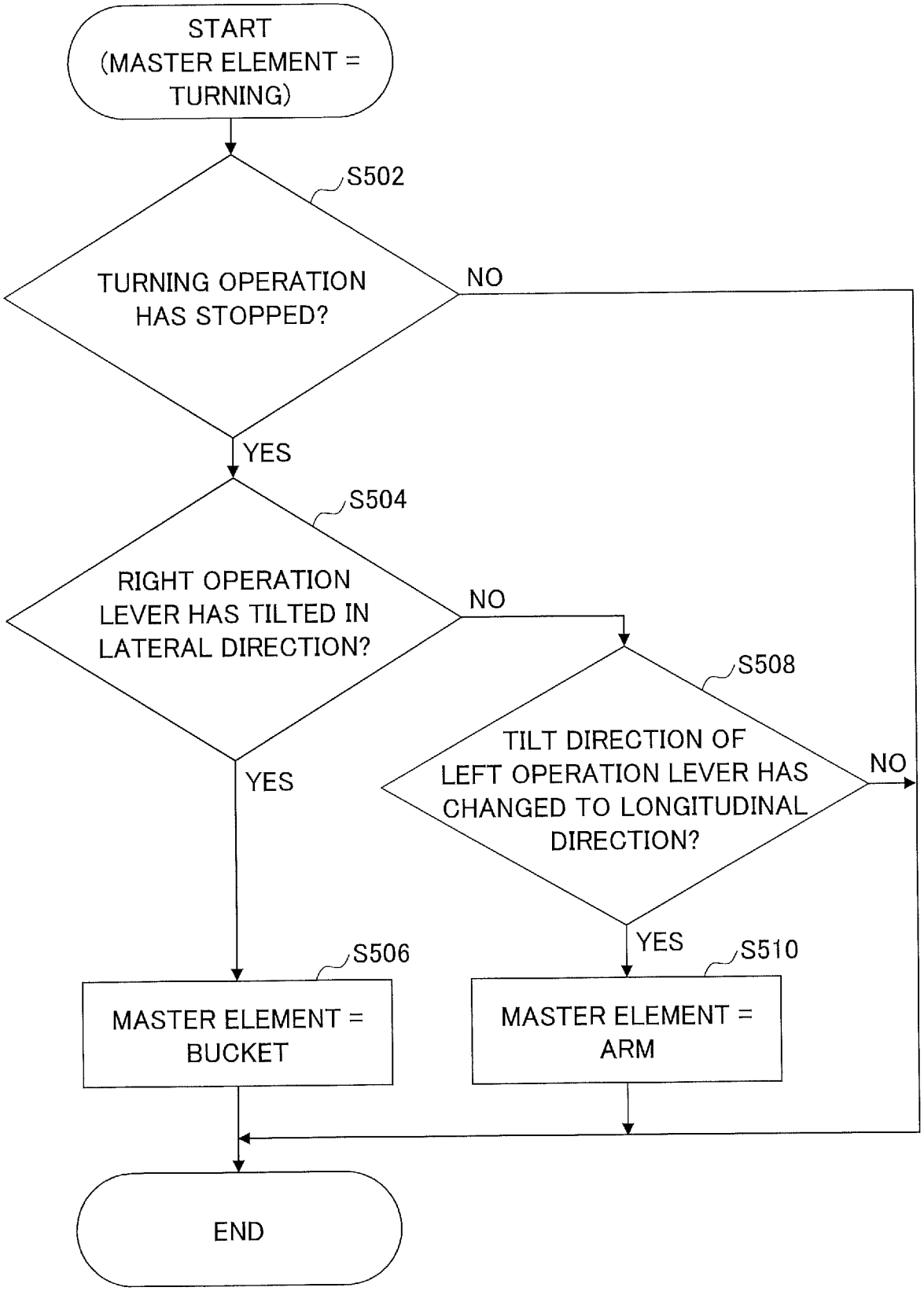
FIG. 11B is a functional block diagram schematically illustrating another example of the master switching process by the controller of the shovel.
Figure 11C:
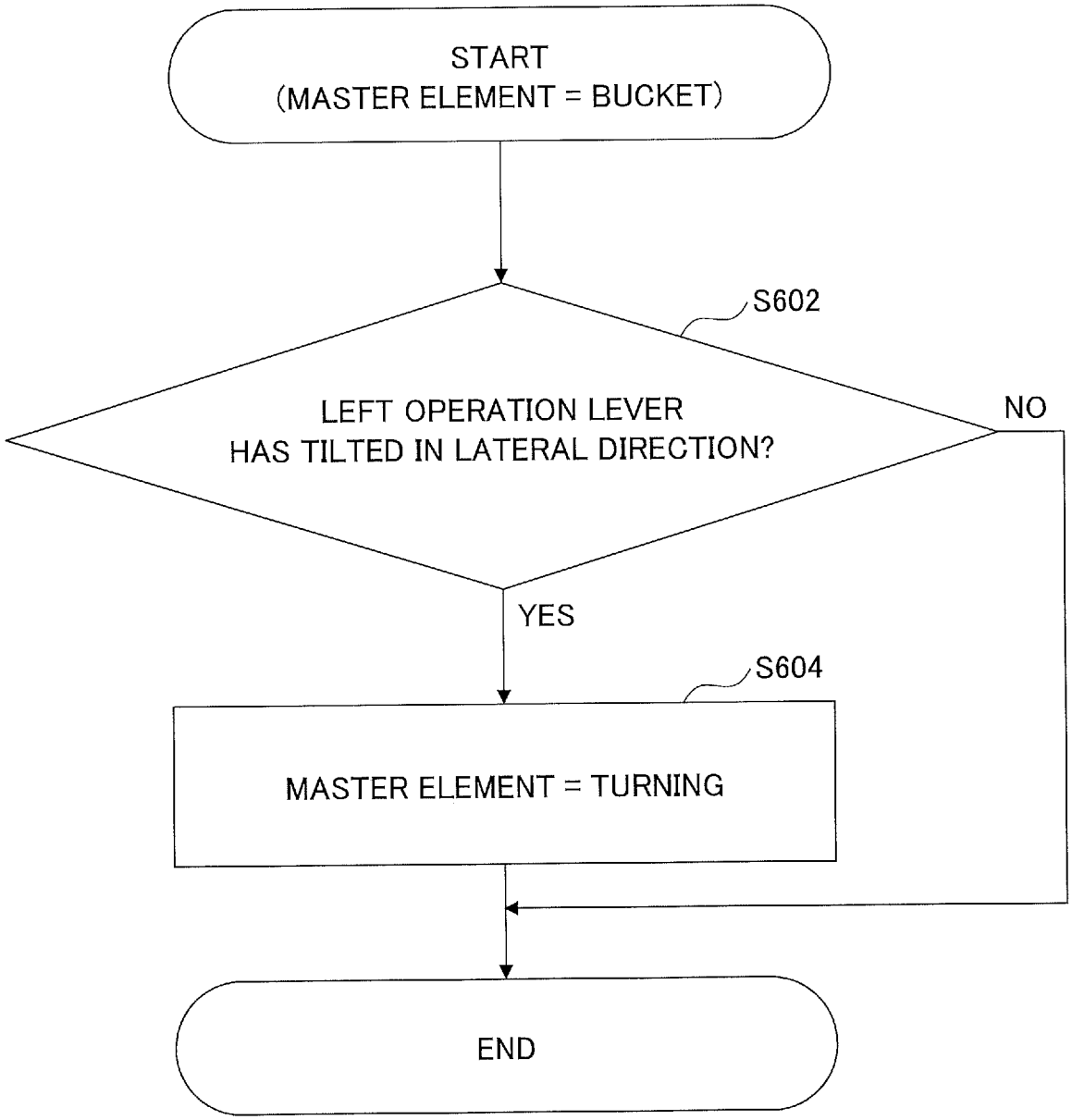
FIG. 11C is a functional block diagram schematically illustrating another example of the master switching process by the controller of the shovel.

FIGS. 11A to 11C are flowcharts schematically illustrating another example of the process related to the machine control function by the controller 30 of the shovel 100 according to the present embodiment, specifically, another example of the master switching process. More specifically, FIGS. 11A to 11C are flowcharts showing master switching processes when the master element is set to the arm 5, the upper pivot body 3, and the bucket 6, respectively, that is, the excavation operation by the shovel 100, the boom raising turning operation or the boom lowering turning operation, and the sediment discharge operation are performed, respectively. In the following, the processes shown in FIGS. 11A to 11C may be repeatedly executed for each control cycle, when the machine control function is valid, for example, the switch NS is pressed. In the following, the case where the operation device 26 (the left operation lever 26L and the right operation lever 26R) is operated by the operator in the cabin 10 will be described. However, as described above, the same applies to the case where the remote operation is performed.

<<Master Switching Process in Excavation Operation>>

In step S402, the master element setting unit 3007 determines whether the tilt direction of the left operation lever 26L has changed from the longitudinal direction to the lateral direction on the basis of the detection signal of the operation pressure sensors 29LA and 29LB. When the tilt direction of the left operation lever 26L changed from the longitudinal direction to the lateral direction, the master element setting unit 3007 proceeds to step S404, and otherwise terminates the process.

In step S404, the master element setting unit 3007 sets the master element to the upper pivot body 3 (the pivot mechanism 2). That is, the master element setting unit 3007 switches the master element from the arm 5 to the upper pivot body 3, and terminates the process.

<<Master Switching Process in Boom Raising Turning Operation or Boom Lowering Turning Operation>>

In step S502, the master element setting unit 3007 determines whether the upper pivot body 3 has stopped turning on the basis of the detection signal of the turning state sensor S5 or the operation pressure sensor 29LB. The master element setting unit 3007 proceeds to step S504 when the upper pivot body 3 stops turning. When the upper pivot body 3 does not stop turning, the process ends.

In step S504, the master element setting unit 3007 determines whether the state in which the left operation lever 26L is operated in the lateral direction has changed to the state in which the right operation lever 26R is operated in the lateral direction (specifically, the right direction) on the basis of the detection signal of the operation pressure sensors 29LB and 29RB. The master element setting unit 3007 proceeds to step S506 when the state in which the left operation lever 26L is operated in the lateral direction has changed to the state in which the right operation lever 26R is operated in the lateral direction (specifically, the right direction), and otherwise proceeds to step S508.

In step S506, the master element setting unit 3007 sets the master element to the bucket 6. That is, the master element setting unit 3007 switches the master element from the upper pivot body 3 to the bucket 6, and terminates the process.

On the other hand, in step S508, the master element setting unit 3007 determines whether a state in which the left operation lever 26L is operated in the lateral direction has changed to a state in which the left operation lever 26L is operated in the longitudinal direction, on the basis of a detection signal of the operation pressure sensors 29LA and 29LB. When the state in which the left operation lever 26L is operated in the lateral direction has been determined to be changed to the state in which the left operation lever 26L is operated in the longitudinal direction, the master element setting unit 3007 proceeds to step S510. Otherwise, the process ends.

In step S510, the master element setting unit 3007 sets the master element to the arm 5. That is, the master element setting unit 3007 switches the master element from the upper pivot body 3 to the arm 5, and terminates the process.

It should be noted that the master element setting unit 3007 may determine in advance whether the shovel 100 is in the boom raising turning operation or the boom lowering turning operation. In this case, the master element setting unit 3007 can determine whether the shovel 100 is in the boom raising turning operation or the boom lowering turning operation on the basis of the history of switching of the master element or the like. Then, when the shovel 100 is in the boom raising turning operation, the master element setting unit 3007 may execute a flowchart in which steps S508 and S510 are omitted. If the shovel 100 is in the boom lowering turning operation, the master element setting unit 3007 may execute a flowchart in which steps S504 and S506 are omitted and modified so that the determination result is YES in step S502, the process proceeds to step S508.

<<Master Switching Process in Sediment Discharge Operation>>

In step S602, the master element setting unit 3007 determines whether a state in which the right operation lever 26R is operated in the lateral direction is changed to a state in which the left operation lever 26L is operated in the lateral direction, on the basis of a detection signal of the operation pressure sensors 29LB and 29RB. When the state in which the right operation lever 26R is operated in the lateral direction has been determined to be changed to the state in which the left operation lever 26R is operated in the lateral direction, the master element setting unit 3007 proceeds to step S604. Otherwise, the process ends.

In step S604, the master element setting unit 3007 sets the upper pivot body 3 to the master element. That is, the master element setting unit 3007 switches the master element from the bucket 6 to the upper pivot body 3, and terminates the process.

<Action Related to Machine Control Function of Shovel>

Next, referring to FIGS. 12A and 12B, an action related to another example of the machine control function of the shovel 100 according to the present embodiment will be described, and specifically, the action related to the machine control function shown in FIGS. 9 to 11 will be described.

Figure 12A:
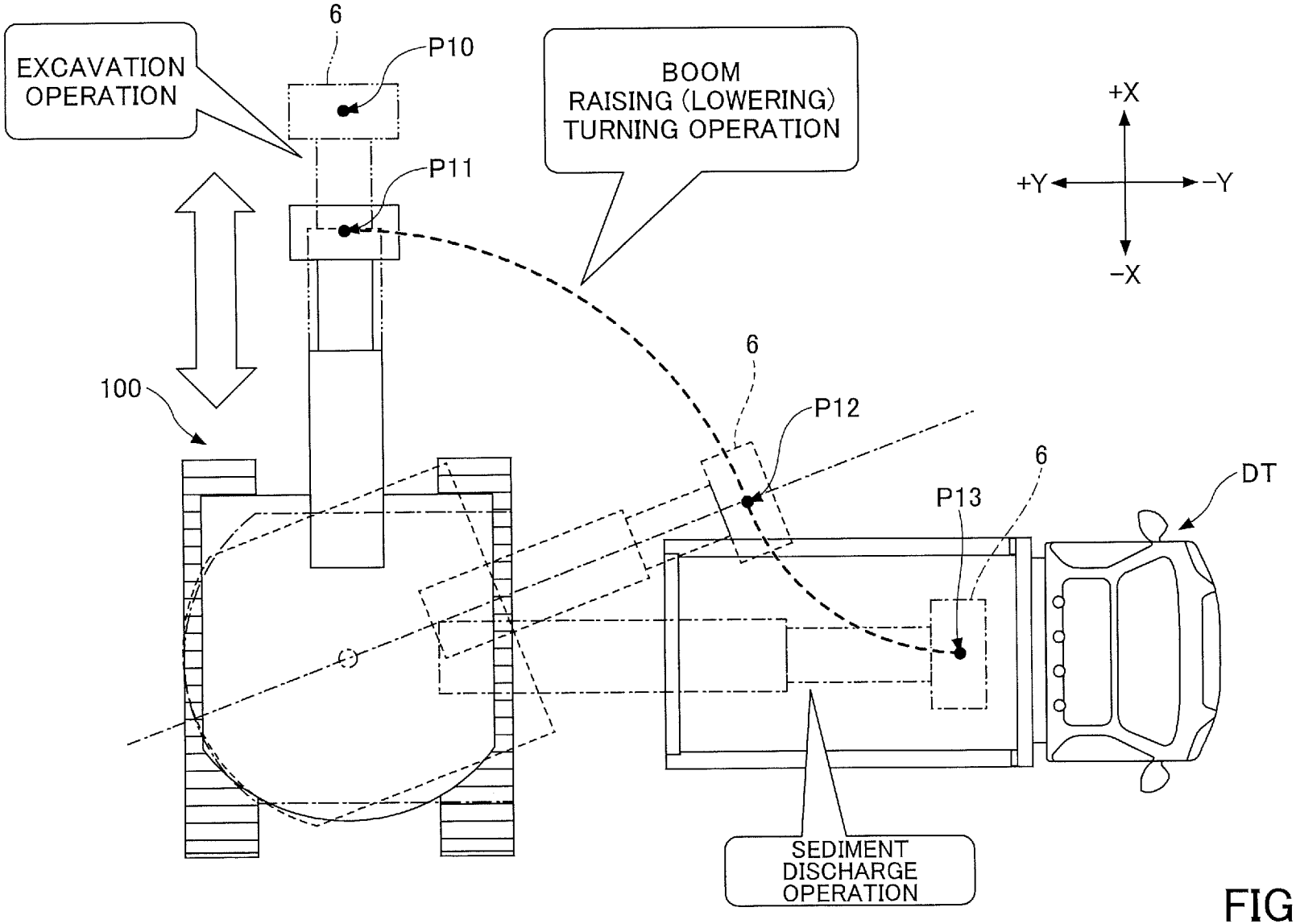
FIG. 12A is a top view for illustrating another example of the operation of the attachment by the machine control function of the shovel.
Figure 12B:
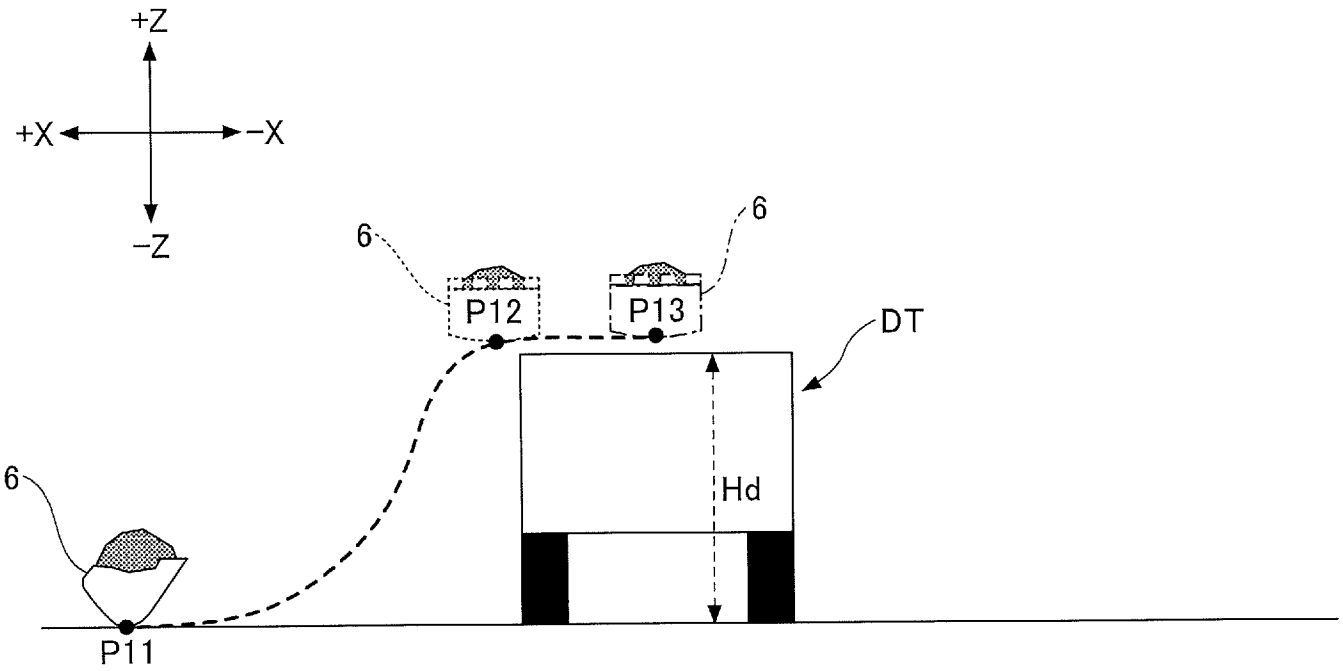
FIG. 12B is a side view for illustrating another example of the operation of the attachment by the machine control function of the shovel.

FIGS. 12A and 12B are diagrams for explaining the action related to another example of the machine control function of the shovel 100 according to the present embodiment. Specifically, FIGS. 12A and 12B are a top view and a side view showing the operation of the attachment AT in a series of operation steps of the excavation operation, the boom raising turning operation, the sediment discharge operation, and the boom lowering turning operation of the shovel 100.

Positions P11, P12, and P13 in the drawings represent the excavation end position, the boom raising end position, and the sediment discharge position, respectively. The position P13 may be changed every time the sediment discharge operation is performed. For example, when sediment is loaded from the side close to the shovel 100 on the loading platform of the dump truck, the position P13 is changed toward the driver's seat side in the loading platform of the dump truck every time the sediment discharge operation is performed. Moreover, a state in which sediment is loaded on the dump truck (hereinafter, referred to as a "loading state") may be detected through the space recognition device 70 of the shovel 100 (for example, an imaging device such as a monocular camera or a stereo camera), and the position P13 may be changed according to the detected loading state. Specifically, a state of unevenness of the loading platform may be detected as the loading state, and a position corresponding to a detected recess may be set as the position P13. Furthermore, as the loading state a spill is detected from the loading platform of the dump truck at the time of sediment discharge, the position P13 may be changed either in the lateral direction or downward according to the detection of the spill.

As shown in FIGS. 12A and 12B, in the present example, the shovel 100 performs the excavation operation in the longitudinal direction from the position P10 to the position P11, and lifts the bucket 6 containing the sediment from the position P11 to a position P12 higher than the height Hd of the dump door of the dump truck DT in the boom raising and turning operation. Thereafter, the shovel 100 performs a sediment discharge operation for opening the arm 5 while opening the bucket 6, moves the bucket 6 from the position P12 to a position P13 corresponding to the target position of the loading platform of the dump truck DT, and discharges sediment to the target position. Then, the shovel 100 returns the bucket 6 from the position P13 to the position P11 (via the position P12) in the boom lowering turning operation by the machine control function, and one cycle of the series of operation steps ends.

Typically, the operator or the like implements such a series of operation steps using a composite operation for the operating device 26. Therefore, the operability of the operator or the like may decrease depending on the degree of skill of the operator or the like.

On the other hand, in the present embodiment, the controller 30 switches the master element in the machine control function, when a predetermined condition related to the operation state in the operation device 26 is satisfied, on the premise of the series of operation steps described above. The predetermined condition in this example corresponds to the case where an operation object, which has not been operated, starts to be operated through a predetermined operation unit (operation device 26).

Specifically, the controller 30 switches the master element from the arm 5 to the upper pivot body 3, as described above, when the state in which the left operation lever 26L is operated in the longitudinal direction is switched to the state in which the left operation lever 26L is operated in the lateral direction, and thereby the boom raising and turning start condition is satisfied. Thus, the controller 30 transits from the state of controlling the operation of the boom cylinder 7 or the like (an example of another actuator) in accordance with the operation of the arm cylinder 8 (an example of the first actuator) operating corresponding to the operation of the left operation lever 26L in the longitudinal direction, to the state of controlling the operation of the boom cylinder 7 or the like in accordance with the operation of the pivot hydraulic motor 2A (an example of a second actuator) operating corresponding to the operation of the left operation lever 26L in the lateral direction. Therefore, the operator or the like can shift the operation process of the shovel 100 by the machine control function from the excavation operation to the boom raising turning operation, only by switching the operation direction (tilting direction) of the left operation lever 26L from the longitudinal direction to the lateral direction, as described above.

Moreover, the controller 30 switches the master element from the upper pivot body 3 to the bucket 6, as described above, when the state in which the left operation lever 26L is operated in the lateral direction is switched to the state in which the right operation lever 26R is operated in the lateral direction, and thereby the sediment discharge start condition is satisfied. Thus, the controller 30 transits from the state of controlling the operation of the boom cylinder 7 or the like (an example of another actuator) in accordance with the operation of the pivot hydraulic motor 2A (an example of the first actuator) operating corresponding to the operation of the left operation lever 26L in the lateral direction, to the state of controlling the operation of the arm cylinder 8 or the like in accordance with the operation of the bucket cylinder 9 (an example of the second actuator) operating corresponding to the operation of the right operation lever 26R in the lateral direction. Therefore, as described above, the operator or the like can shift the operation process of the shovel 100 by the machine control function from the boom raising turning operation to the sediment discharge operation, only by switching the operation object in the operation device 26 from the operation of the left operation lever 26L in the lateral direction to the operation of the right operation lever 26R in the lateral direction.

Moreover, the controller 30 switches the master element from the bucket 6 to the upper pivot body 3, as described above, when the state in which the right operation lever 26R is operated in the lateral direction is switched to the state in which the left operation lever 26L is operated in the lateral direction, and thereby the boom lowering turning start condition is satisfied. Thus, the controller 30 transmits from the state of controlling the operation of the arm cylinder 8 or the like (an example of another actuator) in accordance with the operation of the bucket cylinder 9 (an example of the first actuator) operating corresponding to the operation of the right operation lever 26R in the lateral direction, to the state of controlling the operation of the boom cylinder 7 or the like in accordance with the operation of the pivot hydraulic motor 2A (an example of the second actuator) operating corresponding to the operation of the left operation lever 26L in the lateral direction. Therefore, the operator or the like can shift the operation process of the shovel 100 by the machine control function from the sediment discharge operation to the boom lowering turning operation, only by switching the operation object in the operation device 26 from the operation of the right operation lever 26R in the lateral direction to the operation of the left operation lever 26L in the lateral direction.

When the state in which the left operation lever 26L is operated in the lateral direction to the state in which the left operation lever 26L is operated in the longitudinal direction, and thereby the excavation start condition is satisfied, the controller 30 switches the master element from the upper pivot body 3 to the arm 5, as described above. Thus, the controller 30 transmits from the state of controlling the operation of the boom cylinder 7 or the like (an example of another actuator) in accordance with the operation of the pivot hydraulic motor 2A operating corresponding to the operation of the left operation lever 26L in the lateral direction, to the state of controlling the operation of the boom 4 or the like in accordance with the operation of the arm 5 operating corresponding to the operation of the left operation lever 26L in the longitudinal direction. Therefore, the operator or the like can return the operation process of the shovel 100 by the machine control function from the boom lowering turning operation to the excavation operation, only by switching the operation direction of the left operation lever 26L from the lateral direction to the longitudinal direction, as described above.

That is, the excavation operation of the shovel 100 by the operation related to the arm 5 (that is, the operation of the left operation lever 26L in the longitudinal direction) is completed in the state that the bucket 6 reaches the position P11 from the position P10. Thereafter, when the turning operation (that is, the operation of the left operation lever 26L in the lateral direction) is performed, the boom raising turning operation of the shovel 100 starts so that the bucket 6 goes from the position P11 to the position P13. When the operation (i.e. the operation of the right operation lever 26R in the lateral direction) relating to the bucket 6 is performed after the bucket 6 reaches the position P13, the sediment discharge operation of the shovel 100 starts.

As described above, a leveling operation may be added before the boom lowering turning operation of the shovel 100. That is, when a predetermined condition (a leveling operation start condition) is satisfied, the controller 30 automatically performs the leveling operation for flattening sediment mounted on the loading platform of the dump truck, in accordance with the operation related to the attachment of the operator, and the bucket 6 may be moved in accordance with a predetermined target trajectory. For example, the leveling operation start condition may include a condition "the sediment falling from the bucket 6 to the loading platform of the dump truck is not present", as described above. Moreover, for example, the leveling operation start condition may include a condition "the operation of the arm 5 is performed (i.e. the left operation lever 26L is operated in the longitudinal direction) in the state where the bucket 6 is located above the loading platform of the dump truck", as described above. In this case, the controller 30 may generate a target trajectory based on the shape of the loading platform of the dump truck, as described above.

Thus, the operator or the like can easily cause the shovel 100 to perform the series of operation steps, described above, simply by switching the operation object of a single operation along a predetermined condition without performing a composite operation corresponding to the plurality of operation elements (actuators). Thus, even when the degree of skill of the operator is low, the operator or the like can move the tip (control reference) of the attachment AT along a predetermined target trajectory (for example, the trajectory indicated by a dotted line from the position P1 in the figure to the position P3 via the position P2 in the drawing). In other words, the shovel 100 according to the present embodiment can move the tip of the attachment AT more appropriately along the target trajectory (specifically, a target trajectory over a series of operation steps) in response to the operation by the operator. Accordingly, the shovel 100 according to the present embodiment can improve the operability of the operator or the like through the series of operation steps described above, and can enhance workability.

[Yet Another Example of Machine Control Function According to the Present Embodiment]

Figure 13:
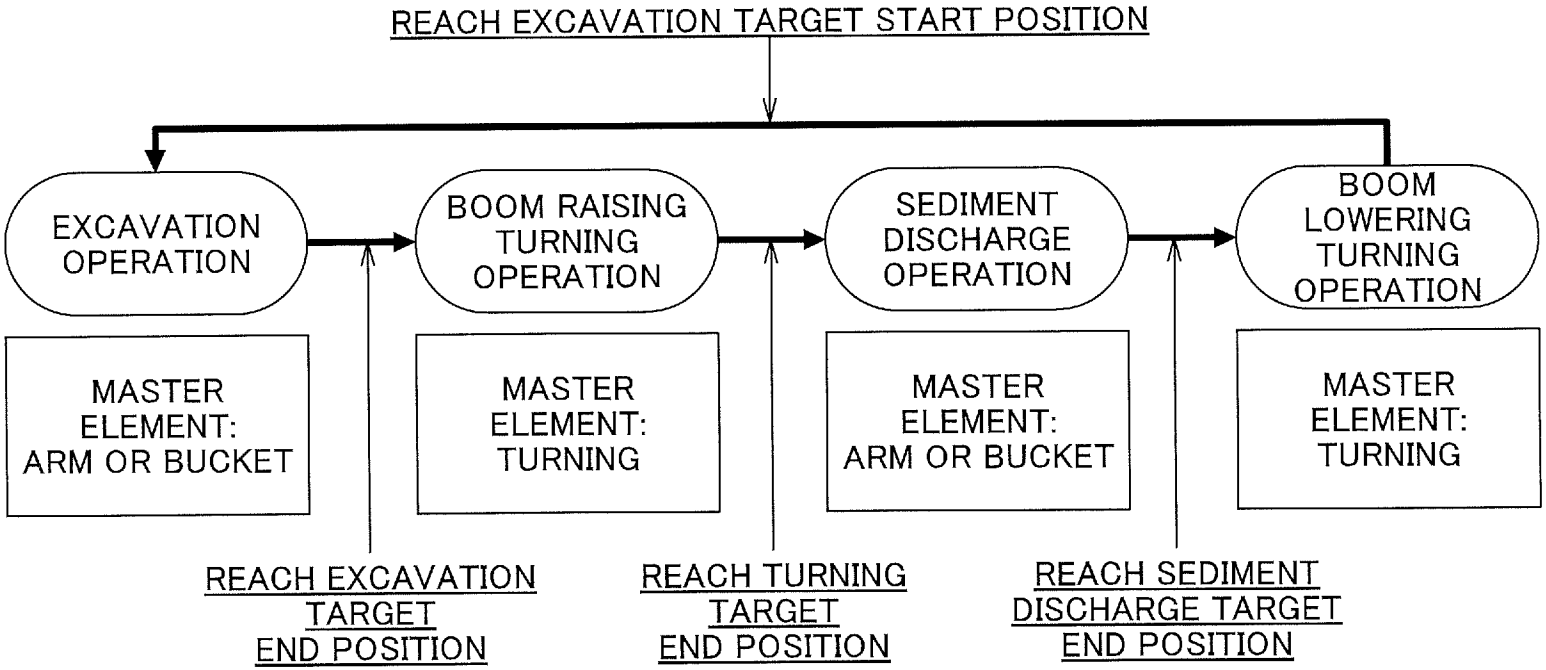
FIG. 13 is a diagram describing a series of procedures which is a subject of further other examples of the machine control function of the shovel.
Figure 14A:
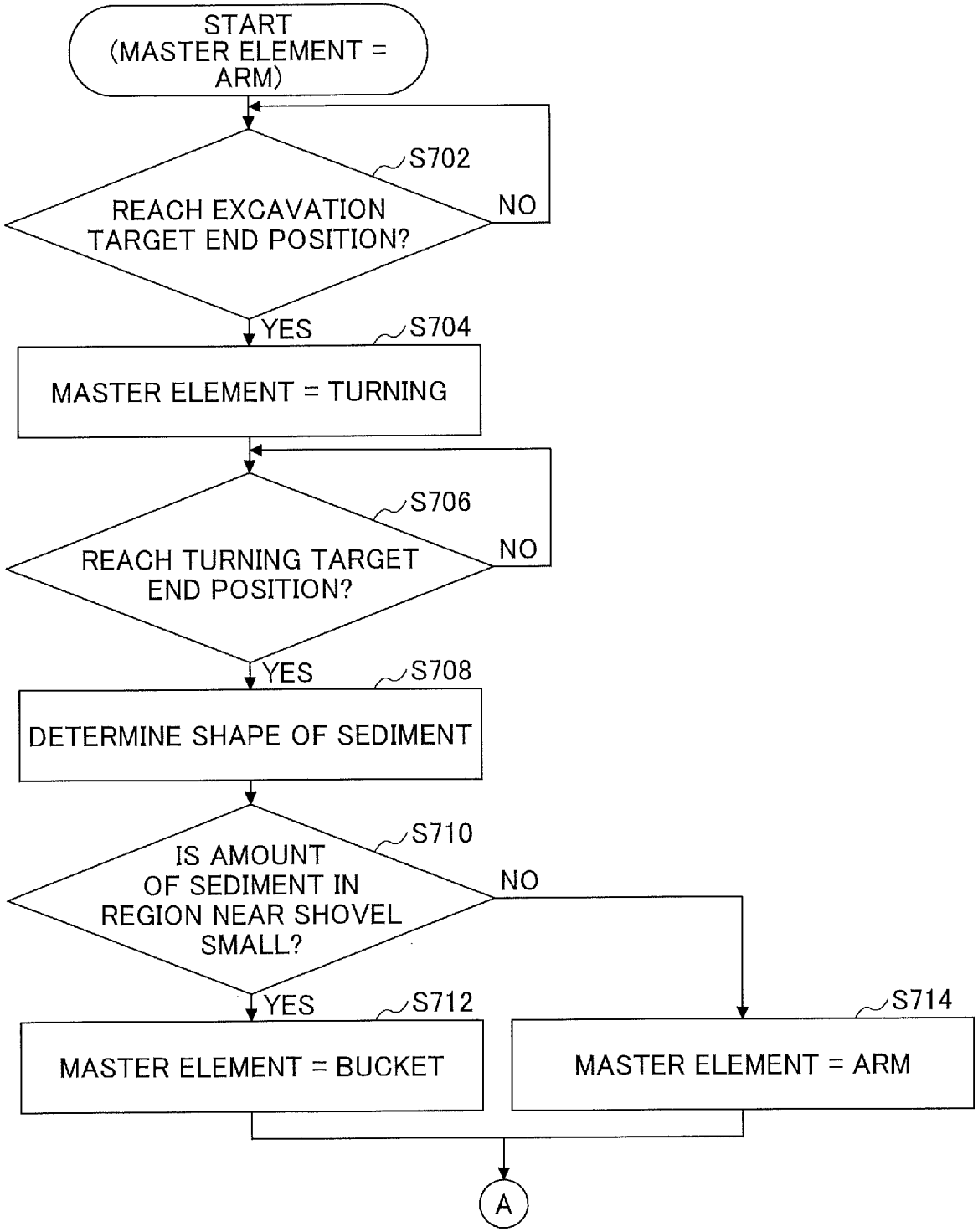
FIG. 14A is a functional block diagram schematically illustrating further another example of the master switching process by the controller of the shovel.
Figure 14B:
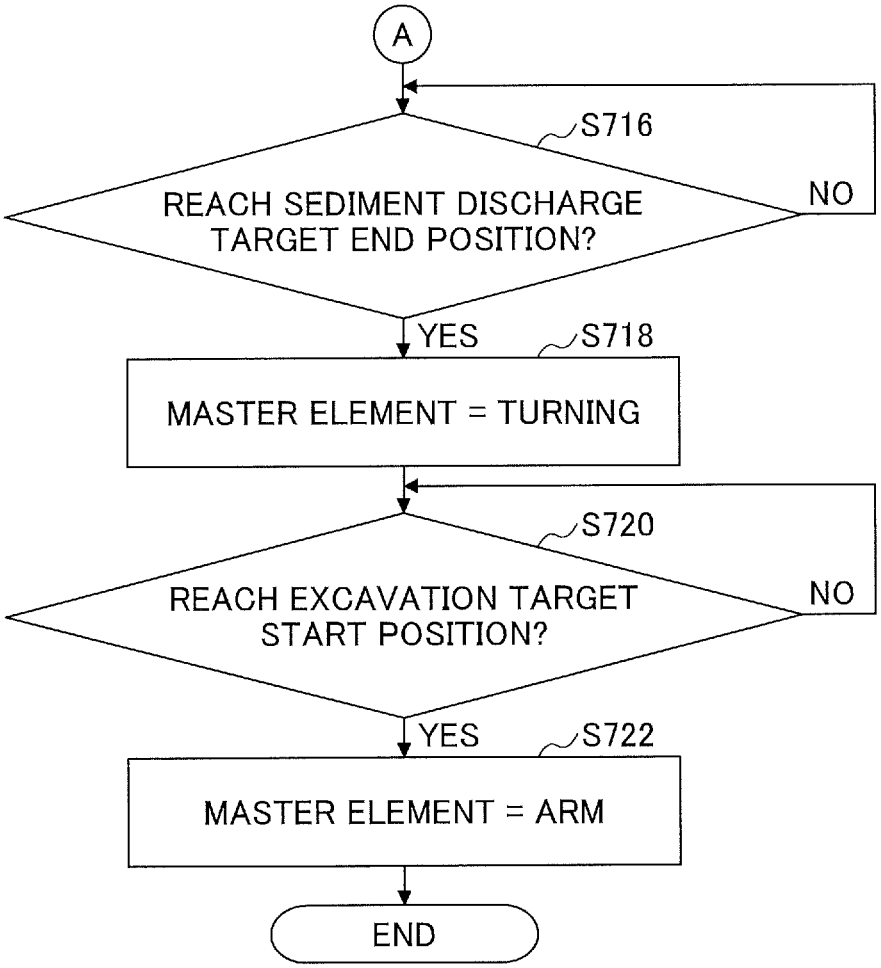
FIG. 14B is a functional block diagram schematically illustrating further another example of the master switching process by the controller of the shovel.

Next, another example of the machine control function of the shovel 100 according to the present embodiment will be described in detail with reference to FIGS. 13 and 14 (FIGS. 14A and 14B). In the present example, the shovel 100 performs a series of operations similar to the above-described other examples (FIGS. 9 to 12) on the basis of the autonomous driving function.

The difference between the configuration of the machine control function of the shovel 100 according to the present example and the above-described configuration of another example (FIGS. 10A to 10D) is similar to the difference between FIG. 6C corresponding to the autonomous driving function and FIG. 6A corresponding to the semi-automatic driving function of the above-described example. That is, the configuration relating to the machine control function of the shovel 100 according to the present embodiment is the same as the above-described other examples (FIGS. 10A to 10D), except that the function of the work content acquisition unit 3001A is adopted instead of the function of the operation content acquisition unit 3001. Therefore, in the present example, an illustration of the configuration relating to the machine control function of the shovel 100 is omitted, and FIGS. 10A to 10D will be applied appropriately to the following description.

<Overview of the Machine Control Function of Shovel>

Referring first to FIG. 13, an overview of still another example of the machine control function of the shovel 100 according to the present embodiment will be described.

FIG. 13 is a diagram illustrating still another example of the machine control function of the shovel 100 according to the present embodiment. Specifically, FIG. 13 is a diagram illustrating a series of operation steps (a work process) of the excavation work to be processed by the machine control function of the shovel 100 according to the present embodiment.

In the present example, the shovel 100 repeats, in the same manner as in the above-described case of FIG. 9, a series of operation steps of after storing sediment in the bucket 6 by the excavation operation; through the boom raising turning operation; discharging the sediment in the bucket 6 onto the loading platform of the dump truck; through the boom lowering turning operation; and returning to the excavation operation again. At this time, the controller 30 implements the machine control function for the series of work processes while switching the master element in the machine control function (autonomous driving function), that is, the operation element operating in response to the operation command.

Specifically, the controller 30 sets the arm 5 to the master element in the excavation operation. The controller 30 controls the operation of the boom 4 and the bucket 6 so that the control reference (work part) of the attachment AT moves along the target construction surface in accordance with the operation of the arm 5 corresponding to the operation command. Moreover, the controller 30 may also set the bucket 6 to the master element in the excavation operation. For example, the excavation length or the excavation depth may be relatively small. Thus, the controller 30 can implement a machine control function related to the excavation operation.

When the control reference (work part) of the attachment AT reaches the target end position of the excavation operation on the target trajectory (hereinafter referred to as an "excavation target end position"), the controller 30 switches (change setting) the master element from the arm 5 to the upper pivot body 3 (pivot mechanism 2). Then, the controller 30 controls the operation of the boom 4 or the like so that the control reference of the attachment AT (for example, the work part such as the back surface of the bucket 6) moves along a predetermined target trajectory in accordance with the turning operation of the upper pivot body 3 corresponding to the operation command. At this time, the target trajectory may be predetermined so that the bucket 6 is directed to a predetermined position in the space above the loading platform without colliding with the dump door or the like of the loading platform of the dump truck which is parked at a predetermined position. Thus, the controller 30 can realize the machine control function related to the boom raising turning operation according to the switching of the operation process from the excavation operation to the boom raising turning operation.

When the control reference (work part) of the attachment AT reaches the end target position (hereinafter referred to as a "turning target end position") of the boom raising turning operation on the target trajectory, the controller 30 switches the master element from the upper pivot body 3 to the bucket 6 (change setting). Then, the controller 30 controls the operation of the arm 5 or the like so that the control reference of the attachment AT (for example, the work part such as the claw edge of the bucket 6) moves along a predetermined target trajectory in accordance with the opening operation of the bucket 6 corresponding to the operation command. At this time, the target trajectory is predetermined so that sediment is discharged to a predetermined target position on the loading platform of the dump truck. The target position on the loading platform of the dump truck may be changed in accordance with a predetermined condition in the series of work steps. Moreover, the controller 30 may switch the master element from the upper pivot body 3 to the arm 5, when the control reference (work part) of the attachment AT reaches the turning target end position on the target trajectory. This is because depending on the shape of the sediment already loaded on the dump truck, it may be necessary to discharge sediment at a position relatively separated from the machine body of the shovel 100. Thus, the controller 30 can realize the machine control function related to the sediment discharge operation according to the switching of the operation process from the boom raising turning operation to the sediment discharge operation.

When the control reference (work part) of the attachment AT reaches the target end position of the sediment discharge operation on the target trajectory, the controller 30 switches the master element from the bucket 6 to the upper pivot body 3 (change setting). Then, the controller 30 controls the operation of the boom 4 or the like so that the control reference of the attachment AT moves along a predetermined target trajectory in accordance with the turning operation of the upper pivot body 3 corresponding to the operation command. At this time, the target trajectory is determined in advance so that the bucket 6 returns to the original work position where the excavation operation was performed from the space above the loading platform of the dump truck without colliding with the dump gate or the like of the loading platform. Thus, the controller 30 can realize the machine control function related to the boom lowering turning operation according to the switching of the operation process from the sediment discharge operation to the boom lowering turning operation.

Moreover, when the control reference (work part) of the attachment AT reaches the target end position of the boom lowering turning operation on the target trajectory, that is, the target start position of the excavation operation (hereinafter referred to as an "excavation target start position"), the controller 30 switches the master element from the upper pivot body 3 to the arm 5 or the bucket 6 (change setting). Thus, the controller 30 can return the shovel 100 again to the excavation operation based on the machine control function, after the loading of sediment to the dump truck is completed.

In this way, in the present example, the controller 30 can switch the master element operating according to an operation command generated on the basis of the autonomous driving function, in accordance with the arrival of the current operating process on the target trajectory at the target end position.

<Process Related to Machine Control Function of Shovel>

Next, referring to FIGS. 14A and 14B, a processing flow related to yet another example of the machine control function by the controller 30 of the shovel 100 according to the present embodiment will be described.

FIGS. 14A and 14B are flowcharts schematically illustrating still another example of processing related to the machine control function by the controller 30 of the shovel 100 according to the present embodiment, and specifically, still another example of the master switching process. The flowcharts of FIGS. 14A and 14B may be performed repeatedly when the autonomous driving function of the shovel 100 is valid.

As shown in FIG. 14A, in step S702, the controller 30 determines whether the work part of the attachment AT (for example, the claw edge of the bucket 6) reaches the excavation target end position on the target trajectory of the excavation operation. When the work part (control reference) of the attachment AT reaches the excavation target end position, the controller 30 proceeds to step S704. When the work part has not reached the excavation target end position, the controller 30 repeats the process of the present step until the work part reaches the position.

In step S704, the controller 30 switches the master element from the arm 5 to the upper pivot body 3. When the processing in step S704 is completed, the controller 30 proceeds to step S706.

In step S706, the controller 30 determines whether the work part of the attachment AT (for example, the back surface of the bucket 6) has reached the turning target end position on the target trajectory of the boom raising turning operation. When the work part of the attachment AT reaches the turning target end position, the controller 30 proceeds to step S708. When the work part has not reached the turning target end position, the controller 30 repeats the process of the present step until the work side reaches the position.

In step S708, the controller 30 determines a shape of the sediment on the loading platform of the dump truck on the basis of the output of the space recognition device 70. When the processing in step S708 is completed, the controller 30 proceeds to step S710.

In step S710, the controller 30 determines whether the amount of the sediment in a region relatively close to the machine body of the shovel 100 on the loading platform of the dump truck is relatively small. When the amount of the sediment in the region relatively close to the machine body of the shovel 100 is relatively small, the controller 30 proceeds to step S712. Otherwise, i.e. when the amount is relatively large, the controller 30 proceeds to step S714.

In step S712, the controller 30 switches the master element from the upper pivot body 3 to the bucket 6. Thus, the controller 30 operates the bucket 6 in accordance with the operation command, and thereby the controller 30 can discharge the sediment of the bucket 6 to the region relatively close to the machine body of the shovel 100 on the loading platform of the dump truck. When the processing in step S712 is completed, the controller 30 proceeds to step S716.

On the other hand, in step S714, the controller 30 switches the master element from the upper pivot body 3 to the arm 5. Thus, the controller 30 operates the arm 5 in accordance with the operation command, and thereby the controller 30 can discharge the sediment of the bucket 6 to a region relatively separated from the machine body of the shovel 100 on the loading platform of the dump truck. When the processing in step S714 is completed, the controller 30 proceeds to step S716.

As shown in FIG. 14B, in step S716, the controller 30 determines whether the work part of the attachment AT (for example, the claw edge of the bucket 6) has reached the target end position of the sediment discharge operation on the target trajectory of the sediment discharge operation. When the work part of the attachment AT reaches the target end position of the sediment discharge operation, the controller 30 proceeds to step S718. When the work part has not reached the target end position, the controller 30 repeats the process of the present step until the work part reaches the target end position.

In step S718, the controller 30 switches the master element from the bucket 6 or the arm 5 to the upper pivot body 3. When the process of step S718 is completed, the controller 30 proceeds to step S720.

In step S720, the controller 30 determines whether the work part of the attachment AT (e.g. the back surface of the bucket 6) reaches the excavation target start position on the target trajectory of the boom lowering turning operation. When the work part of the attachment AT reaches the excavation target start position, the controller 30 proceeds to step S722. When the work part has not reached the target start position, the controller 30 repeats the process of the present step until the work part reaches the target start position.

In step S722, the controller 30 switches the master element from the upper pivot body 3 to the arm 5. When the process in step S722 is completed, the controller 30 terminates the process of the present flowchart.

Thus, in this example, the controller 30 selects either one of the arm 5 (arm cylinder 8) and the bucket 6 (bucket cylinder 9) as the master element on the basis of the shape of the sediment on the sediment discharging place (the loading platform of the dump truck) on starting the sediment discharge operation. Specifically, the controller 30 sets the master element to the bucket 6 (bucket cylinder 9) when the amount of the sediment in the region relatively close to the machine body of the shovel 100 is relatively small. The controller 30 sets the master element to the arm 5 (arm cylinder 8) when the amount of the sediment in the region relatively close to the machine body of the shovel 100 is relatively large. Thus, the shovel 100 can switch the master element in accordance with the shape of the sediment on the sediment discharging place in the sediment discharge operation. Therefore, the shovel 100 can discharge sediment to a more appropriate region of the sediment discharge place by the machine control function (automatic driving function).

In addition, similar processing may be performed at the start of the sediment discharge operation in another example of the machine control function described above. That is, the controller 30 may select either one of the arm 5 and the bucket 6 as the master element on the basis of the shape of the sediment on the sediment discharging place when the sediment discharge operation start condition in another example of the above-described machine control function is satisfied.

[Shovel Management System]

Next, a shovel management system SYS will be described with reference to FIG. 15.

Figure 15:
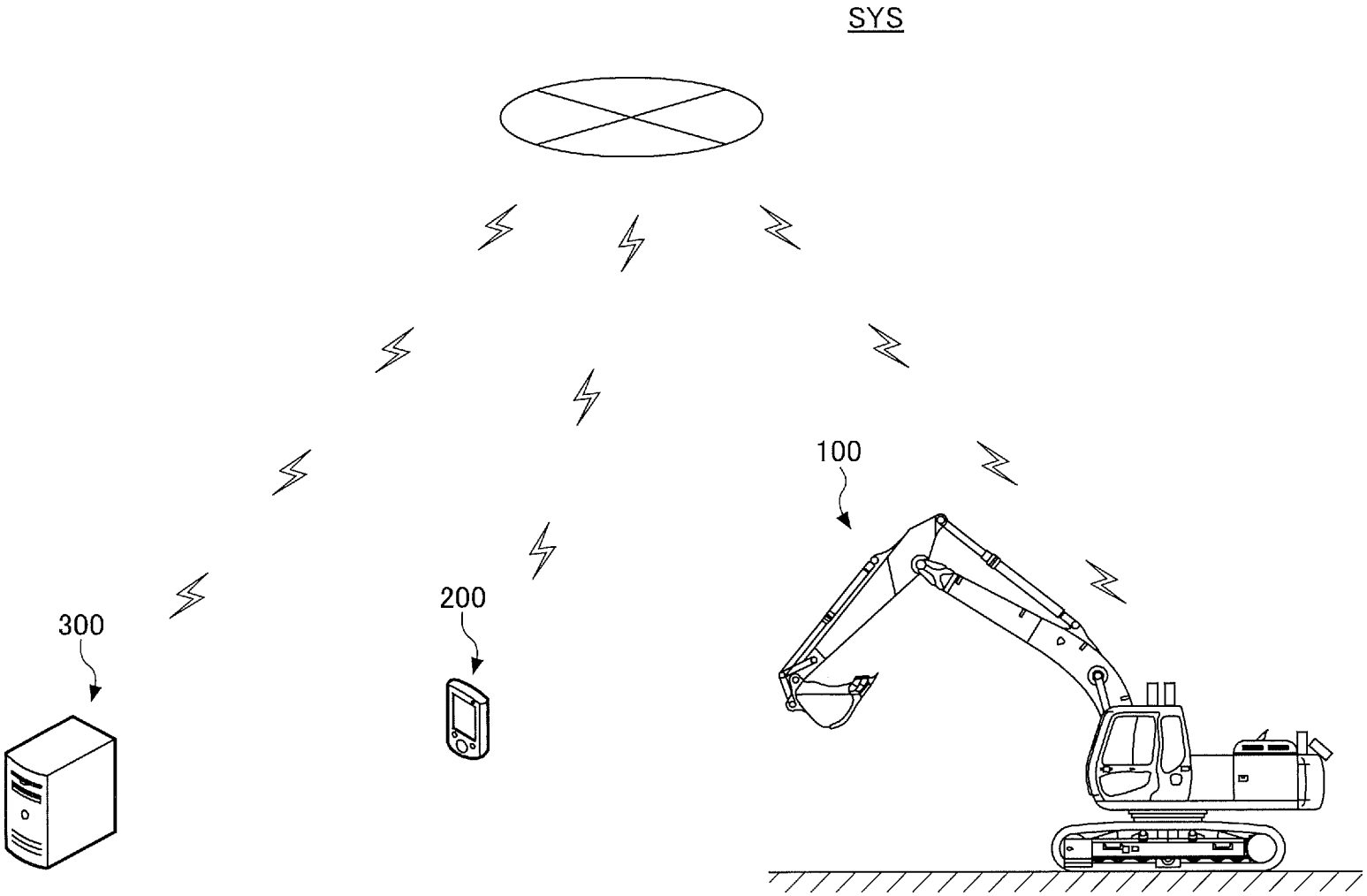
FIG. 15 is a schematic view for illustrating an example of a shovel management system.

FIG. 15 is a schematic view illustrating an example of the shovel management system SYS.

As shown in FIG. 15, the shovel management system SYS includes a shovel 100, a support device 200, and a management device 300. The shovel management system SYS is a system for managing a shovel 100 or a plurality of shovels 100.

Information acquired by the shovel 100 may be shared by a manager and an operator of another shovel through the shovel management system SYS. One or more shovels 100, one or more support devices 200, and one or more management devices 300 constitute the shovel management system SYS. In the present example, the shovel management system SYS includes one shovel 100, one support device 200 and one management device 300.

The support device 200 is typically a portable terminal device, for example, a laptop computer terminal, a tablet terminal, or a smartphone, which is carried by a worker or the like at a construction site. The support device 200 may be a portable terminal carried by the operator of the shovel 100. The support device 200 may be a fixed terminal device.

The management device 300 is typically a fixed terminal device, for example, a server computer (so-called cloud server) installed in a management center or the like outside the construction site. Moreover, the management device 300 may be, for example, an edge server set at the construction site. The management device 300 may be a portable terminal device (for example, a portable terminal such as a laptop computer terminal, a tablet terminal, or a smartphone).

The support device 200, the management device 300, or both may include a monitor and an operation device for remote operation. In this case, the operator using the support device 200 and the management device 300 may operate the shovel 100 while using the operation device for remote operation. The operation device for remote operation is communicatively connected to the controller 30 mounted on the shovel 100 through a wireless communication network such as a short-range wireless communication network, a cellular phone communication network, or a satellite communication network.

Moreover, various information images displayed on the display device D1 installed in the cabin 10 (for example, image information representing a situation around the shovel 100, or various setting screens) may be displayed on a display device connected to the support device 200, the management device 300, or both. The image information representing the situation around the shovel 100 may be generated on the basis of a captured image of the space recognition device 70. Thus, the worker who uses the support device 200 or the manager who uses the management device 300 can perform remote operation for the shovel 100 or perform various settings related to the shovel 100 while monitoring the situation around the shovel 100.

For example, in the shovel management system SYS, the controller 30 of the shovel 100 may transmit information on the machine control function being executed to the support device 200, the management device 300, or both. At this time, the controller 30 may transmit the output of the space recognition device 70, the image captured by the monocular camera, or both, to the support device 200, the management device 300, or both. The image may be a plurality of images captured during execution of the machine control function. Furthermore, the controller 30 may transmit, to the support device 200, the management device 300, or both, information on data related to the operation content of the shovel 100 during execution of the machine control function, data related to a posture of the shovel 100, data related to a posture of the excavation attachment, or any combination thereof. The information is transmitted so that the worker who uses the support device 200 or the manager who uses the management device 300 can acquire information on the shovel 100 during execution of the machine control function.

In this manner, the shovel management system SYS allows information relating to the shovel 100 acquired during execution of the machine control function to be shared with the manager and the operator of another shovel.

[Variation and Change]

While embodiments have been described in detail, the present disclosure is not limited to such specific embodiments, but various modifications and change may be made within the spirit and scope of the appended claims.

For example, in the embodiment described above, an example of the machine control function of the shovel 100 may be combined with another example. Specifically, during the excavation operation of the shovel 100 in the other example of the machine control function described above, the method of switching the master element (FIG. 7A) in the example of the machine control described above may be applied.

For example, in the above-described embodiments and variations, the shovel 100 is configured to hydraulically drive all of the various operation elements such as the lower traveling body 1, the upper pivot body 3, the boom 4, the arm 5, and the bucket 6. However, some of them may be electrically driven. That is, the configuration or the like disclosed in the above-described embodiment may be applied to a hybrid shovel, an electric shovel, or the like.

What is claimed is:

1. A shovel comprising:

a lower travelling body;

an upper pivot body pivotably mounted to the lower travelling body;

an attachment attached to the upper pivot body, the attachment including an arm and a bucket;

an arm cylinder configured to drive the arm;

a bucket cylinder configured to drive the bucket; and a hardware processor configured to control an operation of the bucket cylinder in accordance with an operation of the arm cylinder so that a work part of the attachment is along a target construction surface, wherein the hardware processor is configured to, in response to determining that the work part is within a predetermined distance from a corner of the target construction surface, control the operation of the bucket cylinder in accordance with an operation input related to the attachment, and control the operation of the arm cylinder in accordance with the operation of the bucket cylinder so that the work part moves along the target construction surface, and wherein the hardware processor is configured to determine that the work part is within the predetermined distance from the corner of the target construction surface when the work part is within the predetermined distance from: a portion of the target construction surface in which an inclination changes intermittently in an extension direction of the attachment relative to the upper pivot body in a top view of the shovel; a portion of the target construction surface in which a curvature exceeds a predetermined reference in the extension direction of the attachment; or a portion of the target construction surface in which a direction of bending changes in the extension direction of the attachment.

2. The shovel as claimed in claim 1, further comprising:
a boom cylinder configured to drive a boom included in the attachment,
wherein the hardware processor is further configured to control an operation of the boom cylinder in accordance with the operation of the arm cylinder so that the work part is along the target construction surface, and
wherein the hardware processor is configured to, in response to determining that the work part is moving along a slope having an inclination angle viewed from the shovel on the target construction surface being greater than a predetermined reference,
control the operation of the boom cylinder in accordance with the operation input related to the attachment, and
control the operation of the arm cylinder in accordance with the operation of the boom cylinder so that the work part moves along the target construction surface.

3. The shovel as claimed in claim 1, further comprising:
a boom cylinder configured to drive a boom included in the attachment,
wherein the hardware processor is further configured to, in response to a start of a discharge operation of the shovel,
select one of the arm cylinder or the boom cylinder on a basis of a shape of sediment at a discharge position,
control an operation of the selected one of the arm cylinder or the boom cylinder in accordance with the operation input related to the attachment, and
control an operation of another one of the arm cylinder or the boom cylinder in accordance with the operation of the selected one of the arm cylinder or the boom cylinder.

4. The shovel as claimed in claim 1,
wherein the hardware processor is further configured to control the operation of the bucket cylinder in accordance with the operation input related to the attachment and control the operation of the arm cylinder in accordance with the operation of the bucket cylinder so that the work part moves along the target construction surface, in response to determining that an amount of sediment in a region that is closer to the shovel than another region is smaller than an amount of sediment in said another region, and
wherein the hardware processor is configured to control the operation of the arm cylinder in accordance with the operation input related to the attachment and control the operation of the bucket cylinder in accordance with the operation of the arm cylinder so that the work part moves along the target construction surface, in response to determining that the amount of sediment in the region that is closer to the shovel is larger than the amount of sediment in said another region.

5. The shovel as claimed in claim 1, further comprising:
a travelling motor configured to drive the lower travelling body;
a pivot motor configured to drive the upper pivot body;
a boom cylinder configured to drive a boom included in the attachment; and
a sensor configured to recognize a situation around the shovel,
wherein the hardware processor is configured to disable the travelling motor, the pivot motor, the boom cylinder, the arm cylinder, and the bucket cylinder in response to determining that a person is present within a predetermined range around the shovel on a basis of information acquired by the sensor before starting operations of the travelling motor, the pivot motor, the boom cylinder, the arm cylinder, and the bucket cylinder.

6. The shovel as claimed in claim 1, further comprising:
a travelling motor configured to drive the lower travelling body;
a pivot motor configured to drive the upper pivot body;
a boom cylinder configured to drive a boom included in the attachment;
a sensor configured to recognize a situation around the shovel; and
an operation lever configured to receive operations for the travelling motor, the pivot motor, the boom cylinder, the arm cylinder, and the bucket cylinder,
wherein the hardware processor is configured to refrain from driving the travelling motor, the pivot motor, the boom cylinder, the arm cylinder, and the bucket cylinder even when the operation lever is operated, in response to determining that a person is present within a predetermined range around the shovel on a basis of information acquired by the sensor before starting operations of the travelling motor, the pivot motor, the boom cylinder, the arm cylinder, and the bucket cylinder.

7. The shovel as claimed in claim 1, wherein the hardware processor is further configured to control the operation of the arm cylinder in accordance with the operation input related to the attachment and control the operation of the bucket cylinder in accordance with the operation of the arm cylinder, in response to determining completion of aligning a posture of the bucket with a portion of the target construction surface ahead of the corner after determining that the work part is within the predetermined distance from the corner of the target construction surface.

8. A shovel comprising:
a lower travelling body;
an upper pivot body pivotably mounted to the lower travelling body;
an attachment attached to the upper pivot body, the attachment including a boom and an arm;
a pivot motor configured to turn the upper pivot body;
a boom cylinder configured to drive the boom;
an arm cylinder configured to drive the arm; and
a hardware processor configured to control an operation of the boom cylinder in accordance with an operation of the arm cylinder so that the attachment is along a target trajectory, when an operation related to the arm is performed,
wherein the hardware processor is configured to, in response to switching from a state in which the operation related to the arm is performed to a state in which an operation related to the upper pivot body is performed,
control an operation of the pivot motor in accordance with an operation input related to the upper pivot body, and
control the operation of the boom cylinder in accordance with the operation of the pivot motor so that the attachment is along the target trajectory.

9. The shovel as claimed in claim 8, further comprising:
a bucket cylinder configured to drive a bucket included in the attachment,
wherein the hardware processor is further configured to, when the operation related to the upper pivot body is performed, control the operation of the boom cylinder in accordance with the operation of the pivot motor, and wherein the hardware processor is further configured to, in response to switching from the state in which the operation related to the upper pivot body is performed to a state in which an operation related to the bucket is performed, control an operation of the bucket cylinder in accordance with an operation input related to the bucket, and control the operation of the arm cylinder in accordance with the operation of the bucket cylinder.

10. The shovel as claimed in claim 8, wherein the pivot motor is a hydraulic motor.

11. The shovel as claimed in claim 8, further comprising:

a travelling motor configured to drive the lower travelling body;

a bucket cylinder configured to drive a bucket included in the attachment; and a sensor configured to recognize a situation around the shovel, wherein the hardware processor is configured to disable the travelling motor, the pivot motor, the boom cylinder, the arm cylinder, and the bucket cylinder in response to determining that a person is present within a predetermined range around the shovel on a basis of information acquired by the sensor before starting operations of the travelling motor, the pivot motor, the boom cylinder, the arm cylinder, and the bucket cylinder.

12. The shovel as claimed in claim 8, further comprising:

a travelling motor configured to drive the lower travelling body;

a bucket cylinder configured to drive a bucket included in the attachment;

a sensor configured to recognize a situation around the shovel; and an operation lever configured to receive operations for the travelling motor, the pivot motor, the boom cylinder, the arm cylinder, and the bucket cylinder, wherein the hardware processor is configured to refrain from driving the travelling motor, the pivot motor, the boom cylinder, the arm cylinder, and the bucket cylinder even when the operation lever is operated, in response to determining that a person is present within a predetermined range around the shovel on a basis of information acquired by the sensor before starting operations of the travelling motor, the pivot motor, the boom cylinder, the arm cylinder, and the bucket cylinder.

13. A control device for a shovel, the shovel including a lower travelling body; an upper pivot body pivotably mounted to the lower travelling body; an attachment attached to the upper pivot body, the attachment including an arm and a bucket;

an arm cylinder configured to drive the arm; and a bucket cylinder configured to drive the bucket, the control device comprising:

a hardware processor configured to control an operation of the bucket cylinder in accordance with an operation of the arm cylinder so that a work part of the attachment is along a target construction surface, wherein the hardware processor is configured to, in response to determining that the work part is within a predetermined distance from a corner of the target construction surface, control the operation of the bucket cylinder in accordance with an operation input related to the attachment, and control the operation of the arm cylinder in accordance with the operation of the bucket cylinder so that the work part moves along the target construction surface, and wherein the hardware processor is configured to determine that the work part is within the predetermined distance from the corner of the target construction surface when the work part is within the predetermined distance from: a portion of the target construction surface in which an inclination changes intermittently in an extension direction of the attachment relative to the upper pivot body in a top view of the shovel; a portion of the target construction surface in which a curvature exceeds a predetermined reference in the extension direction of the attachment; or a portion of the target construction surface in which a direction of bending changes in the extension direction of the attachment.

* * * * *